US005264337A

United States Patent [19]

Maskasky

[11] Patent Number: 5,264,337

[45] Date of Patent: Nov. 23, 1993

[54] MODERATE ASPECT RATIO TABULAR GRAIN HIGH CHLORIDE EMULSIONS WITH INHERENTLY STABLE GRAIN FACES

[75] Inventor: Joe E. Maskasky, Rochester, N.Y.

[73] Assignee: Eastman Kodak Company, Rochester, N.Y.

[21] Appl. No.: 34,998

[22] Filed: Mar. 22, 1993

[51] Int. Cl.[5] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,063,951 | 12/1977 | Bogg | 96/94 |
| 4,386,156 | 5/1983 | Mignot | 430/567 |
| 4,399,215 | 8/1983 | Wey | 430/567 |
| 4,400,463 | 8/1983 | Maskasky | 430/434 |
| 4,414,306 | 11/1983 | Wey et al. | 430/434 |
| 4,713,323 | 12/1987 | Maskasky | 430/569 |
| 4,783,398 | 11/1988 | Takada et al. | 430/567 |
| 4,804,621 | 2/1989 | Tufano et al. | 430/567 |
| 4,942,120 | 7/1990 | King et al. | 430/567 |
| 4,952,491 | 8/1990 | Nishikawa et al. | 430/570 |
| 4,983,508 | 1/1991 | Ishiguro et al. | 430/569 |
| 5,178,997 | 2/1993 | Maskasky | 430/569 |
| 5,178,998 | 2/1993 | Maskasky | 430/569 |
| 5,183,732 | 1/1993 | Maskasky | 430/569 |
| 5,185,239 | 1/1993 | Maskasky | 430/569 |

FOREIGN PATENT DOCUMENTS 2-024643 1/1990 Japan .

OTHER PUBLICATIONS

Endo and Okaji, "An Empirical Rule to Modify the Habit of Silver Chloride to form Tabular Grains in an Emulsion", The Journal of Photographic Science, vol. 36, pp. 182-188, 1988.

Mumaw and Haugh, "Siler Halide Precipitation Coalescence Processes", Journal of Imaging Science, vol. 30, No. 5, Sep./Oct., 1986, pp. 198-209.

Symposium: Torino 1963, Photographic Science, Edited by C. Semerano and U. Mazzucato, Focal Press, pp. 52-55.

*Primary Examiner*—Janet C. Baxter

*Attorney, Agent, or Firm*—Carl O. Thomas

[57] ABSTRACT

A radiation sensitive emulsion is disclosed containing a silver halide grain population internally free of iodide at the site of grain nucleation comprised of at least 50 mole percent chloride, based on total silver forming the grain population. Greater than 50 percent of the grain population projected area is accounted for by {100} tabular grains which have an average aspect ratio of up to 7.5.

11 Claims, 1 Drawing Sheet

FIG. 1
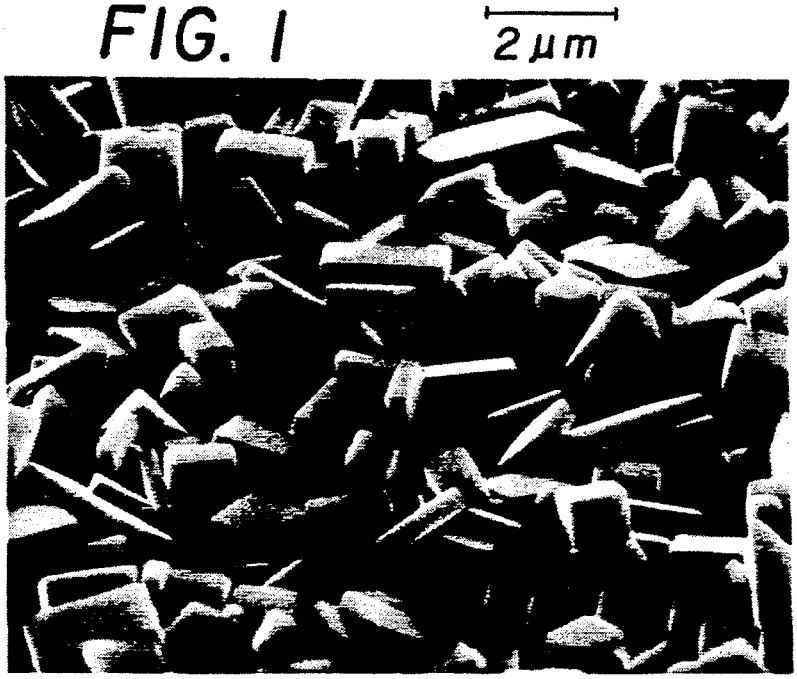
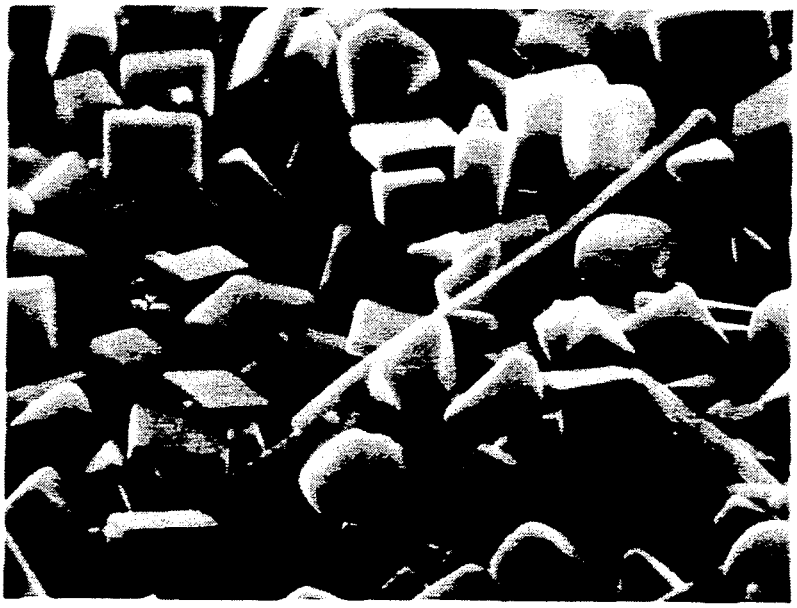
FIG. 2

MODERATE ASPECT RATIO TABULAR GRAIN HIGH CHLORIDE EMULSIONS WITH INHERENTLY STABLE GRAIN FACES

FIELD OF THE INVENTION

The invention relates to silver halide photography. More specifically, the invention relates to radiation sensitive silver halide emulsions useful in photography.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. By a wide margin the most commonly employed photographic emulsions are silver bromide and iodobromide emulsions. Although known and used for many years for selected photographic applications, the more rapid developability and the ecological advantages of high chloride emulsions have provided an impetus for employing these emulsions over a broader range of photographic applications. As employed herein the term "high chloride emulsion" refers to a silver halide emulsion containing at least 50 mole percent chloride, based on total silver. In referring to grains of mixed halide content, the halides are named in order of increasing molar concentrations—e.g., silver iodochloride contains a higher molar concentration of chloride than iodide. The most ecologically attractive high chloride emulsions are those that contain very low levels of bromide and/or iodide ion and preferably none. Of the halide ions available for use in constructing photographic emulsions chloride ions are the most ecologically compatible while iodide ions are the least attractive for use.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multi-emulsion layer formats, can be realized by increasing the proportions of selected tabular grain populations in photographic emulsions.

An emulsion is generally understood to be a "tabular grain emulsion" when tabular grains account for at least 50 percent of total grain projected area. A grain is generally considered to be a tabular grain when the ratio of its equivalent circular diameter (ECD) to its thickness (t) is at least 2. The equivalent circular diameter of a grain is the diameter of a circle having an area equal to the projected area of the grain. The term "intermediate aspect ratio tabular grain emulsion" refers to an emulsion which has an average tabular grain aspect ratio in the range of from 5 to 8. The term "thin tabular grain" is generally understood to be a tabular grain having a thickness of less than 0.2 $\mu$m.

The overwhelming majority of tabular grain emulsions contain tabular grains that are irregular octahedral grains. Regular octahedral grains contain eight identical crystal faces, each lying in a different {111} crystallographic plane. Tabular irregular octahedra contain two or more parallel twin planes that separate two major grain faces lying in {111} crystallographic planes. The {111} major faces of the tabular grains exhibit a threefold symmetry, appearing triangular or hexagonal. It is generally accepted that the tabular shape of the grains is the result of the twin planes producing favored edge sites for silver halide deposition, with the result that the grains grow laterally while increasing little, if any, in thickness after parallel twin plane incorporation.

While tabular grain emulsions have been advantageously employed in a wide variety of photographic and radiographic applications, the requirement of parallel twin plane formation and {111} crystal faces pose limitations both in emulsion preparation and use. These disadvantages are most in evidence in considering tabular grains containing significant chloride concentrations. It is generally recognized that silver chloride grains prefer to form regular cubic grains—that is, grains bounded by six identical {100} crystal faces. Tabular grains bounded by {111} faces in silver chloride emulsions often revert to nontabular forms unless morphologically stabilized.

While tabular grain silver bromide emulsions were known to the art long before the 1980's, Wey U.S. Pat. No. 4,399,215 produced the first tabular grain silver chloride emulsion. The tabular grains were of the twinned type, exhibiting major faces of threefold symmetry lying in {111} crystallographic planes. An ammoniacal double-jet precipitation technique was employed. The thicknesses of the tabular grains were high compared to contemporaneous silver bromide and bromoiodide tabular grain emulsions because the ammonia ripening agent thickened the tabular grains. To achieve ammonia ripening it was also necessary to precipitate the emulsions at a relatively high pH, which is known to produce elevated minimum densities (fog) in high chloride emulsions. Further, to avoid degrading the tabular grain geometries sought both bromide and iodide ions were excluded from the tabular grains early in their formation.

Wey et al U.S. Pat. No. 4,414,306 developed a twinning process for preparing silver chlorobromide emulsions containing up to 40 mole percent chloride based on total silver. This process of preparation has not been successfully extended to high chloride emulsions. The highest average aspect ratio reported in the Examples was 11.

Maskasky U.S. Pat. No. 4,400,463 (hereinafter designated Maskasky I) developed a strategy for preparing a high chloride emulsion containing tabular grains with parallel twin planes and {111} major crystal faces with the significant advantage of tolerating significant internal inclusions of the other halides. The strategy was to use a particularly selected synthetic polymeric peptizer in combination with a grain growth modifier having as its function to promote the formation of {111} crystal faces. Adsorbed aminoazaindenes, preferably adenine, and iodide ions were disclosed to be useful grain growth modifiers.

Maskasky U.S. Pat. No. 4,713,323 (hereinafter designated Maskasky II), significantly advanced the state of the art by preparing high chloride emulsions containing tabular grains with parallel twin planes and {111} major crystal faces using an aminoazaindene growth modifier and a gelatino-peptizer containing up to 30 micromoles per gram of methionine. Since the methionine content of a gelatino-peptizer, if objectionably high, can be readily reduced by treatment with a strong oxidizing agent (or alkylating agent King et al U.S. Pat. No.

4,942,120), Maskasky II placed within reach of the art high chloride tabular grain emulsions with significant bromide and iodide ion inclusions prepared starting with conventional and universally available peptizers.

Maskasky I and II have stimulated further investigations of grain growth modifiers capable of preparing high chloride emulsions of similar tabular grain content. Tufano et al U.S. Pat. No. 4,804,621 employed di(hydroamino)azines as grain growth modifiers; Takada et al U.S. Pat. No. 4,783,398 employed heterocycles containing a divalent sulfur ring atom; Nishikawa et al U.S. Pat. No. 4,952,491 employed spectral sensitizing dyes and divalent sulfur atom containing heterocycles and acyclic compounds; and Ishiguro et al U.S. Pat. No. 4,983,508 employed organic bis-quaternary amine salts.

Bogg U.S. Pat. No. 4,063,951 reported the first tabular grain emulsions in which the tabular grains had parallel {100} major crystal faces. The tabular grains of Bogg exhibited square or rectangular major faces, thus lacking the threefold symmetry of conventional tabular grain {111} major crystal faces. In the sole example Bogg employed an ammoniacal ripening process for preparing silver bromoiodide tabular grains having aspect ratios ranging from 4:1 to 1:1. The average aspect ratio of the emulsion was reported to be 2, with the highest aspect ratio grain (grain A in FIG. 3) being only 4. Bogg states that the emulsions can contain no more than 1 percent iodide and demonstrates only a 99.5% bromide 0.5% iodide emulsion. Attempts to prepare tabular grain emulsions by the procedures of Bogg have been unsuccessful.

Mignot U.S. Pat. No. 4,386,156 represents an improvement over Bogg in that the disadvantages of ammoniacal ripening were avoided in preparing a silver bromide emulsion containing tabular grains with square and rectangular major faces. Mignot specifically requires ripening in the absence of silver halide ripening agents other than bromide ion (e.g., thiocyanate, thioether or ammonia).

Endo and Okaji, "An Empirical Rule to Modify the Habit of Silver Chloride to form Tabular Grains in an Emulsion", *The Journal of Photographic Science*, Vol. 36, pp. 182–188, 1988, discloses silver chloride emulsions prepared in the presence of a thiocyanate ripening agent. Emulsion preparations by the procedures disclosed has produced emulsions containing a few tabular grains within a general grain population exhibiting mixed {111} and {100} faces.

Mumaw and Haugh, "Silver Halide Precipitation Coalescence Processes", *Journal of Imaging Science*, Vol. 30, No. 5, Sept./Oct. 1986, pp. 198–299, is essentially cumulative with Endo and Okaji, with section IV-B being particularly pertinent.

Symposium: Torino 1963, *Photographic Science*, Edited by C. Semerano and U. Mazzucato, Focal Press, pp. 52–55, discloses the ripening of a cubic grain silver chloride emulsion for several hours at 77° C. During ripening tabular grains emerged and the original cubic grains were depleted by Ostwald ripening. As demonstrated by the comparative Example below, after 3 hours of ripening tabular grains account for only a small fraction of the total grain projected area, and only a small fraction of the tabular grains were less than 0.3 μm in thickness. In further investigations going beyond the actual teachings provided, extended ripening eliminated many of the smaller cubic grains, but also degraded many of the tabular grains to thicker forms.

Japanese published patent application (Kokai) 02/024,643, laid open Jan. 26, 1990, was cited in a Patent Cooperation Treaty search report as being pertinent to the tabular grain structures claimed, but is in Applicant's view unrelated. The claim is directed to a negative working emulsion containing a hydrazide derivative and tabular grains with an equivalent circular diameter of 0.6 to 0.2 μm. Only conventional tabular grain preparations are disclosed and only silver bromide and bromoiodide emulsions are exemplified.

Maskasky U.S. Pat. Nos. 5,185,239 and 5,183,732, (hereinafter designated Maskasky IIIa and IIIb) each disclose a process for preparing a high chloride {111} tabular grain emulsion in which silver ion is introduced into a gelatino-peptizer dispersing medium containing a stoichiometric excess of chloride ions of less than 0.5 molar, a pH of at least 4.6, and a grain growth modifier. In Maskasky IIIa the grain growth modifier is a triaminopyrimidine with mutually independent 4, 5 and 6 ring position substitutes, while in Maskasky IIIb the grain growth modifier is adenine.

Maskasky U.S. Pat. No. 5,178,997, (hereinafter designated Maskasky IV) discloses a process for preparing a high chloride {111} tabular grain emulsion in which silver ion is introduced into a gelatino-peptizer dispersing medium containing a stoichiometric excess of chloride ions of less than 0.5 molar and a grain growth modifier of the formula:

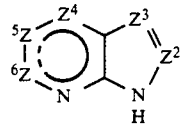

where $Z^2$ is $-C(R^2)=$ or $-N=$;

$Z^3$ is $-C(R^3)=$ or $-N=$;

$Z^4$ is $-C(R^4)=$ or $-N=$;

$Z^5$ is $-C(R^5)=$ or $-N=$;

$Z^6$ is $-C(R^6)=$ or $-N=$;

with the proviso that no more than one of $Z^4$, $Z^5$ and $Z^6$ is $-N=$;

$R^2$ is H, $NH_2$ or $CH_3$;

$R^3$, $R^4$ and $R^5$ are independently selected, $R^3$ and $R^5$ being hydrogen, halogen, amino or hydrocarbon and $R^4$ being hydrogen, halogen or hydrocarbon, each hydrocarbon moiety containing from 1 to 7 carbon atoms; and $R^6$ is H or $NH_2$.

Maskasky and Chang U.S. Pat. No. 5,178,998, (hereinafter designated Maskasky et al) discloses a process for preparing a high chloride tabular grain emulsion in which silver ion is introduced into a gelatino-peptizer dispersing medium containing a stoichiometric excess of chloride ions of less than 0.5 molar and a grain growth modifier of the formula:

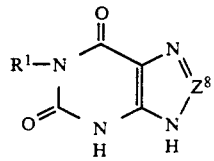

where $Z^8$ is $-C(R^8)=$ or $-N=$;

$R^8$ is H, $NH_2$ or $CH_3$; and $R^1$ is hydrogen or a hydrocarbon containing from 1 to 7 carbon atoms.

RELATED PATENT APPLICATIONS

Maskasky U.S. Ser. No. 035,349, filed concurrently herewith as a continuation-in-part of U.S. Ser. No. 955,010, filed Oct. 1, 1992, which is in turn a continuation-in-part of U.S. Ser. No. 764,868, filed Sep. 24, 1991, titled HIGH TABULARITY HIGH CHLORIDE EMULSIONS WITH INHERENTLY STABLE GRAIN FACES, commonly assigned, (hereinafter referred to as Maskasky V), discloses high aspect ratio tabular grain high chloride emulsions containing tabular grains that are internally free of iodide and that have {100} major faces. In a preferred form, Maskasky V employs an organic compound containing a nitrogen atom with a resonance stabilized $\pi$ electron pair to favor formation of {100} faces.

House, Brust, Hartsell and Black U.S. Ser. No. 034,060, filed concurrently herewith as a continuation-in-part of U.S. Ser. No. 940,404, filed Sep. 3, 1992, which is in turn a continuation-in-part of U.S. Ser. No. 826,338, filed Jan. 27, 1992, each commonly assigned, titled HIGH ASPECT RATIO TABULAR GRAIN EMULSIONS, discloses emulsions containing tabular grains bounded by {100} major faces accounting for 50 percent of total grain projected area selected on the criteria of adjacent major face edge ratios of less than 10 and thicknesses of less than 0.3 μm and having higher aspect ratios than any remaining tabular grains satisfying these criteria (1) have an average aspect ratio of greater than 8 and (2) internally at their nucleation site contain iodide and at least 50 mole percent chloride.

Brust, House, Hartsell and Black U.S. Ser. No. 035,009, filed concurrently herewith and commonly assigned, titled MODERATE ASPECT RATIO TABULAR GRAIN EMULSIONS AND PROCESSES FOR THEIR PREPARATION, discloses radiation sensitive emulsions comprised of a dispersing medium and silver halide grains. At least 50 percent of total grain projected area is accounted for by tabular grains bounded by {100} major faces having adjacent edge ratios of less than 10, each having an aspect ratio of at least 2 and an average aspect ratio of up to 8, and internally at their nucleation site containing iodide and at least 50 mole percent chloride. A process of preparing the emulsions is also disclosed.

House, Brust, Hartsell, Black, Antoniades, Tsaur and Chang U.S. Ser. No. 033,738, filed concurrently herewith as a continuation-in-part of U.S. Ser. No. 940,404, filed Sep. 3, 1992, which is in turn a continuation-in-part of U.S. Ser. No. 826,338, filed Jan. 27, 1992, each commonly assigned, titled PROCESSES OF PREPARING TABULAR GRAIN EMULSIONS, discloses processes of preparing emulsions containing tabular grains bounded by {100} major faces of which tabular grains bounded by {100} major faces account for 50 percent of total grain projected area selected on the criteria of adjacent major face edge ratios of less than 10 and thicknesses of less than 0.3 μm and internally at their nucleation site contain iodide and at least 50 mole percent chloride, comprised of the steps of (1) introducing silver and halide salts into the dispersing medium so that nucleation of the tabular grains occurs in the presence of iodide with chloride accounting for at least 50 mole percent of the halide present in the dispersing medium and the pCl of the dispersing medium being maintained in the range of from 0.5 to 3.5 and (2) following nucleation completing grain growth under conditions that maintain the {100} major faces of the tabular grains until the tabular grains exhibit an average aspect ratio of greater than 8.

Puckett U.S. Ser. No. 033,739, filed concurrently herewith and commonly assigned, titled OLIGOMER MODIFIED TABULAR GRAIN EMULSIONS discloses radiation sensitive emulsions and processes for their preparation. At least 50 percent of total grain projected area is accounted for by high chloride tabular grains bounded by {100} major faces having adjacent edge ratios of less than 10, each having an aspect ratio of at least 2 and containing on average at least one pair of metal ions chosen from group VIII, periods 5 and 6, at adjacent cation sites in their crystal lattice.

Brust, House, Hartsell, Black, Marchetti and Budz U.S. Ser. No. 034,982, filed concurrently herewith as a continuation-in-part of U.S. Ser. No. 940,404, filed Sep. 3, 1992, which is in turn a continuation-in-part of U.S. Ser. No. 826,338, filed Jan. 27, 1992, each commonly assigned, titled COORDINATION COMPLEX LIGAND MODIFIED TABULAR GRAIN EMULSIONS, discloses emulsions containing tabular grains bounded by {100} major faces accounting for 50 percent of total grain projected area selected on the criteria of adjacent major face edge ratios of less than 10 and thicknesses of less than 0.3 μm and having higher aspect ratios than any remaining tabular grains satisfying these criteria (1) have an average aspect ratio of greater than 8 and (2) internally at their nucleation site contain iodide and at least 50 mole percent chloride. The tabular grain contain non-halide coordination complex ligands.

Budz, Ligtenberg and Roberts U.S. Ser. No. 034,050, filed concurrently herewith and commonly assigned, titled DIGITAL IMAGING WITH TABULAR GRAIN EMULSIONS, discloses digitally imaging photographic elements containing tabular grain emulsions comprised of a dispersing medium and silver halide grains containing at least 50 mole percent chloride, based on total silver. At least 50 percent of total grain projected area is accounted for by tabular grains bounded by {100} major faces having adjacent edge ratios of less than 10, each having an aspect ratio of at least 2, and internally at their nucleation site containing iodide and at least 50 mole percent chloride.

Szajewski U.S. Ser. No. 034,061, filed concurrently herewith and commonly assigned, titled FILM AND CAMERA, discloses roll films and roll film containing cameras containing at least one emulsion layer is present containing tabular grain emulsions comprised of a dispersing medium and silver halide grains containing at least 50 mole percent chloride, based on total silver. At least 50 percent of total grain projected area is accounted for by tabular grains bounded by {100} major faces having adjacent edge ratios of less than 10, each having an aspect ratio of at least 2, and internally at their nucleation site containing iodide and at least 50 mole percent chloride.

Szajewski, House, Brust, Hartsell, Black, Bohan and Merrill U.S. Ser. No. 034,997, filed concurrently herewith as a continuation-in-part of U.S. Ser. No. 940,404, filed Sep. 3, 1992, which is in turn a continuation-in-part of U.S. Ser. No. 826,338, filed Jan. 27, 1992, each commonly assigned, titled DYE IMAGE FORMING PHOTOGRAPHIC ELEMENTS, discloses dye image forming photographic elements containing at least one tabular grain emulsion comprised of a dispersing medium and silver halide grains. At least 50 percent of total grain projected area is accounted for by tabular grains bounded by {100} major faces having adjacent edge ratios of less than 10, each having an aspect ratio of at least 2, and internally at their nucleation site containing iodide and at least 50 mole percent chloride.

Lok and Budz U.S. Ser. No. 034,317, filed concurrently herewith and commonly assigned, titled TABULAR GRAIN EMULSIONS CONTAINING ANTIFOGGANTS AND STABILIZERS discloses tabular grain emulsions comprised of a dispersing medium, silver halide grains and at least one selected antifoggant or stabilizer. At least 50 percent of total grain projected area is accounted for by high chloride tabular grains bounded by {100} major faces having adjacent edge ratios of less than 10, each having an aspect ratio of at least 2.

Szajewski and Buchanan U.S. Ser. No. 035,347, filed concurrently herewith and commonly assigned, titled METHOD OF PROCESSING PHOTOGRAPHIC ELEMENTS CONTAINING TABULAR GRAIN EMULSIONS, discloses a process of developing and desilvering a dye image forming photographic element containing a high chloride {100} tabular grain emulsion of the type herein disclosed.

Maskasky U.S. Ser. No. 763,030, filed Sep. 17, 1991, commonly assigned and now allowed, titled ULTRATHIN HIGH CHLORIDE TABULAR GRAIN EMULSIONS, (hereinafter designated Maskasky VI) discloses a high chloride tabular grain emulsion in which greater than 50 percent of the total grain projected area is accounted for by ultrathin tabular grains having a thickness of less than 360 {111} crystal lattice planes. A {111} crystal face stabilizer is absorbed to the major faces of the ultrathin tabular grains.

SUMMARY OF THE INVENTION

In one aspect this invention is directed to a radiation sensitive emulsion containing a silver halide grain population internally free of iodide at the site of grain nucleation comprised of at least 50 mole percent chloride, based on total silver forming the grain population, in which greater than 50 percent of the grain population projected area is accounted for by tabular grains, wherein the tabular grains (a) have parallel major faces lying in {100} crystallographic planes and (b) each have an aspect ratio of at least 2 and together have an average aspect ratio of up to 7.5.

BRIEF DESCRIPTION OF THE DRAWINGS

FIGS. 1 and 2 are scanning electron photomicrographs of the grains of Examples 1 and 2, respectively.

DESCRIPTION OF PREFERRED EMBODIMENTS

The invention is directed to a photographically useful, radiation sensitive emulsion containing a silver halide grain population that is internally free of iodide at the grain nucleation site comprised of at least 50 mole percent chloride, based on total silver forming the grain population, in which greater than 50 percent of the projected area of the grain population is accounted for by tabular grains. The tabular grains (a) have parallel major faces lying in {100} crystallographic planes and (b) each have an aspect ratio of at least 2 and together have an average aspect ratio of up to 7.5. For brevity of expression tabular grains having parallel major faces lying in {100} crystallographic planes are also referred to as {100} tabular grains.

The emulsions of the invention combine the known advantages of tabular grains resulting from their characteristic non-isomorphic shape and the known advantages of high chloride content with tabular grain crystal faces that are inherently more stable than {111} crystal faces in high chloride emulsions.

The emulsions contain a high chloride {100} tabular grain population that is internally free of iodide at the grain nucleation site. That is, at the time the grains are formed no iodide is intentionally incorporated into the reaction vessel and hence no iodide is provided to be incorporated into the grains as they are formed. In a specifically preferred form of the invention the high chloride {100} tabular grains are internally free of iodide. The term "internally free of iodide" is herein employed to mean that no iodide ion is intentionally incorporated in the grains during their nucleation and growth prior to achieving their required tabular grain characteristics—i.e., prior to achieving an aspect ratio of at least 2. It is, of course, recognized that total iodide exclusion is not feasible, since both chloride and bromide salts of purity levels conventionally employed in photography contain low levels of iodide impurities. Further, precipitation of iodide ion onto the grain surfaces after the tabular grain characteristics sought have been obtained is a matter of choice, depending upon the photographic application to be served. It is generally preferred to limit the total iodide content of the grain population to less than 2 mole percent, optimally to less than 1 mole percent, based on total silver.

The high chloride {100} tabular grain population contains at least 50 mole percent chloride, based on total silver forming the grain population (hereinafter referred to as total silver), with any remaining halide being bromide or iodide (within the constraints noted above). Thus, the silver halide content of the grain population can consist essentially of silver chloride as the sole silver halide. Alternatively, the grain population can consist essentially of silver bromochloride, where bromide ion accounts for up to 50 mole percent of the silver halide, based on total silver. Preferred emulsions according to the invention contain less than 20 mole percent bromide, optimally less than 10 mole percent bromide, based on total silver. Silver iodochloride and silver iodobromochloride emulsions are also within the contemplation of the invention.

The dimensions of the tabular grains—i.e., their ECD, thickness (t) and aspect ratio (ECD/t)—are chosen to satisfy photographic requirements. The high chloride {100} tabular grains in the emulsions of the invention exhibit mean aspect ratios of up to 7.5. For many photographic applications emulsions of intermediate aspect ratios—that is, from 5 to 7.5—are preferred.

The tabular grain population can exhibit any grain thickness that is compatible with the average aspect ratios noted above. For many photograhic applications it is preferred that the {100} tabular grains accounting for at least 50 percent of total grain projected area have thicknesses of less than 0.3 μm and, optimally, less than 0.2 μm. It is appreciated that when the thicknesses of the tabular grains are limited the mean tabular grain ECD's of the emulsions are also limited. Thus, the mean ECD of {100} tabular grains having thicknesses of less than 0.3 μm or 0.2 μm is less than 2.35 μm or 1.5 μm, respectively.

There are specific photographic applications that can benefit by greater tabular grain thicknesses. For example, in constructing a blue recording emulsion layer of maximum achievable speed it is specifically contemplated that tabular grain thicknesses that are on average 1 μm or or even larger, but preferably up to 0.8 μm, can be tolerated. This is because the eye is least sensitive to the blue record and hence higher levels of image granularity (noise) can be tolerated without objection. There is an additional incentive for employing larger grains in the blue record in that it is sometimes difficult to match in the blue record the highest speeds attainable in the green and red record. A source of this difficulty resides in the blue photon deficiency of sunlight. While sunlight on an energy basis exhibits equal parts of blue, green and red light, at shorter wavelengths the photons have higher energy. Hence on a photon distribution basis daylight is slightly blue deficient.

When tabular grain thicknesses are large (e.g., greater than 0.5 μm), the {100} tabular grain population can exhibit a mean ECD that ranges up to the highest photographically useful magnitudes. For photographic utility average ECD's of less than 10 μm are contemplated, although average ECD's in most photographic applications rarely exceed 6 μm. As is generally understood by those skilled in the art, tabular grain emulsions having higher ECD's are advantageous for achieving relatively high levels of photographic sensitivity while tabular grain emulsions with lower ECD's are advantageous in achieving low levels of granularity.

So long as the population of tabular grains satisfying the parameters noted above accounts for at least 50 percent of total grain projected area a photographically desirable grain population is available. It is recognized that the advantageous properties of the emulsions of the invention are increased as the proportion of tabular grains having {100} major faces is increased. The preferred emulsions according to the invention are those in which at least 70 percent and optimally at least 90 percent of total grain projected area is accounted for by tabular grains having {100} major faces. When no significant grain population other than the {100} tabular grains are present in the emulsion, {100} tabular grain projected area can approach 100 percent of the total grain projected area. If tabular grains do not account for 50 percent of the total grain projected area, the emulsion does not satisfy the requirements of the invention and is, in general, a photographically inferior emulsion.

In the foregoing discussion the classification of acicular or rod-like grains with {100} major faces has not been specifically addressed. Usually rod-like grains constitute a negligibly small fraction of total grain projected area and, in the rare instance when their occurrence is not negligibly small, are easily visually distinguished from {100} tabular grains. To provide an objective standard for identifying and excluding rod-like grains, any grain with a {100} major face that exhibits a ratio of adjacent edge lengths of at least 10 is considered to be a rod-like grain and not a tabular grain. Conversely, {100} tabular grains are those in which the major faces have adjacent edge length ratios of less than 10. Typically the adjacent edge ratios are less than 5 and optimally less than 2.

So long as tabular grains having the desired characteristics described above account for the requisite proportion of the total grain projected area, the remainder of the total grain projected area can be accounted for by any combination of coprecipitated grains. It is, of course, common practice in the art to blend emulsions to achieve specific photographic objectives. Blended emulsions in which at least one component emulsion satisfies the tabular grain descriptions above are specifically contemplated.

The emulsions of the present invention are unique in that they provide for the first time a tabular population of high chloride content satisfying the dimensional relationships discussed above most commonly sought in photographic tabular grain applications while additionally providing the tabular grain population in a form that is inherently more stable than any dimensionally similar high chloride tabular grain population heretofore known to the art.

The tabular grain population in the emulsions of this invention exhibit opposed parallel major faces that lie in {100} crystal planes. This is readily visually confirmed by the square and rectangular tabular grain major faces. In radiation sensitive silver halide emulsions prepared for photographic applications the grain population is susceptible to significant modification not only during grain nucleation and growth, but in subsequent physical and chemical ripening, during sensitization, during addenda addition, during melt-holding (holding in a flowable form) and even during coating. During each of these steps the emulsion is typically well above ambient temperatures. Since emulsions are mixtures of grains of unequal size, ripening (the dissolution of smaller grains and the redeposition of silver halide onto remaining grains) can be a significant factor in altering the grain population in the above-noted steps.

It is a significant advantage of this invention that the tabular grain population by reason of having {100} major crystal faces is in its crystallographically most stable form. Thus, there is a minimization of any risk of the desired tabular qualities of the grains being degraded. Unlike, tabular grain populations having {111} major faces, it is not necessary to intervene actively to preserve the major faces of the tabular grains in their preferred formed. The restrictions on adsorbed addenda, pH, halide ion excess, peptizer choices and other restrictions applicable to high chloride tabular grain emulsions having {111} major grain faces, reflected in the various teachings of the prior art discussed above, are totally obviated in the practice of this invention.

Stated another way, the tabular grain emulsions of this invention exhibit the inherent high levels of stability of high chloride cubic grain emulsions—that is, high chloride emulsions containing regular grains bounded by {100} crystal faces. The emulsions of this invention can therefore be acted upon following their formation in the same manner as conventional high chloride cubic grain emulsions. In other words, the high chloride tabular grain emulsions of this invention can be physically and chemically ripened, chemically and/or spectrally sensitized, and otherwise prepared for photographic use employing the full range of photographic peptizers, vehicles, sensitizers, and addenda as well as handling and coating procedures conventionally employed in connection with high chloride cubic grain emulsions.

Although it is generally accepted that twinning of grains having {100} crystal faces does not produce tabular grain shapes (*James The Theory of the Photographic Process*, 4th Ed. Macmillan, New York 1977, pp. 21 and 22), no consensus has emerged in the art as to the type of crystal irregularity that produces tabular grains having {100} major crystal faces. The most commonly advanced theory is that tabularity is imparted by screw dislocations in the crystal structure as the grains are being grown. It has been observed that most of the tabular grains exhibit the accelerated lateral growth that produces tabularity along each of the four grain edges. However, a significant percentage of the grain population grows laterally along only two of the four grains edges while still other grains grow laterally along three of the four grain edges. This suggests that a separate tabular growth inducing crystal irregularity must be introduced along each edge that supports accelerated lateral grain growth. It is believed that the edge structures of the tabular grains described above either lie in {100} crystallographic planes or are irregular.

The high chloride {100} tabular grain population emulsion described above can be prepared by the procedures described in the Examples below. To avoid elevated minimum density (fog) levels in the emulsion it is contemplated to precipitate at a pH of 8 or less, preferably on the acid side of neutrality (i.e., at a pH of less than 7). This precludes ammoniacal precipitations.

High minimum density levels are also avoided by precipitating on the halide excess side of the equivalency point—that is, precipitations are conducted with a stoichiometric excess of halide ion. Since silver chloride is approximately two orders of magnitude more soluble than silver bromide and four orders of magnitude more soluble than silver iodide, the halide ion content of the dispersing medium during precipitation is accounted for entirely or almost entirely by chloride ion. It is preferred to precipitate while maintaining a stoichiometric excess of chloride ion as compared to silver ion in the dispersing medium during precipitation that at least equals and preferably slightly exceeds the minimum solubility of silver chloride. In other words, chloride ion introduction is regulated to achieve near minimum silver chloride solubility while avoiding excessive levels that would result in large amounts of silver halide ion complexes being formed in the dispersing medium. It is preferred to precipitate in a pCl range of from 1.0 to 3.0.

It has been observed that rapid grain nucleations, including so-called dump nucleations, in which significant levels of dispersing medium supersaturation with halide and silver ions exist at nucleation, accelerate introduction of the grain irregularities responsible for tabularity. Since nucleation can be achieved essentially instantaneously, immediate departures from initial supersaturation to the preferred pCl ranges noted above are entirely consistent with this approach.

It has also been observed that maintaining the level of peptizer in the dispersing medium during grain nucleation at a level of less than 1 percent by weight enhances of tabular grain formation. It is believed that coalescence of grain nuclei pairs is at least in part responsible for introducing the crystal irregularities that induce tabular grain formation. Limited coalescence can be promoted by withholding peptizer from the dispersing medium or by initially limiting the concentration of peptizer. Mignot U.S. Pat. No. 4,334,012 illustrates grain nucleation in the absence of a peptizer with removal of soluble salt reaction products to avoid coalescence of nuclei. Since limited coalescence of grain nuclei is considered desirable, the active interventions of Mignot to eliminate grain nuclei coalescence can be either eliminated or moderated. It is also contemplated to enhance limited grain coalescence by employing one or more peptizers that exhibit reduced adhesion to grain surfaces. For example, it is generally recognized that low methionine gelatin of the type disclosed by Maskasky II is less tightly absorbed to grain surfaces than gelatin containing higher levels of methionine. Further moderated levels of grain adsorption can be achieved with so-called "synthetic peptizers"—that is, peptizers formed from synthetic polymers. In the Examples below nucleation of tabular grain emulsions is demonstrated with gelatino-peptizers containing typical naturally occurring levels of methionine (i.e., greater than 30 micromoles per gram). It is therefore concluded that grain nucleation and growth can be conducted by selecting from among conventional peptizers, such as any of those disclosed in *Research Disclosure*, Item 308119, Section IX. Vehicles and vehicle extenders, published December 1989, the disclosure of which is the disclosure of which is here incorporated by reference. Deionized gelatino-peptizers, those have had calcium and other divalent metal ions removed, are specifically contemplated for use. In the latter instance it is preferred to compensate for calcium ion removal by adding divalent or trivalent metal ions, such as alkaline earth or earth metal ions, preferably magnesium, calcium, barium or aluminum ions. The maximum quantity of peptizer compatible with limited coalescence of grain nuclei is, of course, related to the strength of adsorption to the grain surfaces. Once grain nucleation has been completed, immediately after silver salt introduction, peptizer levels can be increased to any convenient conventional level for the remainder of the precipitation process.

The emulsions of the invention include silver chloride, silver iodochloride emulsions, silver iodobromochloride emulsions, and silver bromoiodochloride emulsions. Dopants, in concentrations of up to $10^{-2}$ mole per silver mole and typically less than $10^{-4}$ mole per silver mole, can be present in the grains. Compounds of metals such as copper, thallium, lead, mercury, bismuth, zinc, cadmium rhenium, and Group VIII metals (e.g., iron, ruthenium, rhodium, palladium, osmium, iridium, and platinum) can be present during grain precipitation, preferably during the growth stage of precipitation. The modification of photographic properties is related to the level and location of the dopant within the grains. When the metal forms a part of a coordination complex, such as a hexacoordination complex or a tetracoordination complex, the ligands can also be included within the grains and the ligands can further influence photographic properties. Coordination ligands, such as halo, aquo, cyano cyanate, thiocyanate, nitrosyl, thionitrosyl, oxo and carbonyl ligands are contemplated and can be relied upon to modify photographic properties.

Dopants and their addition are illustrated by Arnold et al U.S. Pat. No. 1,195,432; Hochstetter U.S. Pat. No. 1,951,933; Trivelli et al U.S. Pat. No. 2,448,060; Overman U.S. Pat. No. 2,628,167; Mueller et al U.S. Pat. No. 2,950,972; McBride U.S. Pat. No. 3,287,136; Sidebotham U.S. Pat. No. 3,488,709; Rosecrants et al U.S. Pat. No. 3,737,313; Spence et al U.S. Pat. No. 3,687,676; Gilman et al U.S. Pat. No. 3,761,267; Shiba et al U.S. Pat. No. 3,790,390; Ohkubo et al U.S. Pat. No. 3,890,154; Iwaosa et al U.S. Pat. No. 3,901,711; Habu et al U.S. Pat. No. 4,173,483; Atwell U.S. Pat. No. 4,269,927; Janusonis et al U.S. Pat. No. 4,835,093; McDugle et al U.S. Pat. Nos. 4,933,272, 4,981,781, and 5,037,732; Keevert et al U.S. Pat. No. 4,945,035; and Evans et al U.S. Pat. No. 5,024,931, the disclosures of which are here incorporated by reference. For background as to alternatives known to the art attention is directed to B. H. Carroll, "Iridium Sensitization: A Literature Review", *Photographic Science and Engineering*, Vol. 24, NO. 6, Nov./Dec. 1980, pp. 265–257, and Grzeskowiak et al published European Patent Application 0 264 288.

Although not essential to the practice of the invention, it has been found advantageous to incorporate an agent capable of restraining the emergence of non-{100} grain crystal faces in the emulsion during its preparation. The restraining agent, when employed, can be active during grain nucleation, during grain growth or throughout precipitation.

Useful restraining agents under the contemplated conditions of precipitation have been identified that are organic compounds containing a nitrogen atom with a resonance stabilized $\pi$ electron pair. Resonance stabilization prevents protonation of the nitrogen atom under the relatively acid conditions of precipitation.

Aromatic resonance can be relied upon for stabilization of the $\pi$ electron pair of the nitrogen atom. The nitrogen atom can either be incorporated in an aromatic ring, such as an azole or azine ring, or the nitrogen atom can be a ring substituent of an aromatic ring.

In one preferred form the restraining agent can satisfy the following formula:

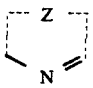

(III)

where Z represents the atoms necessary to complete a five or six membered aromatic ring structure, preferably formed by carbon and nitrogen ring atoms. Preferred aromatic rings are those that contain one, two or three nitrogen atoms. Specifically contemplated ring structures include 2H-pyrrole, pyrrole, imidazole, pyrazole, 1,2,3-triazole, 1,2,4-triazole, 1,3,5-triazole, pyridine, pyrazine, pyrimidine, and pyridazine.

When the stabilized nitrogen atom is a ring substituent, preferred compounds satisfy the following formula:

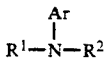

(IV)

where

Ar is an aromatic ring structure containing from 5 to 14 carbon atoms and $R^1$ and $R^2$ are independently hydrogen, Ar, or any convenient aliphatic group or together complete a five or six membered ring.

Ar is preferably a carbocyclic aromatic ring, such as phenyl or naphthyl. Alternatively any of the nitrogen and carbon containing aromatic rings noted above can be attached to the nitrogen atom of formula IV through a ring carbon atom. In this instance, the resulting compound satisfies both formulae III and IV. Any of a wide variety of aliphatic groups can be selected. The simplest contemplated aliphatic groups are alkyl groups, preferably those containing from 1 to 10 carbon atoms and most preferably from 1 to 6 carbon atoms. Any functional substituent of the alkyl group known to be compatible with silver halide precipitation can be present. It is also contemplated to employ cyclic aliphatic substituents exhibiting 5 or 6 membered rings, such as cycloalkane, cycloalkene and aliphatic heterocyclic rings, such as those containing oxygen and/or nitrogen hetero atoms. Cyclopentyl, cyclohexyl, pyrrolidinyl, piperidinyl, furanyl and similar heterocyclic rings are specifically contemplated.

The following are representative of compounds contemplated satisfying formulae III and/or IV:

R-1

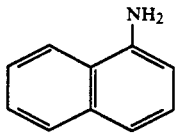

aniline

RA-2

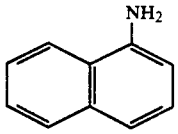

α-naphthylamine

RA-3

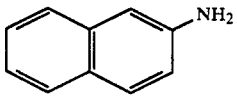

β-naphthylamine

RA-4

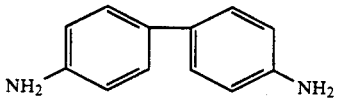

benzidine

RA-5

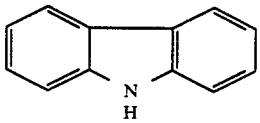

carbazole

RA-6

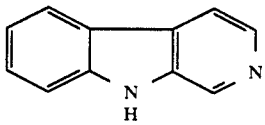

norharman

RA-7

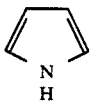

pyrrole

RA-8

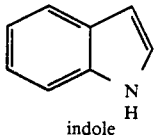

indole

RA-9

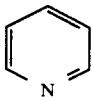

pyridine

-continued
RA-10
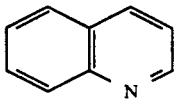
quinoline
RA-11
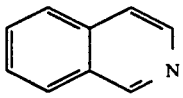
isoquinoline
RA-12
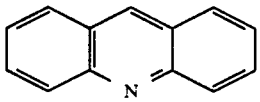
acridine
RA-13
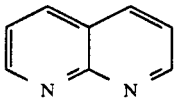
1,8-naphthyridine
RA-14
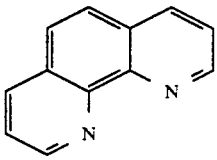
1,10-phenanthroline
RA-15
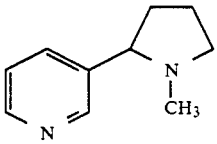
nicotine
RA-16
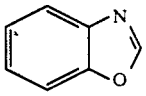
benzoxazole
RA-17
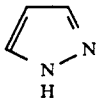
pyrazole
RA-18
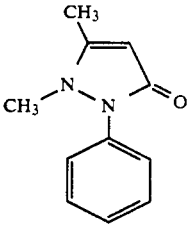
antipyrine
-continued
RA-19
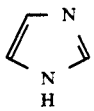
imidazole
RA-20
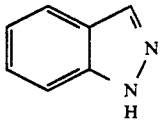
indazole
RA-21
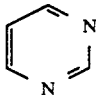
pyrimidine
RA-22
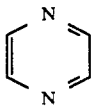
pyrazine
RA-23
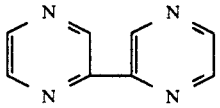
2,2'-bipyrazine
RA-24
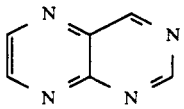
pteridine
RA-25
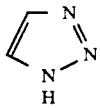
1,2,3-triazole
RA-26
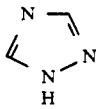
1,2,4-triazole
RA-27
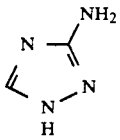
3-amino-1,2,4-triazole
RA-28
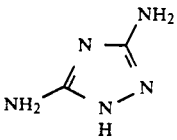
3,5-diamino-1,2,4-triazole -continued

RA-29

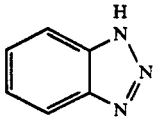

benzotriazole

RA-30

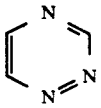

1,2,4-triazine

RA-31

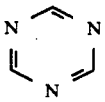

1,3,5-triazine

Selection of preferred restraining agents and their useful concentrations can be accomplished by the following selection procedure: The compound being considered for use as a restraining agent is added to a silver chloride emulsion consisting essentially of cubic grains with a mean grain edge length of 0.3 μm. The emulsion is 0.2M in sodium acetate, has a pCl of 2.1, and has a pH that is at least one unit greater than the pKa of the compound being considered. The emulsion is held at 75° C. with the restraining agent present for 24 hours. If, upon microscopic examination after 24 hours, the cubic grains have sharper edges of the {100} crystal faces than a control differing only in lacking the compound being considered, the compound introduced is performing the function of a restraining agent. The significance of sharper edges of intersection of the {100} crystal faces lies in the fact that grain edges are the most active sites on the grains in terms of ions reentering the dispersing medium. By maintaining sharp edges the restraining agent is acting to restrain the emergence of non-{100} crystal faces, such as are present, for example, at rounded edges and corners. In some instances instead of dissolved silver chloride depositing exclusively onto the edges of the cubic grains a new population of grains bounded by {100} crystal faces is formed. Optimum restraining agent activity occurs when the new grain population is a tabular grain population in which the tabular grains are bounded by {100} major crystal faces.

It is specifically contemplated to deposit epitaxially silver salt onto the tabular grains acting as hosts. Conventional epitaxial depositions onto high chloride silver halide grains are illustrated by Maskasky U.S. Pat. No. 4,435,501 (particularly Example 24B); Ogawa et al U.S. Pat. Nos. 4,786,588 and 4,791,053; hasebe et al U.S. Pat. Nos. 4,820,624 and 4,865,962 Sugimoto and Miyake, "Mechanism of Halide Conversion Process of Colloidal AgCl Microcrystals by $Br^-$ Ions", Parts I and II, *Journal of Colloid and Interface Science*, Vol. 140, No. 2, Dec. 1990, pp. 335–361; Houle et al U.S. Pat. No. 5,035,992; and Japanese published applications (Kokai) 252649-A (priority 02.03.90-JP 051165 Japan) and 288143-A (priority 04.04.90-JP 089380 Japan). The disclosures of the above U.S. patents are here incorporated by reference.

The emulsions of the invention can be chemically sensitized with active gelatin as illustrated by T. H. James, *The Theory of the Photographic Process*, 4th Ed., Macmillan, 1977, pp. 67–76, or with sulfur, selenium, tellurium, gold, platinum, palladium, iridium, osmium, rhenium or phosphorus sensitizers or combinations of these sensitizers, such as at pAg levels of from 5 to 10, pH levels of from 5 to 8 and temperatures of from 30 to 80° C., as illustrated by *Research Disclosure*, Vol. 120, April, 1974, Item 12008, *Research Disclosure*, Vol. 134, June, 1975, Item 13452, Sheppard et al U.S. Pat. No. 1,623,499, Matthies et al U.S. Pat. No. 1,673,522, Waller et al U.S. Pat. No. 2,399,083, Damschroder et al U.S. Pat. No. 2,642,361, McVeigh U.S. Pat. No. 3,297,447, Dunn U.S. Patent 3,297,446, McBride U.K. Patent 1,315,755, Berry et al U.S. Pat. No. 3,772,031, Gilman et al U.S. Pat. No. 3,761,267, Ohi et al U.S. Pat. No. 3,857,711, Klinger et al U.S. Pat. No. 3,565,633, Oftedahl U.S. Pat. Nos. 3,901,714 and 3,904,415 and Simons U.K. Patent 1,396,696; chemical sensitization being optionally conducted in the presence of thiocyanate derivatives as described in Damschroder U.S. Pat. No. 2,642,361; thioether compounds as disclosed in Lowe et al U.S. Pat. No. 2,521,926, Williams et al U.S. Pat. No. 3,021,215 and Bigelow U.S. Pat. No. 4,054,457; and azaindenes, azapyridazines and azapyrimidines as described in Dostes U.S. Pat. No. 3,411,914, Kuwabara et al U.S. Pat. No. 3,554,757, Oguchi et al U.S. Pat. No. 3,565,631 and Oftedahl U.S. Pat. No. 3,901,714; elemental sulfur as described by Miyoshi et al European Patent Application EP 294,149 and Tanaka et al European Patent Application EP 297,804; and thiosulfonates as described by Nishikawa et al European Patent Application EP 293,917. Additionally or alternatively, the emulsions can be reduction-sensitized—e.g., with hydrogen, as illustrated by Janusonis U.S. Pat. No. 3,891,446 and Babcock et al U.S. Pat. No. 3,984,249, by low pAg (e.g., less than 5), high pH (e.g., greater than 8) treatment, or through the use of reducing agents such as stannous chloride, thiourea dioxide, polyamines and amineboranes as illustrated by Allen et al U.S. Pat. No. 2,983,609, Oftedahl et al *Research Disclosure*, Vol. 136, August, 1975, Item 13654, Lowe et al U.S. Pat. Nos. 2,518,698 and 2,739,060, Roberts et al U.S. Pat. Nos. 2,743,182 and 183, Chambers et al U.S. Pat. No. 3,026,203 and Bigelow et al U.S. Pat. No. 3,361,564.

Chemical sensitization can take place in the presence of spectral sensitizing dyes as described by Philippaerts et al U.S. Pat. No. 3,628,960, Kofron et al U.S. Pat. No. 4,439,520, Dickerson U.S. Pat. No. 4,520,098, Maskasky U.S. Pat. No. 4,435,501, Ihama et al U.S. Pat. No. 4,693,965 and Ogawa U.S. Pat. No. 4,791,053. Chemical sensitization can be directed to specific sites or crystallographic faces on the silver halide grain as described by Haugh et al U.K. Patent Application 2,038,792A and Mifune et al published European Patent Application EP 302,528. The sensitivity centers resulting from chemical sensitization can be partially or totally occluded by the precipitation of additional layers of silver halide using such means as twin-jet additions or pAg cycling with alternate additions of silver and halide salts as described by Morgan U.S. Pat. No. 3,917,485, Becker U.S. Pat. No. 3,966,476 and *Research Disclosure*, Vol. 181, May, 1979, Item 18155. Also as described by Morgan, cited above, the chemical sensitizers can be added prior to or concurrently with the additional silver halide formation. Chemical sensitization can take place during or after halide conversion as described by Hasebe et al European Patent Application EP 273,404. In many instances epitaxial deposition onto selected tabular grain sites (e.g., edges or corners) can either be used to direct chemical sensitization or to itself perform the functions normally performed by chemical sensitization.

The emulsions of the invention can be spectrally sensitized with dyes from a variety of classes, including the polymethine dye class, which includes the cyanines, merocyanines, complex cyanines and merocyanines (i.e., tri-, tetra- and polynuclear cyanines and merocyanines), styryls, merostyryls, streptocyanines, hemicyanines, arylidenes, allopolar cyanines and enamine cyanines.

The cyanine spectral sensitizing dyes include, joined by a methine linkage, two basic heterocyclic nuclei, such as those derived from quinolinium, pyridinium, isoquinolinium, 3H-indolium, benzindolium, oxazolium, thiazolium, selenazolinium, imidazolium, benzoxazolium, benzothiazolium, benzoselenazolium, benzotellurazolium, benzimidazolium, naphthoxazolium, naphthothiazolium, naphthoselenazolium, naphtotellurazolium, thiazolinium, dihydronaphthothiazolium, pyrylium and imidazopyrazinium quaternary salts.

The merocyanine spectral sensitizing dyes include, joined by a methine linkage, a basic heterocyclic nucleus of the cyanine-dye type and an acidic nucleus such as can be derived from barbituric acid, 2-thiobarbituric acid, rhodanine, hydantoin, 2-thiohydantoin, 4-thiohydantoin, 2-pyrazolin-5-one, 2-isoxazolin-5-one, indan-1,3-dione, cyclohexan-1,3-dione, 1,3-dioxane-4,6-dione, pyrazolin-3,5-dione, pentan-2,4-dione, alkylsulfonyl acetonitrile, benzoylacetonitrile, malononitrile, malonamide, isoquinolin-4-one, chroman-2,4-dione, 5H-furan-2-one, 5H-3-pyrrolin-2-one, 1,1,3-tricyanopropene and telluracyclohexanedione.

One or more spectral sensitizing dyes may be employed. Dyes with sensitizing maxima at wavelengths throughout the visible and infrared spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization greater in some spectral region than that from any concentration of one of the dyes alone or that which would result from the additive effect of the dyes. Supersensitization can be achieved with selected combinations of spectral sensitizing dyes and other addenda such as stabilizers and antifoggants, development accelerators or inhibitors, coating aids, brighteners and antistatic agents. Any one of several mechanisms, as well as compounds which can be responsible for supersensitization, are discussed by Gilman, *Photographic Science and Engineering*, Vol. 18, 1974, pp. 418–430.

Spectral sensitizing dyes can also affect the emulsions in other ways. For example, spectrally sensitizing dyes can increase photographic speed within the spectral region of inherent sensitivity. Spectral sensitizing dyes can also function as antifoggants or stabilizers, development accelerators or inhibitors, reducing or nucleating agents, and halogen acceptors or electron acceptors, as disclosed in Brooker et al U.S. Pat. No. 2,131,038, Illingsworth et al U.S. Pat. No. 3,501,310, Webster et al U.S. Pat. No. 3,630,749, Spence et al U.S. Pat. No. 3,718,470 and Shiba et al U.S. Pat. No. 3,930,860.

Among useful spectral sensitizing dyes for sensitizing the emulsions of the invention are those found in U.K. Patent 742,112, Brooker U.S. Pat. Nos. 1,846,300, '301, '302, '303, '304, 2,078,233 and 2,089,729, Brooker et al U.S. Pat. Nos. 2,165,338, 2,213,238, 2,493,747, '748, 2,526,632, 2,739,964 (Reissue 24,292), 2,778,823, 2,917,516, 3,352,857, 3,411,916 and 3,431,111, Sprague U.S. Pat. No. 2,503,776, Nys et al U.S. Pat. No. 3,282,933, Riester U.S. Pat. No. 3,660,102, Kampfer et al U.S. Pat. No. 3,660,103, Taber et al U.S. Pat. Nos. 3,335,010, 3,352,680 and 3,384,486, Lincoln et al U.S. Pat. No. 3,397,981, Fumia et al U.S. Pat. Nos. 3,482,978 and 3,623,881, Spence et al U.S. Pat. No. 3,718,470 and Mee U.S. Pat. No. 4,025,349, the disclosures of which are here incorporated by reference. Examples of useful supersensitizing-dye combinations, of non-light-absorbing addenda which function as supersensitizers or of useful dye combinations are found in McFall et al U.S. Pat. No. 2,933,390, Jones et al U.S. Pat. No. 2,937,089, Motter U.S. Pat. No. 3,506,443 and Schwan et al U.S. Pat. No. 3,672,898, the disclosures of which are here incorporated by reference.

Spectral sensitizing dyes can be added at any stage during the emulsion preparation. They may be added at the beginning of or during precipitation as described by Wall, *Photographic Emulsions*, American Photographic Publishing Co., Boston, 1929, p. 65, Hill U.S. Pat. No. 2,735,766, Philippaerts et al U.S. Pat. No. 3,628,960, Locker U.S. Pat. No. 4,183,756, Locker et al U.S. Pat. No. 4,225,666 and *Research Disclosure*, Vol. 181, May, 1979, Item 18155, and Tani et al published European Patent Application EP 301,508. They can be added prior to or during chemical sensitization as described by Kofron et al U.S. Pat. No. 4,439,520, Dickerson U.S. Pat. No. 4,520,098, Maskasky U.S. Pat. No. 4,435,501 and Philippaerts et al cited above. They can be added before or during emulsion washing as described by Asami et al published European Patent Application EP 287,100 and Metoki et al published European Patent Application EP 291,399. The dyes can be mixed in directly before coating as described by Collins et al U.S. Pat. No. 2,912,343. Small amounts of iodide can be adsorbed to the emulsion grains to promote aggregation and adsorption of the spectral sensitizing dyes as described by Dickerson cited above. Postprocessing dye stain can be reduced by the proximity to the dyed emulsion layer of fine high-iodide grains as described by Dickerson. Depending on their solubility, the spectral-sensitizing dyes can be added to the emulsion as solutions in water or such solvents as methanol, ethanol, acetone or pyridine; dissolved in surfactant solutions as described by Sakai et al U.S. Pat. No. 3,822,135; or as dispersions as described by Owens et al U.S. Pat. No. 3,469,987 and Japanese published Patent Publication 24185/71. The dyes can be selectively adsorbed to particular crystallographic faces of the emulsion grain as a means of restricting chemical sensitization centers to other faces, as described by Mifune et al published European Patent Application EP 302,528. The spectral sensitizing dyes may be used in conjunction with poorly adsorbed luminescent dyes, as described by Miyasaka et al published European Patent Applications 270,079, 270,082 and 278,510.

The following illustrate specific spectral sensitizing dye selections:

SS-1: Anhydro-5'-chloro-3'-di-(3-sulfopropyl)naphtho[1,2-d]thiazolothiacyanine hydroxide, sodium salt SS-2: Anhydro-5'-chloro-3'-di-(3-sulfopropyl)naphtho[1,2-d]oxazolothiacyanine hydroxide, sodium salt SS-3: Anhydro-4,5-benzo-3'-methyl-4'-phenyl-1-(3-sulfopropyl)naphtho[1,2-d]thiazolothiazolocyanine hydroxide SS-4: 1,1'-Diethylnaphtho[1,2-d]thiazolo-2'-cyanine bromide SS-5: Anhydro-1,1'-dimethyl-5,5'-di-(trifluoromethyl)-3-(4-sulfobuyl)-3'-(2,2,2-trifluoroethyl)benzimidazolocarbocyanine hydroxide SS-6: Anhydro-3,3'-(2-methoxyethyl)-5,5'-diphenyl-9-ethyloxacarbocyanine, sodium salt SS-7: Anhydro-11-ethyl-1,1'-di-(3-sulfopropyl)naphtho[1,2-d]oxazolocarbocyanine hydroxide, sodium salt SS-8: Anhydro-5,5'-dichloro-9-ethyl-3,3'-di-(3-sulfopropyl)oxaselenacarbocyanine hydroxide, sodium salt SS-9: 5,6-Dichloro-3',3'-dimethyl-1,1',3-triethylbenzimid-azolo-3H-indolocarbocyanine bromide SS-10: Anhydro-5,6-dichloro-1,1-diethyl-3-(3-sulfopropylbenzimidazolooxacarbocyanine hydroxide SS-11: Anhydro-5,5'-dichloro-9-ethyl-3,3'-di-(2-sulfoethylcarbamoylmethyl)thiacarbocyanine hydroxide, sodium salt SS-12: Anhydro-5',6'-dimethoxy-9-ethyl-5-phenyl-3-(3-sulfobutyl)-3'-(3-sulfopropyl)oxathiacarbocyanine hydroxide, sodium salt SS-13: Anhydro-5,5'-dichloro-9-ethyl-3-(3-phosphonopropyl)-3'-(3-sulfopropyl)thiacarbocyanie hydroxide SS-14: Anhydro-3,3'-di-(2-carboxyethyl)-5,5'-dichloro-9-ethylthiacarbocyanine bromide SS-15: Anhydro-5,5'-dichloro-3-(2-carboxyethyl)-3'-(3-sulfopropyl)thiacyanine sodium salt SS-16: 9-(5-Barbituric acid)-3,5-dimethyl-3'-ethyltellurathiacarbocyanine bromide SS-17: Anhydro-5,6-methylenedioxy-9-ethyl-3-methyl-3'-(3-sulfopropyl)tellurathiacarbocyanine hydroxide SS-18: 3-Ethyl-6,6'-dimethyl-3'-pentyl-9.11-neopentylenethiadicarbocyanine bromide SS-19: Auhydro-3-ethyl-9,11-neopentylene-3'-(3-sulfopropyl)thiadicarbocyanine hydroxide SS-20: Anhydro-3-ethyl-11,13-neopentylene-3'-(3-sulfopropyl)oxathiatricarbocyanine hydroxide, sodium salt SS-21: Anhydro-5-chloro 9-ethyl-5'-phenyl-3'-(3-sulfobutyl)-3-(3-sulfopropyl)oxacarbocyanine hydroxide, sodium salt SS-22: Anhydro-5,5'-diphenyl-3,3'-di-(3-sulfobutyl)-9-ethyloxacarbocyanine hydroxide, sodium salt SS-23: Anhydro-5,5'-dichloro-3,3'-di-(3-sulfopropyl)-9-ethylthiacarbocyanine hydroxide, triethylammonium salt SS-24: Anhydro-5,5'-dimethyl-3,3'-di-(3-sulfopropyl)-9-ethylthiacarbocyanine hydroxide, sodium salt SS-25: Anhydro-5,6-dichloro-1-ethyl-3-(3-sulfobutyl)-1'-(3-sulfopropyl)benzimidazolonaphtho[1,2-d]thiazolocarbocyanine hydroxide, triethylammonium salt SS-26: Anhydro-11-ethyl-1,1'-di-(3-sulfopropyl)-naphth[1,2-d]oxazolocarbocyanine hydroxide, sodium salt SS-27: Anhydro-3,9-diethyl-3'-methylsulfonylcarbamoylmethyl-5-phenyloxathiacarbocyanine p-toluenesulfonate SS-28: Anhydro-6,6'-dichloro-1,1'-diethyl-3,3'-di-(3-sulfopropyl)-5,5'-bis(trifluoromethyl)benzimidazolocarbocyanine hydroxide, sodium salt SS-29: Anhydro-5'-chloro-5-phenyl-3,3'-di-(3-sulfopropyl)oxathiacyanine hydroxide, sodium salt SS-30: Anhydro-5,5'-dichloro-3,3'-di-(3-sulfopropyl)-thiacyanine hydroxide, sodium salt SS-31: 3-Ethyl-5-[1,4-dihydro-1-(4-sulfobutyl)pyridin-4-ylidene]rhodanine, triethylammonium salt SS-32: 1-Carboxyethyl-5-[2-(3-ethylbenzoxazolin-2-ylidene)-ethylidene]-3-phenylthiohydantoin SS-33: 4-[2-((1,4-Dihydro-1-dodecylpyridin-ylidene)ethylidene]-3-phenyl-2-isoxazolin-5-one SS-34: 5-(3-Ethylbenzoxazolin-2-ylidene)-3-phenylrhodanine SS-35: 1,3-Diethyl-5-{[1-ethyl-3-(3-sulfopropyl)benzimidazolin-2-ylidene]ethylidene}-2-thiobarbituric acid SS-36: 5-[2-(3-Ethylbenzoxazolin-2-ylidene)ethylidene]-1-methyl-2-dimethylamino-4-oxo-3-phenylimidazolinium p-toluenesulfonate SS-37: 5-[2-(5-Carboxy-3-methylbenzoxazolin-2-ylidene)ethylidene]-3-cyano-4-phenyl-1-(4-methylsulfonamido-3-pyrrolin-5-one SS-38: 2-[4-(Hexylsulfonamido)benzoylcyanomethine]-2-{2-{3-(2-methoxyethyl)-5-[(2-methoxyethyl)sulfonamido]benzoxazolin-2-ylidene}ethylidene}acetonitrile SS-39: 3-Methyl-4-[2 (3-ethyl-5,6 dimethylbenzotellurazolin-2-ylidene)ethylidene]-1-phenyl-2-pyrazolin-5-one SS-40: 3-Heptyl-1-phenyl-5-{4-[3-(3-sulfobutyl)-naphtho[1,2-d]thiazolin]-2-butenylidene}-2-thiohydantoin SS-41: 1,4-Phenylene-bis(2-aminovinyl-3-methyl-2-thiazolinium]dichloride SS-42: Anhydro-4-{2-[3-(3-sulfopropyl)thiazolin-2-ylidene]ethylidene}-2-{3-[3-(3-sulfopropyl)thiazolin-2-ylidene]propenyl-5-oxazolium, hydroxide, sodium salt SS-43: 3-Carboxymethyl-5-{3-carboxymethyl-4-oxo-5-methyl1,3,4-thiadiazolin-2-ylidene)ethylidene]thiazolin-2-ylidene}rhodanine, dipotassium salt SS-44: 1,3-Diethyl-5-[1-methyl-2-(3,5-dimethylbenzotellurazolin-2-ylidene)ethylidene]-2-thiobarbituric acid SS-45: 3-Methyl-4-[2-(3-ethyl-5,6-dimethylbenzotellurazolin-2-ylidene)-1-methylethylidene]-1-phenyl-2-pyrazolin-5-one SS-46: 1,3-Diethyl-5-[1-ethyl-2-(3-ethyl-5,6-dimethoxybenzotellurazolin-2-ylidene)ethylidene]-2-thiobarbituric acid SS-47: 3-Ethyl-5-{[(ethylbenzothiazolin-2-ylidene)-methyl]-[(1,5-dimethylnaphtho[1,2-d]selenazolin-2-ylidene)methyl]methylene}rhodanine SS-48: 5-{Bis[(3-ethyl-5,6-dimethylbenzothiazolin-2-ylidene)methyl]methylene}-1,3-diethyl-barbituric acid SS-49: 3-Ethyl-5-{[(3-ethyl-5-methylbenzotellurazolin-2-ylidene)methyl][1-ethylnaphtho[1,2-d]-tellurazolin-2-ylidene)methyl]methylene}rhodanine SS-50: Anhydro-5,5'-diphenyl-3,3'-di-(3-sulfopropyl)-thiacyanine hydroxide, triethylammonium salt SS-51: Anhydro-5-chloro-5'-phenyl-3,3'-di-(3-sulfopropyl)thiacyanine hydroxide, triethylammonium salt Instability which increases minimum density in negative-type emulsion coatings (i.e., fog) can be protected against by incorporation of stabilizers, antifoggants, antikinking agents, latent-image stabilizers and similar addenda in the emulsion and contiguous layers prior to coating. Most of the antifoggants effective in the emulsions of this invention can also be used in developers and can be classified under a few general headings, as illustrated by C.E.K. Mees, *The Theory of the Photographic Process*, 2Nd Ed., Macmillan, 1954, pp. 677-680.

To avoid such instability in emulsion coatings, stabilizers and antifoggants can be employed, such as halide ions (e.g., bromide salts); chloropalladates and chloropalladites as illustrated by Trivelli et al U.S. Pat. No. 2,566,263; water-soluble inorganic salts of magnesium, calcium, cadmium, cobalt, manganese and zinc as illustrated by Jones U.S. Pat. No. 2,839,405 and Sidebotham U.S. Pat. No. 3,488,709; mercury salts as illustrated by Allen et al U.S. Pat. No. 2,728,663; selenols and diselenides as illustrated by Brown et al U.K. Patent 1,336,570 and Pollet et al U.K. Patent 1,282,303; quaternary ammonium salts of the type illustrated by Allen et al U.S. Pat. No. 2,694,716, Brooker et al U.S. Pat. No. 2,131,038, Graham U.S. Pat. No. 3,342,596 and Arai et al U.S. Pat. No. 3,954,478; azomethine desensitizing dyes as illustrated by Thiers et al U.S. Pat. No. 3,630,744; isothiourea derivatives as illustrated by Herz et al U.S. Pat. No. 3,220,839 and Knott et al U.S. Pat. No. 2,514,650; thiazolidines as illustrated by Scavron U.S. Pat. No. 3,565,625; peptide derivatives as illustrated by Maffet U.S. Pat. No. 3,274,002; pyrimidines and 3-pyrazolidones as illustrated by Welsh U.S. Pat. No. 3,161,515 and Hood et al U.S. Pat. No. 2,751,297; azotriazoles and azotetrazoles as illustrated by Baldassarri et al U.S. Pat. No. 3,925,086; azaindenes, particularly tetraazaindenes, as illustrated by Heimbach U.S. Pat. No. 2,444,605, Knott U.S. Pat. No. 2,933,388, Williams U.S. Pat. No. 3,202,512, *Research Disclosure*, Vol. 134, June, 1975, Item 13452, and Vol. 148, August, 1976, Item 14851, and Nepker et al U.K. Patent 1,338,567; mercaptotetrazoles, -triazoles and -diazoles as illustrated by Kendall et al U.S. Pat. No. 2,403,927, Kennard et al U.S. Pat. No. 3,266,897, *Research Disclosure*, Vol. 116, December, 1973, Item 11684, Luckey et al U.S. Pat. No. 3,397,987 and Salesin U.S. Pat. No. 3,708,303; azoles as illustrated by Peterson et al U.S. Pat. No. 2,271,229 and *Research Disclosure*, Item 11684, cited above; purines as illustrated by Sheppard et al U.S. Pat. No. 2,319,090, Birr et al U.S. Pat. No. 2,152,460, *Research Disclosure*, Item 13452, cited above, and Dostes et al French Patent 2,296,204, polymers of 1,3-dihydroxy-(and/or 1,3-carbamoxy)-2-methylenepropane as illustrated by Saleck et al U.S. Pat. No. 3,926,635 and tellurazoles, tellurazolines, tellurazolinium salts and tellurazolium salts as illustrated by Gunther et al U.S. Pat. No. 4,661,438, aromatic oxatellurazinium salts as illustrated by Gunther, U.S. Pat. No. 4,581,330 and Przyklek-Elling et al U.S. Pat. Nos. 4,661,438 and 4,677,202. High-chloride emulsions can be stabilized by the presence, especially during chemical sensitization, of elemental sulfur as described by Miyoshi et al European published Patent Application EP 294,149 and Tanaka et al European published Patent Application EP 297,804 and thiosulfonates as described by Nishikawa et al European published Patent Application EP 293,917.

Among useful stabilizers for gold sensitized emulsions are water-insoluble gold compounds of benzothiazole, benzoxazole, naphthothiazole and certain merocyanine and cyanine dyes as illustrated by Yutzy et al U.S. Pat. No. 2,597,915, and sulfinamides, as illustrated by Nishio et al U.S. Pat. No. 3,498,792.

Among useful stabilizers in layers containing poly(alkylene oxides) are tetraazaindenes, particularly in combination with Group VIII noble metals or resorcinol derivatives, as illustrated by Carroll et al U.S. Pat. No. 2,716,062, U.K. Patent 1,466,024 and Habu et al U.S. Pat. No. 3,929,486; quaternary ammonium salts of the type illustrated by Piper U.S. Pat. No. 2,886,437; water-insoluble hydroxides as illustrated by Maffet U.S. Pat. No. 2,953,455; phenols as illustrated by Smith U.S. Pat. Nos. 2,955,037 and '038; ethylene diurea as illustrated by Dersch U.S. Pat. No. 3,582,346; barbituric acid derivatives as illustrated by Wood U.S. Pat. No. 3,617,290; boranes as illustrated by Bigelow U.S. Pat. No. 3,725,078; 3-pyrazolidinones as illustrated by Wood U.K. Patent 1,158,059 and aldoximines, amides, anilides and esters as illustrated by Butler et al U.K. Patent 988,052.

The emulsions can be protected from fog and desensitization caused by trace amounts of metals such as copper, lead, tin, iron and the like by incorporating addenda such as sulfocatechol-type compounds, as illustrated by Kennard et al U.S. Pat. No. 3,236,652; aldoximines as illustrated by Carroll et al U.K. Patent 623,448 and meta- and polyphosphates as illustrated by Draisbach U.S. Pat. No. 2,239,284, and carboxylic acids such as ethylenediamine tetraacetic acid as illustrated by U.K. Patent 691,715.

Among stabilizers useful in layers containing synthetic polymers of the type employed as vehicles and to improve covering power are monohydric and polyhydric phenols as illustrated by Forsgard U.S. Pat. No. 3,043,697; saccharides as illustrated by U.K. Patent 97,497 and Stevens et al U.K. Patent 1,039,471, and quinoline derivatives as illustrated by Dersch et al U.S. Pat. No. 3,446,618.

Among stabilizers useful in protecting the emulsion layers against dichroic fog are addenda such as salts of nitron as illustrated by Barbier et al U.S. Pat. Nos. 3,679,424 and 3,820,998; mercaptocarboxylic acids as illustrated by Willems et al U.S. Pat. No. 3,600,178; and addenda listed by E. J. Birr, *Stabilization of Photographic Silver Halide Emulsions*, Focal Press, London, 1974, pp. 126-218.

Among stabilizers useful in protecting emulsion layers against development fog are addenda such as azabenzimidazoles as illustrated by Bloom et al U.K. Patent 1,356,142 and U.S. Pat. No. 3,575,699, Rogers U.S. Pat. No. 3,473,924 and Carlson et al U.S. Pat. No. 3,649,267; substituted benzimidazoles, benzothiazoles, benzotriazoles and the like as illustrated by Brooker et al U.S. Pat. No. 2,131,038, Land U.S. Pat. No. 2,704,721, Rogers et al U.S. Pat. No. 3,265,498: mercapto-substituted compounds, e.g., mercaptotetrazoles, as illustrated by Dimsdale et al U.S. Pat. No. 2,432,864, Rauch et al U.S. Pat. No. 3,081,170, Weyerts et al U.S. Pat. No. 3,260,597, Grasshoff et al U.S. Pat. No. 3,674,478 and Arond U.S. Pat. No. 3,706,557; isothiourea derivatives as illustrated by Herz et al U.S. Pat. No. 3,220,839, and thiodiazole derivatives as illustrated by von Konig U.S. Pat. No. 3,364,028 and von Konig et al U.K. Patent 1,186,441.

Where hardeners of the aldehyde type are employed, the emulsion layers can be protected with antifoggants such as monohydric and polyhydric phenols of the type illustrated by Sheppard et al U.S. Pat. No. 2,165,421;

nitro-substituted compounds of the type disclosed by Rees et al U.K. Patent 1,269,268; poly(alkylene oxides) as illustrated by Valbusa U.K. Patent 1,151,914, and mucohalogenic acids in combination with urazoles as illustrated by Allen et al U.S. Pat. Nos. 3,232,761 and 3,232,764, or further in combination with maleic acid hydrazide as illustrated by Rees et al U.S. Pat. No. 3,295,980.

To protect emulsion layers coated on linear polyester supports, addenda can be employed such as parabanic acid, hydantoin acid hydrazides and urazoles as illustrated by Anderson et al U.S. Pat. No. 3,287,135, and piazines containing two symmetrically fused 6-member carbocyclic rings, especially in combination with an aldehyde-type hardening agent, as illustrated in Rees et al U.S. Pat. No. 3,396,023.

Kink desensitization of the emulsions can be reduced by the incorporation of thallous nitrate as illustrated by Overman U.S. Pat. No. 2,628,167; compounds, polymeric latices and dispersions of the type disclosed by Jones et al U.S. Pat. No. 2,759,821 and '822; azole and mercaptotetrazole hydrophilic colloid dispersions of the type disclosed by *Research Disclosure*, Vol. 116, December, 1973, Item 11684; plasticized gelatin compositions of the type disclosed by Milton et al U.S. Pat. No. 3,033,680; water-soluble interpolymers of the type disclosed by Rees et al U.S. Pat. No. 3,536,491; polymeric latices prepared by emulsion polymerization in the presence of poly(alkylene oxide) as disclosed by Pearson et al U.S. Pat. No. 3,772,032, and gelatin graft copolymers of the type disclosed by Rakoczy U.S. Pat. No. 3,837,861.

Where the photographic element is to be processed at elevated bath or drying temperatures, as in rapid access processors, pressure desensitization and/or increased fog can be controlled by selected combinations of addenda, vehicles, hardeners and/or processing conditions as illustrated by Abbott et al U.S. Pat. No. 3,295,976, Barnes et al U.S. Pat. No. 3,545,971, Salesin U.S. Pat. No. 3,708,303, Yamamoto et al U.S. Pat. No. 3,615,619, Brown et al U.S. Pat. No. 3,623,873, Taber U.S. Pat. No. 3,671,258, Abele U.S. Pat. No. 3,791,830, *Research Disclosure*, Vol. 99, July, 1972, Item 9930, Florens et al U.S. Pat. No. 3,843,364, Priem et al U.S. Pat. No. 3,867,152, Adachi et al U.S. Pat. No. 3,967,965 and Mikawa et al U.S. Pat. Nos. 3,947,274 and 3,954,474.

In addition to increasing the pH or decreasing the pAg of an emulsion and adding gelatin, which are known to retard latent-image fading, latent-image stabilizers can be incorporated, such as amino acids, as illustrated by Ezekiel U.K. Patents 1,335,923, 1,378,354, 1,387,654 and 1,391,672, Ezekiel et al U.K. Patent 1,394,371, Jefferson U.S. Pat. No. 3,843,372, Jefferson et al U.K. Patent 1,412,294 and Thurston U.K. Patent 1,343,904; carbonyl-bisulfite addition products in combination with hydroxybenzene or aromatic amine developing agents as illustrated by Seiter et al U.S. Pat. No. 3,424,583; cycloalkyl-1,3-diones as illustrated by Beckett et al U.S. Pat. No. 3,447,926; enzymes of the catalase type as illustrated by Matejec et al U.S. Pat. No. 3,600,182; halogen-substituted hardeners in combination with certain cyanine dyes as illustrated by Kumai et al U.S. Pat. No. 3,881,933; hydrazides as illustrated by Honig et al U.S. Pat. No. 3,386,831; alkenyl benzothiazolium salts as illustrated by Arai et al U.S. Pat. No. 3,954,478; hydroxy-substituted benzylidene derivatives as illustrated by Thurston U.K. Patent 1,308,777 and Ezekiel et al U.K. Patents 1,347,544 and 1,353,527; mercapto-substituted compounds of the type disclosed by Sutherns U.S. Pat. No. 3,519,427; metal-organic complexes of the type disclosed by Matejec et al U.S. Pat. No. 3,639,128; penicillin derivatives as illustrated by Ezekiel U.K. Patent 1,389,089; propynylthio derivatives of benzimidazoles, pyrimidines, etc., as illustrated by von Konig et al U.S. Pat. No. 3,910,791; combinations of iridium and rhodium compounds as disclosed by Yamasue et al U.S. Pat. No. 3,901,713; sydnones or sydnone imines as illustrated by Noda et al U.S. Pat. No. 3,881,939; thiazolidine derivatives as illustrated by Ezekiel U.K. Patent 1,458,197 and thioether-substituted imidazoles as illustrated by *Research Disclosure*, Vol. 136, August, 1975, Item 13651.

Apart from the features that have been specifically discussed the tabular grain emulsion preparation procedures, the tabular grains that they produce, and their further use in photography can take any convenient conventional form. Substitution for conventional emulsions of the same or similar silver halide composition is generally contemplated, with substitution for silver halide emulsions of differing halide composition, particularly tabular grain emulsions, being also feasible in many types of photographic applications. The low levels of native blue sensitivity of the high chloride {100} tabular grain emulsions of the invention allows the emulsions to be employed in any desired layer order arrangement in multicolor photographic elements, including any of the layer order arrangements disclosed by Kofron et al U.S. Pat. No. 4,439,520, the disclosure of which is here incorporated by reference, both for layer order arrangements and for other conventional features of photographic elements containing tabular grain emulsions. Conventional features are further illustrated by the following incorporated by reference disclosures:

ICBR-1: *Research Disclosure*, Vol. 308, December 1989, Item 308,119;

ICBR-2: *Research Disclosure*, Vol. 225, January 1983, Item 22,534;

ICBR-3: Wey et al U.S. Pat. No. 4,414,306, issued Nov. 8, 1983;

ICBR-4: Solberg et al U.S. Pat. No. 4,433,048, issued Feb. 21, 1984;

ICBR-5: Wilgus et al U.S. Pat. No. 4,434,226, issued Feb. 28, 1984;

ICBR-6: Maskasky U.S. Pat. No. 4,435,501, issued Mar. 6, 1984;

ICBR-7: Maskasky U.S. Pat. No. 4,643,966, issued Feb. 17, 1987;

ICBR-8: Daubendiek et al U.S. Pat. No. 4,672,027, issued Jan. 9, 1987;

ICBR-9: Daubendiek et al U.S. Pat. No. 4,693,964, issued Sep. 15, 1987;

ICBR-10: Maskasky U.S. Pat. No. 4,713,320, issued Dec. 15, 1987;

ICBR-11: Saitou et al U.S. Pat. No. 4,797,354, issued Jan. 10, 1989;

ICBR-12: Ikeda et al U.S. Pat. No. 4,806,461, issued Feb. 21, 1989;

ICBR-13: Makino et al U.S. Pat. No. 4,853,322, issued Aug. 1, 1989; and

ICBR-14: Daubendiek et al U.S. Pat. No. 4,914,014, issued Apr. 3, 1990.

Photographic elements are contemplated containing in at least one layer a high chloride {100} tabular grain emulsion according to the invention. In the simplest contemplated form, the photographic element is a black-and-white taking film or print forming paper containing a single high chloride {100} tabular grain emulsion layer. In another black-and-white photographic element construction, particualarly common in taking film constructions, two emulsions are present differing in photographic speed, with the faster emulsion coated over or blended with the slower emulsion. In this construction the high chloride {100} tabular grain emulsion can form either the faster or slower emulsion or both. For example, when image definition is of paramount importance, a faster high coated over a slower emulsion layer, which can contain a conventional nontabular grain emulsion of any convenient halide composition. For a very high speed taking film, a preferred construction is to coat a conventional high aspect ratio tabular grain silver iodobromide emulsion in the overlying faster emulsion layer and to coat a high chloride {100} tabular grain emulsion in the underlying emulsion layer. In each of the constructions the presence of a high chloride emulsion in the layer nearest the support facilitates rapid processing. In addition to the emulsion layer or layers and the support the taking film can and typically does additionally include a conventional antihalation layer interposed between the support and the nearest emulsion layer or coated on the opposite side of the support and/or a conventional photographic vehicle overcoat, typically including an anti-matting agent and one or more surfactants, UV-absorbers and/or lubricants.

Black-and-white photographic elements usually rely on developed silver to produce a viewable image. It is well known to supplement or replace the silver image with a neutral density dye image, where the dye image is formed by the same techniques employed in color photography, except that instead of forming a single dye of a neutral hue it is usually more advantageous to form neutral hues by employing a combination of dyes.

Monochromatic color photographic elements can be constructed identically to the black-and-white films and print elements. In the simplest photographic element construction dye image-forming compounds are introduced into the film during processing and developed silver is bleached to leave a dye image. It is usually more convenient to incorporate one or more dye image-forming compounds in the color photographic element in reactive association with the emulsion layer or layers. Usually reactive association is achieved by incorporating the dye image providing compound in the emulsion layer or layers or in an adjacent layer, usually a contiguous adjacent layer.

Multicolor photographic elements differ from monochromatic color photographic elements in that at least three superimposed dye image forming layer units are coated on the film support. Typically a blue recording layer unit is provided to produce a viewable yellow dye image, a green recording layer unit is provided to produce a viewable magenta dye image, and a red recording layer unit is provided to produce a viewable cyan dye image. Each layer unit contains at least one emulsion layer. Commonly each layer unit contains two or three superimposed emulsion layers differing in sensitivity, with the more sensitive of adjacent emulsion layers within a layer unit being coated farther from the support. In addition to the layers noted, muticolor photographic elements include an interlayer containing an oxidized developing agent scavenger between adjacent layer units to avoid color contamination of the separate blue, green and red exposure records.

In multicolor films that are intended to be scanned for computer storage of image information as opposed to being used directly for producing a color print it is recognized that one, some or all of the layer units can, if desired, form "false color" dye images. Further, by eliminating silver bleaching it is possible to produce three separate exposure records using only two different image dyes. For example, the blue recording layer unit can form only a silver image, a yellow dye image, a magenta dye image, a cyan dye image or a near infrared absorbing dye image. If the blue recording layer unit does not form a dye image, then the green recording layer unit must form a dye image, which can be any hue noted above. If the blue recording layer unit does form a dye image, then the green recording layer unit can form only a silver image or a dye image of any hue other than that formed by the blue recording layer unit. Finally, if each of the blue and green recording layer units form dye images, the red recording layer unit can form only a silver image or a dye image of any hue not formed by the remaining layer units. If one of the blue and green recording layer units forms only a silver image, then the red recording layer unit must form a dye image.

In a specifically preferred form of the invention at least one emulsion layer in a color photographic element contains a high chloride {100} tabular grain emulsion and, in reactive association with the emulsion, at least one image-dye forming compound and an image modifying compound that contains a photographically useful group that is released by reaction of the modifying compound with oxidized developing agent. It is possible to include a high chloride {100} tabular grain emulsion in only one emulsion layer of one layer unit, in all emulsion layers in only one layer unit, in one emulsion of each layer unit, or in more than one emulsion layer in each emulsion layer unit. In one specifically contemplated form of the invention all of the latent image forming emulsions in all of the layer units are high chloride {100} tabular grain emulsions. Any emulsions that are not high chloride {100} tabular grain emulsions can take any convenient conventional form known to be useful in photographic elements. In each occurrence of a high chloride {100} tabular grain emulsion it is preferably in reactive association with at least one image-dye forming compound and an image modifying compound that contains a photographically useful group that is released by reaction of the modifying compound with oxidized developing agent.

Following is a description of the terms "dye image-forming compound" and "photographically useful group-releasing compound", sometimes referred to simply as "PUG-releasing compound", as used herein.

A dye image-forming compound is typically a coupler compound, a dye redox releaser compound, a dye developer compound, an oxichromic developer compound, or a bleachable dye or dye precursor compound. Dye redox releaser, dye developer, and oxichromic developer compounds useful in color photographic elements that can be employed in image transfer processes are described in *The Theory of the Photographic Process*, 4th edition, T.H. James, editor, Macmillan, New York, 1977, Chapter 12, Section V, and in Section XXIII of *Research Disclosure*, December 1989, Item 308119, published by Kenneth Mason Publications, Ltd., Dudley Annex, 12a North Street, Emsworth, Hampshire, PO1O 7DQ, United Kingdom. Dye compounds useful in color photographic elements employed in dye bleach processes are described in Chapter 12, Section IV, of *The Theory of the Photographic Process*, 4th edition.

Preferred dye image-forming compounds are coupler compounds, which react with oxidized color developing agents to form colored products, or dyes. A coupler compound contains a coupler moiety COUP, which is combined with the oxidized developer species in the coupling reaction to form the dye structure. A coupler compound can additionally contain a group, called a coupling-off group, that is attached to the coupler moiety by a bond that is cleaved upon reaction of the coupler compound with oxidized color developing agent. Coupling-off groups can be halogen, such as chloro, bromo, fluoro, and iodo, or organic radicals that are attached to the coupler moieties by atoms such as oxygen, sulfur, nitrogen, phosphorus, and the like.

A PUG-releasing compound is a compound that contains a photographically useful group and is capable of reacting with an oxidized developing agent to release said group. Such a PUG-releasing compound comprises a carrier moiety and a leaving group, which are linked by a bond that is cleaved upon reaction with oxidized developing agent. The leaving group contains the PUG, which can be present either as a preformed species, or as a blocked or precursor species that undergoes further reaction after cleavage of the leaving group from the carrier to produce the PUG. The reaction of an oxidized developing agent with a PUG-releasing compound can produce either colored or colorless products.

Carrier moieties (CAR) include hydroquinones, catechols, aminophenols, sulfonamidophenols, sulfonamidonaphthols, hydrazides, and the like that undergo cross-oxidation by oxidized developing agents. A preferred carrier moiety in a PUG-releasing compound is a coupler moiety COUP, which can combine with an oxidized color developer in the cleavage reaction to form a colored species, or dye. When the carrier moiety is a COUP, the leaving group is referred to as a coupling-off group. As described previously for leaving groups in general, the coupling-off group contains the PUG, either as a preformed species or as a blocked or precursor species. The coupler moiety can be ballasted or unballasted. It can be monomeric, or it can be part of a dimeric, oligomeric or polymeric coupler, in which case more than one group containing PUG can be contained in the coupler, or it can form part of a bis compound in which the PUG forms part of a link between two coupler moieties.

The PUG can be any group that is typically made available in a photographic element in an imagewise fashion. The PUG can be a photographic reagent or a photographic dye. A photographic reagent, which upon release further reacts with components in the photographic element as described herein, is a moiety such as a development inhibitor, a development accelerator, a bleach inhibitor, a bleach accelerator, an electron transfer agent, a coupler (for example, a competing coupler, a dye-forming coupler, or a development inhibitor releasing coupler, a dye precursor, a dye, a developing agent (for example, a competing developing agent, a dye-forming developing agent, or a silver halide developing agent), a silver complexing agent, a fixing agent, an image toner, a stabilizer, a hardener, a tanning agent, a fogging agent, an ultraviolet radiation absorber, an antifoggant, a nucleator, a chemical or spectral sensitizer, or a desensitizer.

The PUG can be present in the coupling-off group as a preformed species or it can be present in a blocked form or as a precursor. The PUG can be, for example, a preformed development inhibitor, or the development inhibiting function can be blocked by being the point of attachment to the carbonyl group bonded to PUG in the coupling-off group. Other examples are a preformed dye, a dye that is blocked to shift its absorption, and a leuco dye.

A PUG-releasing compound can be described by the formula CAR-$(TIME)_n$-PUG, wherein (TIME) is a linking or timing group, n is 0, 1, or 2, and CAR is a carrier moiety from which is released imagewise a PUG (when n is 0) or a PUG precursor $(TIME)_1$-PUG or $(TIME)_2$-PUG (when n is 1 or 2) upon reacting with oxidized developing agent. Subsequent reaction of $(TIME)_1$-PUG or $(TIME)_2$-PUG produces PUG.

Linking groups (TIME), when present, are groups such as esters, carbamates, and the like that undergo base-catalyzed cleavage, including intramolecular nucleophilic displacement, thereby releasing PUG. Where n is 2, the (TIME) groups can be the same or different. Suitable linking groups, which are also known as timing groups, are shown in U.S. Pat. Nos. 5,151,343; 5,051,345; 5,006,448; 4,409,323; 4,248,962; 4,847,185; 4,857,440; 4,857,447; 4,861,701; 5,021,322; 5,026,628, and 5,021,555, all incorporated herein by reference. Especially useful linking groups are p-hydroxphenylmethylene moieties, as illustrated in the previously mentioned U.S. Pat. Nos. 4,409,323; 5,151,343 and 5,006,448, and o-hydroxyphenyl substituted carbamate groups, disclosed in U.S. Pat. Nos. 5,151,343 and 5,021,555, which undergo intramolecular cyclization in releasing PUG.

When TIME is joined to a COUP, it can be bonded at any of the positions from which groups are released from couplers by reaction with oxidized color developing agent. Preferably, TIME is attached at the coupling position of the coupler moiety so that, upon reaction of the coupler with oxidized color developing agent, TIME, with attached groups, will be released from COUP.

TIME can also be in a non-coupling position of the coupler moiety from which it can be displaced as a result of reaction of the coupler with oxidized color developing agent. In the case where TIME is in a non-coupling position of COUP, other groups can be in the coupling position, including conventional coupling off groups. Also, the same or different inhibitor moieties from those described in this invention can be used. Alternatively, COUP can have TIME and PUG in each of a coupling position and a non-coupling position. Accordingly, compounds useful in this invention can release more than one mole of PUG per mole of coupler.

TIME can be any organic group which will serve to connect CAR to the PUG moiety and which, after cleavage from CAR, will in turn be cleaved from the PUG moiety. This cleavage is preferably by an intramolecular nucleophilic displacement reaction of the type described in, for example, U.S. Pat. No. 4,248,962, or by electron transfer along a conjugated chain as described in, for example, U.S. Pat. No. 4,409,323.

As used herein, the term "intramolecular nucleophilic displacement reaction" refers to a reaction in which a nucleophilic center of a compound reacts directly, or indirectly through an intervening molecule, at another site on the compound, which is an electrophilic center, to effect displacement of a group or atom attached to the electrophilic center. Such compounds have both a nucleophilic group and an electrophilic group spatially related by the configuration of the molecule to promote reactive proximity. Preferably, the nucleophilic group and the electrophilic group are located in the compound so that a cyclic organic ring, or a transient cyclic organic ring, can be easily formed by an intramolecular reaction involving the nucleophilic center and the electrophilic center.

Useful timing groups are represented by the structure:

$$\leftarrow Nu - LINK \rightarrow E$$

wherein:

Nu is a nucleophilic group attached to a position on CAR from which it will be displaced upon reaction of CAR with oxidized developing agent;

E is an electrophilic group attached to an inhibitor moiety as described and is displaceable therefrom by Nu after Nu is displaced from CAR; and LINK is a linking group for spatially relating Nu and E, upon displacement of Nu from CAR, to undergo an intramolecular nucleophilic displacement reaction with the formation of a 3- to 7-membered ring and thereby release the PUG moiety.

A nucleophilic group (Nu) is defined herein as a group of atoms one of which is electron rich. Such an atom is referred to as a nucleophilic center. An electrophilic group (E) is defined herein as a group of atoms one of which is electron deficient. Such an atom is referred to as an electrophilic center.

Thus, in PUG-releasing compounds as described herein, the timing group can contain a nucleophilic group and an electrophilic group, which groups are spatially related with respect to one another by a linking group so that, upon release from CAR, the nucleophilic center and the electrophilic center will react to effect displacement of the PUG moiety from the timing group. The nucleophilic center should be prevented from reacting with the electrophilic center until release from the CAR moiety, and the electrophilic center should be resistant to external attack, such as hydrolysis. Premature reaction can be prevented by attaching the CAR moiety to the timing group at the nucleophilic center or an atom in conjunction with a nucleophilic center, so that cleavage of the timing group and the PUG moiety from CAR unblocks the nucleophilic center and permits it to react with the electrophilic center, or by positioning the nucleophilic group and the electrophilic group so that they are prevented from coming into reactive proximity until release. The timing group can contain additional substituents, such as additional photographically useful groups (PUGs), or precursors thereof, which may remain attached to the timing group or be released.

It will be appreciated that, in the timing group, for an intramolecular reaction to occur between the nucleophilic group and the electrophilic group, the groups should be spatially related after cleavage from CAR so that they can react with one another. Preferably, the nucleophilic group and the electrophilic group are spatially related within the timing group so that the intramolecular nucleophilic displacement reaction involves the formation of a 3- to 7-membered ring, most preferably a 5- or 6-membered ring.

It will be further appreciated that for an intramolecular reaction to occur in the aqueous alkaline environment encountered during photographic processing, the thermodynamics should be such and the groups be so selected that an overall free energy decrease results upon ring closure, forming the bond between the nucleophilic group and the electrophilic group, and breaking the bond between the electrophilic group and the PUG. Not all possible combinations of nucleophilic group, linking group, and electrophilic group will yield a thermodynamic relationship favorable to breaking of the bond between the electrophilic group and the PUG moiety. However, it is within the skill of the art to select appropriate combinations taking the above energy relationships into account.

Representative Nu groups contain electron rich oxygen, sulfur and nitrogen atoms. Representative E groups contain electron deficient carbonyl, thiocarbonyl, phosphonyl and thiophosphonyl moieties. Other useful Nu and E groups will be apparent to those skilled in the art.

The linking group can be an acyclic group such as alkylene, for example, methylene, ethylene or propylene, or a cyclic group such as an aromatic group, such as phenylene or naphthylene, or a heterocyclic group, such as furan, thophene, pyridine, quinoline or benzoxazine. Preferably, LINK is alkylene or arylene. The groups Nu and E are attached to LINK to provide, upon release of Nu from CAR, a favorable spatial relationship for nucleophilic attack of the nucleophilic center in Nu on the electrophilic center in E. When LINK is a cyclic group, Nu and E can be attached to the same or adjacent rings. Aromatic groups in which Nu and E are attached to adjacent ring positions are particularly preferred LINK groups.

TIME can be unsubstituted or substituted. The substituents can be those which will modify the rate of reaction, diffusion, or displacement, such as halogen, including fluoro, chloro, bromo, or iodo, nitro, alkyl of 1 to 20 carbon atoms, acyl, such as carboxy, carboxyalkyl, alkoxycarbonyl, alkoxycarbonamido, sulfoalkyl, alkanesulfonamido, and alkylsulfonyl, solubilizing groups, ballast groups and the like, or they can be substituents which are separately useful in the photographic element, such as a stabilizer, an antifoggant, a dye (such as a filter dye or a solubilized masking dye) and the like. For example, solubilizing groups will increase the rate of diffusion; ballast groups will decrease the rate of diffusion; electron withdrawing groups will decrease the rate of displacement of the PUG.

As used herein, the term "electron transfer down a conjugated chain" is understood to refer to transfer of an electron along a chain of atoms in which alternate single bonds and double bonds occur. A conjugated chain is understood to have the same meaning as commonly used in organic chemistry. This further includes TIME groups capable of undergoing fragmentation reactions where the number of double bonds is zero. Electron transfer down a conjugated chain is described in, for example, U.S. Pat. No. 4,409,323.

As previously described, more than one sequential TIME moiety can be usefully employed. Useful TIME moieties can have a finite half-life or an extremely short half-life. The half-life is controlled by the specific structure of the TIME moiety, and may be chosen so as to best optimize the photographic function intended.

TIME moiety half-lives of from less than 0.001 second to over 10 minutes are known in the art. TIME moieties having a half-life of over 0.1 second are often preferred for use in PUG-releasing compounds that yield development inhibitor moieties, although use of TIME moieties with shorter half-lives to produce development inhibitor moieties is known in the art. The TIME moiety may either spontaneously liberate a PUG after being released from CAR, or may liberate PUG only after a further reaction with another species present in a process solution, or may liberate PUG during contact of the photographic element with a process solution.

Following is a listing of patents and publications that describe representative coupler compounds that contain COUP groups useful in the invention:

Couplers which form cyan dyes upon reaction with oxidized color developing agents are described in such representative patents and publications as: U.S. Pat. Nos. 2,772,162; 2,895,826; 3,002,836; 3,034,892; 2,474,293; 2,423,730; 2,367,531; 3,041,236; 4,333,999, "Farbkuppler-eine Literaturubersicht," published in Agfa Mitteilungen, Band III, pp. 156–175 (1961), and Section VII D of *Research Disclosure*, Item 308119, December 1989. Preferably such couplers are phenols and naphthols.

Couplers which form magenta dyes upon reaction with oxidized color developing agent are described in such representative patents and publications as: U.S. Pat. Nos. 2,600,788; 2,369,489; 2,343,703; 2,311,082; 3,152,896; 3,519,429; 3,062,653; 2,908,573, "Farbkuppler-eine Literaturubersicht," published in Agfa Mitteilungen, Band III, pp. 126–156 (1961), and Section VII D of *Research Disclosure*, Item 308119, December 1989. Preferably such couplers are pyrazolones or pyrazolotriazoles.

Couplers which form yellow dyes upon reaction with oxidized and color developing agent are described in such representative patents and publications as: U.S. Pat. Nos. 2,875,057; 2,407,210; 3,265,506; 2,298,443; 3,048,194; 3,447,928, "Farbkuppler-eine Literaturubersicht," published in Agfa Mitteilungen, Band III, pp. 112–126 (1961), and Section VII D of *Research Disclosure*, Item 308119, December 1989. Preferably such couplers are acylacetamides, such as benzoylacetamides and pivaloylacetamides.

Couplers which form colorless products upon reaction with oxidized color developing agent are described in such representative patents as: U.K. Patent No. 861,138; U.S. Pat. Nos. 3,632,345; 3,928,041; 3,958,993 and 3,961,959. Preferably, such couplers are cyclic carbonyl-containing compounds which react with oxidized color developing agents but do not form dyes.

PUG groups that are useful in the present invention include, for example:

1. PUG's which form development inhibitors upon release

PUG's which form development inhibitors upon release are described in such representative patents as U.S. Pat. Nos. 3,227,554; 3,384,657; 3,615,506; 3,617,291; 3,733,201 and U.K. Pat. No. 1,450,479. Useful development inhibitors are iodide and heterocyclic compounds such as mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, oxadiazoles, benzotriazoles, benzodiazoles, oxazoles, thiazoles, diazoles, triazoles, thiadiazoles, oxathiazoles, thiatriazoles, tetrazoles, benzimidazoles, indazoles, isoindazoles, mercaptooxazoles, mercaptothiadiazoles, mercaptothiazoles, mercaptotriazoles, mercaptooxadiazoles, mercaptodiazoles, mercaptooxathiazoles, tellurotetrazoles, or benzisodiazoles. Structures of typical development inhibitor moieties are:

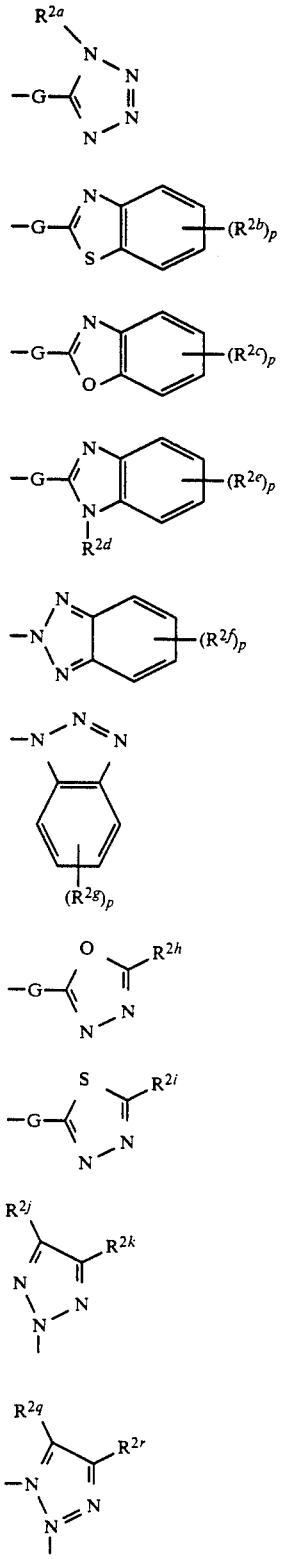

-continued

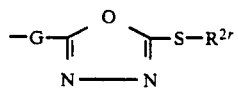

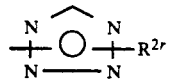

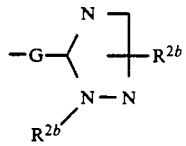

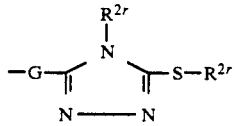

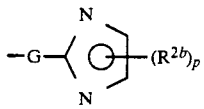

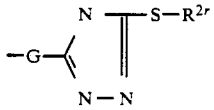

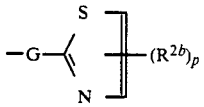

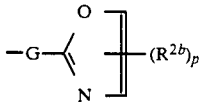

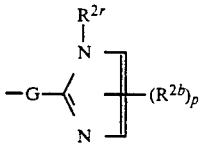

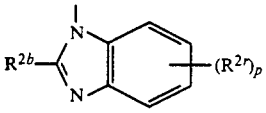

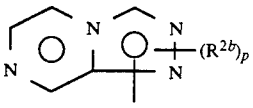

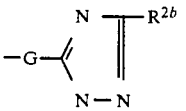

-continued

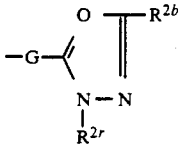

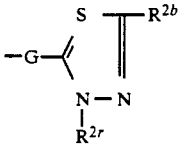

wherein:

G is S, Se, or Te, S being preferred; and wherein $R^{2a}$, $R^{2d}$, $R^{2h}$, $R^{2i}$, $R^{2j}$, $R^{2k}$, $R^{2q}$ and $R^{2r}$ are individually hydrogen, substituted or unsubstituted alkyl, straight chained or branched, saturated or unsaturated, of 1 to 8 carbon atoms such as methyl, ethyl, propyl, butyl, 1-ethylpentyl, 2-ethoxyethyl, t-butyl or i-propyl; alkoxy or alkylthio, such as methoxy, ethoxy, propoxy, butoxy, octyloxy, methylthio, ethylthio, propylthio, butylthio, or octylthiol; alkyl esters such as $CO_2CH_3$, $CO_2C_2H_5$, $CO_2C_3H_7$, $CO_2C_4H_9$, $CH_2CO_2CH_3$, $CH_2CO_2C_2H_5$, $CH_2CO_2C_3H_7$, $CH_2CO_2C_4H_9$, $CH_2CH_2CO_2CH_3$, $CH_2CH_2CO_2C_2H_5$, $CH_2CH_2CO_2C_3H_7$, and $CH_2CH_2CO_2C_4H_9$; aryl or heterocyclic esters such as $CO_2R^{2s}$, $CH_2CO_2R^{2s}$, and $CH_2CH_2CO_2R^{2s}$ wherein $R^{2s}$ is substituted or unsubstituted aryl, or a substituted or unsubstituted heterocyclic group; substituted or unsubstituted benzyl, such as methoxy-, chloro-, nitro-, hydroxy-, carboalkoxy-, carboaryloxy-, keto-, sulfonyl-, sulfenyl-, sulfinyl-, carbonamido-, sulfonamido-, carbamoyl-, or sulfamoyl-substituted benzyl; substituted or unsubstituted aryl, such as phenyl, naphthyl, or chloro-, methoxy-, hydroxy-, nitro-, hydroxy-, carboalkoxy-, carboaryloxy-, keto-, sulfonyl-, sulfenyl-, sulfinyl-, carbonamido-, sulfonamido-, carbamoyl-, or sulfamoyl-substituted phenyl. These substituents may be repeated more than once as substituents. $R^{2a}$, $R^{2d}$, $R^{2h}$, $R^{2i}$, $R^{2j}$, $R^{2k}$, $R^{2q}$ and $R^{2r}$ may also be a substituted or unsubstituted heterocyclic group selected from groups such as pyridine, pyrrole, furan, thiophene, pyrazole, thiazole, imidazole, 1,2,4-triazole, oxazole, thiadiazole, indole, benzthiophene, benzimidazole, benzoxazole and the like wherein the substitutents are as selected from those mentioned previously.

$R^{2b}$, $R^{2c}$, $R^{2e}$, $R^{2f}$, and $R^{2g}$, are as described for $R^{2a}$, $R^{2d}$, $R^{2h}$, $R^{2i}$, $R^{2j}$, $R^{2k}$, $R^{2q}$ and $R^{2r}$; or, are individually one or more halogens such as chloro, fluoro or bromo and p is 0, 1, 2, 3 or 4.

2. PUGs which are dyes, or form dyes upon release

Suitable dyes and dye precursors include azo, azomethine, azophenol, azonaphthol, azoaniline, azopyrazolone, indoaniline, indophenol, anthraquinone, triarylmethane, alizarin, nitro, quinoline, indigoid and phthalocyanine dyes or precursors of such dyes such as leuco dyes, tetrazolium salts or shifted dyes. These dyes can be metal complexed or metal complexable. Representative patents describing such dyes are U.S. Pat. Nos. 3,880,658; 3,931,144; 3,932,380; 3,932,381; 3,942,987, and 4,840,884. Preferred dyes and dye precursors are azo, azomethine, azophenol, azonaphthol, azoaniline, and indoaniline dyes and dye precursors. Structures of typical dyes and dye precursors are:
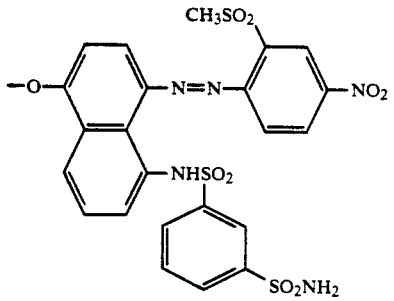
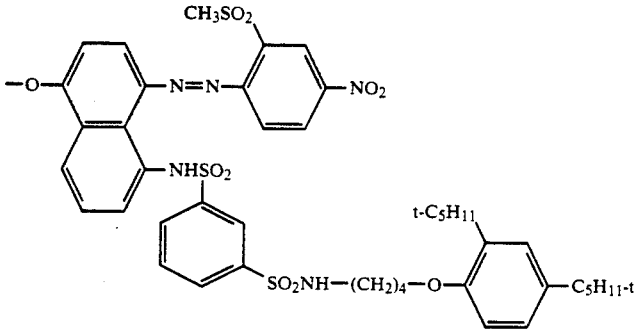
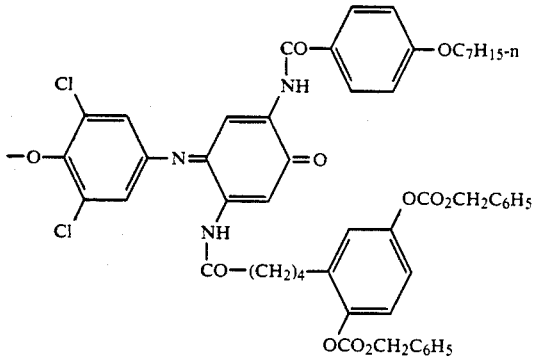
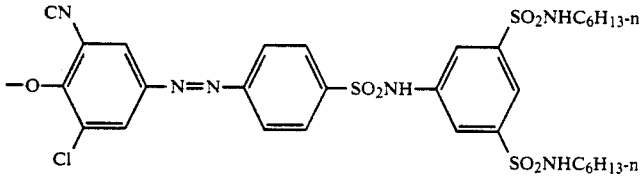
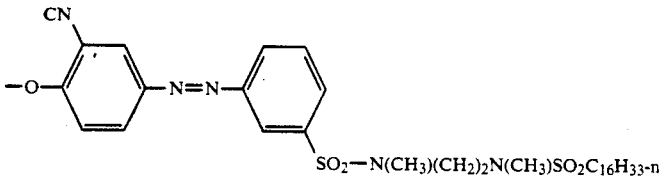
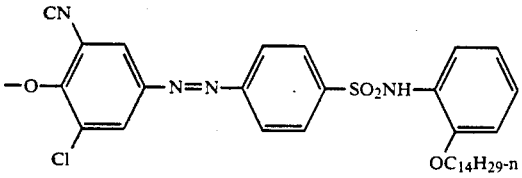

-continued

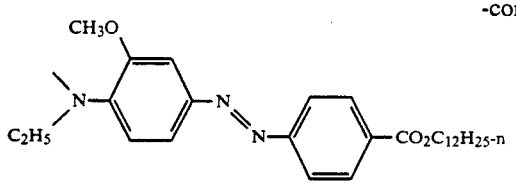

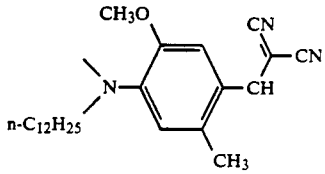

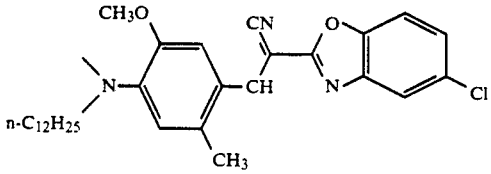

Suitable azo, azamethine and methine dyes are represented by the formulae in U.S. Pat. No. 4,840,884, col. 8, lines 1–70.

Dyes can be chosen from those described, for example, in J. Fabian and H. Hartmann, *Light Absorption of Organic Colorants*, published by Springer-Verlag Co., but are not limited thereto.

Typical dyes are azo dyes having a radical represented by the following formula:

$$-X-Y-N=N-Z$$

wherein X is a hetero atom such as an oxygen atom, a nitrogen atom and a sulfur atom, Y is an atomic group containing at least one unsaturated bond having a conjugated relation with the azo group, and linked to X through an atom constituting the unsaturated bond, Z is an atomic group containing at least one unsaturated bond capable of conjugating with the azo group, and the number of carbon atoms contained in Y and Z is 10 or more.

Furthermore, Y and Z are each preferably an aromatic group or an unsaturated heterocyclic group. As the aromatic group, a substituted or unsubstituted phenyl or naphthyl group is preferred. As the unsaturated heterocyclic group, a 4- to 7-membered heterocyclic group containing at least one hetero atom selected from a nitrogen atom, a sulfur atom and an oxygen atom is preferred, and it may be part of a benzene-condensed ring system. The heterocyclic group means groups having a ring structure such as pyrrole, thiophene, furan, imidazole, 1,2,4-triazole, oxazole, thiadiazole, pyridine, indole, benzthiophene, benzimidazole, or benzoxazole.

Y may be substituted with other groups as well as X and the azo groups. Examples of such other groups include an aliphatic or alicyclic hydrocarbon group, an aryl group, an acyl group, an alkoxycarbonyl group, an aryloxycarbonyl group, an acylamino group, an alkylthio, an arylthio group, a heterocyclic group, a sulfonyl group, a halogen atom, a nitro group, a nitroso group, a cyano group, —COOM (M=H, an alkali metal atom or $NH_4$), a hydroxyl group, a sulfonamido group, an alkoxy group, an aryloxy group, and an acyloxy group. In addition, a carbamoyl group, an amino group, a ureido group, a sulfamoyl group, a carbamoylsulfonyl group and a hydrazino group are included. These groups may be further substituted with a group such as those disclosed above repeatedly, for example once or twice.

In the case where Z is a substituted aryl group or a substituted unsaturated heterocyclic group, groups listed as substituents for Y can be used in the same manner for Z.

When Y and Z contain an aliphatic or alicyclic hydrocarbon moiety as a substituent, any substituted or unsubstituted, saturated, unsaturated or straight or branched groups having, in the case of an aliphatic hydrocarbon moiety, from 1 to 32, preferably from 1 to 20 carbon atoms, and, in the case of an alicyclic hydrocarbon moiety having from 5 to 32, preferably from 5 to 20 carbon atoms, can be used. When substitution is carried out repeatedly, the uppermost number of carbon atoms of the thus obtained substituent is preferably 32.

When Y and Z contain an aryl moiety as a substituent, the number of carbon atoms of the moiety is generally from 6 to 10, and preferably it is a substituted or unsubstituted phenyl group. In the present invention, groups in the formulas shown hereinabove and hereinafter are defined as follows:

An acyl group, a carbamoyl group, an amino group, a ureido group, a sulfamoyl group, a carbamoylsulfonyl group, an urethane group, a sulfonamido group, a hydrazino group, and the like represents unsubstituted groups thereof and substituted groups thereof which are substituted with an aliphatic hydrocarbon group, an alicyclic hydrocarbon group or an aryl group to form mono-, di-, or tri-substituted groups; an acylamino group, a sulfonyl group, a sulfonamido group, an acyloxy group and the like each is aliphatic alicyclic, and aromatic group.

Typical examples of this group represented by formula for azo dyes shown above are contained in, for example, U.S. Pat. Nos. 4,424,156 and 4,857,447, column 6, lines 35–70.

3. PUG's which are couplers

Couplers released can be nondiffusible color-forming couplers, non-color forming couplers or diffusible competing couplers. Representative patents and publications describing competing couplers are: "On the Chemistry of White Couplers," by W. Puschel, Agfa-Gevaert AG Mitteilungen and der Forschungs-Laboratorium der Agfa-Gevaert AG, Springer Verlag, 1954, pp. 352–367; U.S. Pat. Nos. 2,998,314; 2,808,329; 2,689,793; 2,742,832; German Patent No. 1,168,769 and British Patent No. 907,274. Structures of useful competing couplers are:

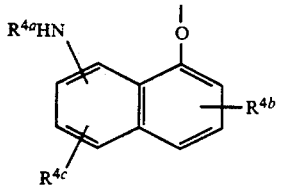

where $R^{4a}$ is hydrogen or alkylcarbonyl, such as acetyl, and $R^{4b}$ and $R^{4c}$ are individually hydrogen or a solubilizing group, such as sulfo, aminosulfonyl, and carboxy

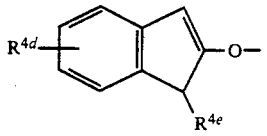

where $R^{4d}$ is as defined above and $R^{4e}$ is halogen, aryloxy, arylthio, or a development inhibitor, such as a mercaptotetrazole, such as phenylmercaptotetrazole or ethylmercaptotetrazole.

4. PUG's which form developing agents

Developing agents released can be color developing agents, black-and-white developing agents or cross-oxidizing developing agents. They include aminophenols, phenylenediamines, hydroquinones and pyrazolidones. Representative patents are: U.S. Pat. Nos. 2,193,015; 2,108,243; 2,592,364; 3,656,950; 3,658,525; 2,751,297; 2,289,367; 2,772,282; 2,743,279; 2,753,256 and 2,304,953.

Structures of suitable developing agents are:

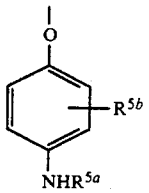

where $R^{5a}$ is hydrogen or alkyl of 1 to 4 carbon atoms and $R^{5b}$ is hydrogen or one or more halogen such as chloro or bromo; or alkyl of 1 to 4 carbon atoms such as methyl, ethyl or butyl groups.

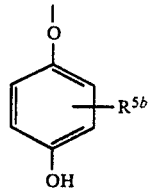

where $R^{5b}$ is as defined above.

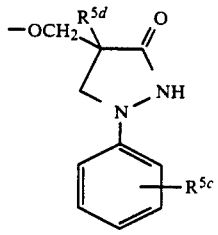

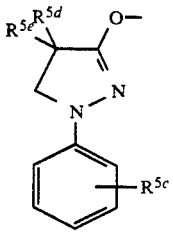

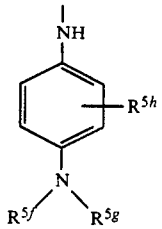

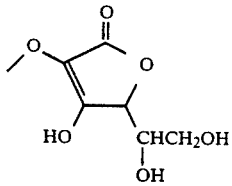

where $R^{5c}$ is hydrogen or alkyl of 1 to 4 carbon atoms and $R^{5d}$, $R^{5e}$, $R^{5f}$, $R^{5g}$, and $R^{5h}$ are individually hydrogen, alkyl of 1 to 4 carbon atoms such as methyl or ethyl; hydroxyalkyl of 1 to 4 carbon atoms such as hydroxymethyl or hydroxyethyl or sulfoalkyl containing 1 to 4 carbon atoms.

5. PUG's which are bleach inhibitors

Representative patents are U.S. Pat. Nos. 3,705,801; 3,715,208; and German OLS No. 2,405,279. Structures of typical bleach inhibitors are:

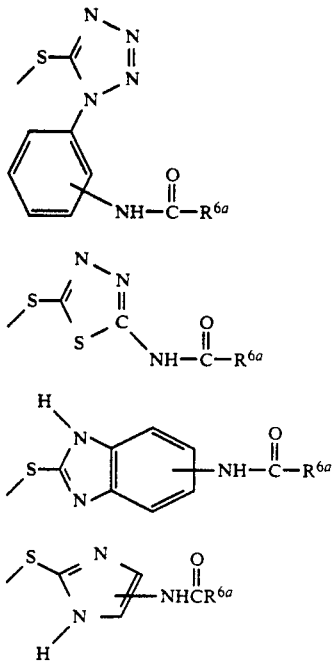

where $R^{6a}$ is alkyl or aryl of 6 to 20 carbon atoms.

6. PUG's which are bleach accelerators

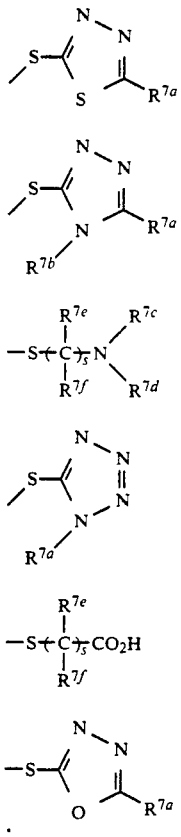

wherein $R^{7a}$ is hydrogen, alkyl, such as methyl, ethyl, and butyl, alkoxy, such as ethoxy and butoxy, or alkylthio, such as ethylthio and butylthio, for example containing 1 to 6 carbon atoms, and which may be unsubstituted or substituted; $R^{7b}$ is hydrogen, substituted or unsubstituted alkyl, or substituted or unsubstituted aryl, such as phenyl; $R^{7c}$, $R^{7d}$, $R^{7e}$ and $R^{7f}$ are individually hydrogen, substituted or unsubstituted alkyl, or substituted or unsubstituted aryl, such as straight chained or branched alkyl containing 1 to 6 carbon atoms, for example methyl, ethyl and butyl; s is 1 to 6; $R^{7c}$ and $R^{7d}$, or $R^{7e}$ and $R^{7f}$ together may form a 5-, 6-, or 7-membered ring.

It is often preferred for $R^{7a}$ and $R^{7b}$ to be solubilizing functions by the structure:

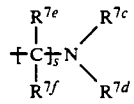

or

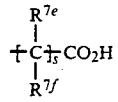

where $R^{7c}$, $R^{7d}$, $R^{7e}$, $R^{7f}$, and s are as defined above.

Other PUGs representative of bleach accelerators, can be found in for example U.S. Pat. Nos. 4,705,021; 4,912,024; 4,959,299; 4,705,021; 5,063,145, columns 21-22, lines 1-70; and EP Patent No. 0,193,389.

7 PUGs which are electron transfer agents (ETAs)

ETAs useful in the present invention are 1-aryl-3-pyrazolidinone derivatives which, once released, become active electron transfer agents capable of accelerating development under processing conditions used to obtain the desired dye image.

The electron transfer agent pyrazolidinone moieties which have been found to be useful in providing development acceleration function are derived from compounds generally of the type described in U.S. Pat. Nos. 4,209,580;, 4,463,081; 4,471,045; and 4,481,287 and in published Japanese patent application No. 62-123,172. Such compounds comprise 3-pyrazolidinone structures having an unsubstituted or substituted aryl group in the 1-position. Also useful are the combinations disclosed in U.S. Pat. No. 4,859,578. Preferably these compounds have one or more alkyl groups in the 4- or 5-positions of the pyrazolidinone ring.

Electron transfer agents suitable for use in this invention are represented by the following two formulas:

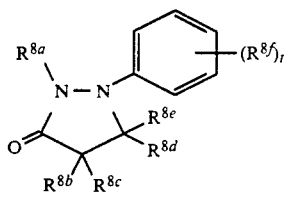

-continued

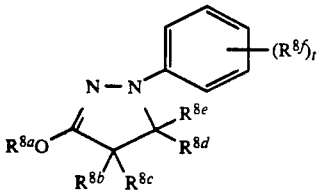

wherein:

$R^{8a}$ is hydrogen;

$R^{8b}$ and $R^{8c}$ each independently represents hydrogen, substituted or unsubstituted alkyl having from 1 to about 8 carbon atoms (such as hydroxyalkyl), carbamoyl, or substituted or unsubstituted aryl having from 6 to about 10 carbon atoms;

$R^{8d}$ and $R^{8e}$ each independently represents hydrogen, substituted or unsubstituted alkyl having from 1 to about 8 carbon atoms or substituted or unsubstituted aryl having from 6 to about 10 carbon atoms;

$R^{8f}$, which may be present in the ortho, meta or para positions of the benzene ring, represents halogen, substituted or unsubstituted alkyl having from 1 to about 8 carbon atoms, or substituted or unsubstituted alkoxy having from 1 to about 8 carbon atoms, or sulfonamido, and when m is greater than 1, the $R^{8f}$ substituents can be the same or different or can be taken together to form a carbocyclic or a heterocyclic ring, for example a benzene or an alkylenedioxy ring; and t is 0 or 1 to 3.

When $R^{8b}$ and $R^{8c}$ groups are alkyl, it is preferred that they comprise from 1 to 3 carbon atoms. When $R^{8b}$ and $R^{8c}$ represent aryl, they are preferably phenyl.

$R^{8d}$ and $R^{8e}$ are preferably hydrogen.

When $R^{8f}$ represents sulfonamido, it may be, for example, methanesulfonamido, ethanesulfonamido or toluenesulfonamido.

8. PUGs which are development inhibiting redox releasers (DIRRs)

DIRRs useful in the present invention include hydroquinone, catechol, pyrogallol, 1,4-naphthohydroquinone, 1,2-naphthoquinone, sulfonamidophenol, sulfonamidonaphthol and hydrazide derivatives which, once released, become active inhibitor redox releasing agents that are then capable of releasing a development inhibitor upon reaction with a nucleophile such as hydroxide ion under processing conditions used to obtain the desired dye image. Such redox releasers are represented by formula (II) in U.S. Pat. No. 4,985,336; col. 3, lines 10 to 25 and formulas (III) and (IV) col.14, line 54 to col. 17, line 11. Other redox releasers can be found in European Patent Application No. 0,285,176. Typical redox releasers include the following:

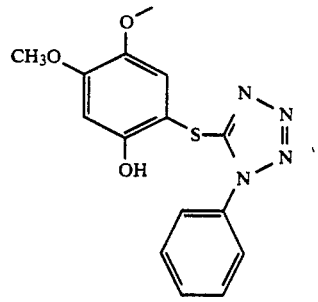

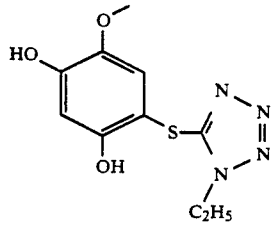

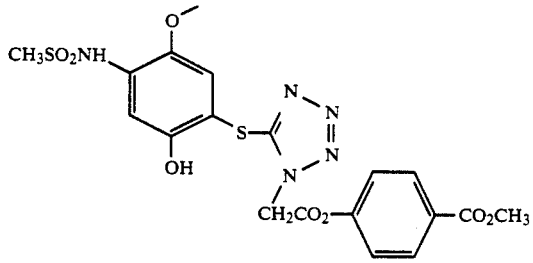

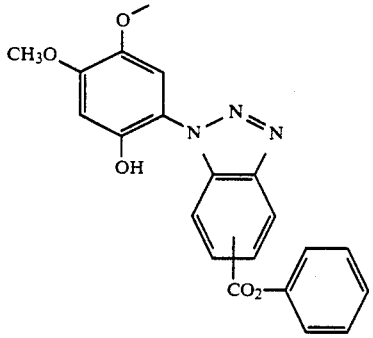

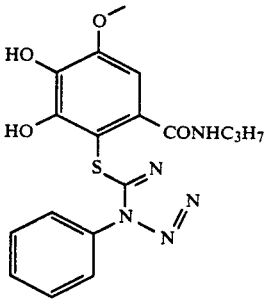

Couplers containing other suitable redox releasers can be found in for example, U.S. Pat. No. 4,985,336; cols. 17 to 62.

The following formula represents a 5-, 6-, or 7-membered nitrogen-containing unsaturated heterocyclic group which has 2 to 6 carbon atoms, which is connected to the carrier moiety through the nitrogen atom and which has a sulfonamido group and a development inhibitor group or a precursor thereof, on the ring carbon atoms. Z represents an atomic group necessary to form a 5-, 6-, or 7-membered nitrogen-containing unsaturated heterocyclic ring containing 2 to 6 carbon atoms together with the nitrogen atom; DI represents a development inhibitor group; and R represents a substituent; and DI is connected to a carbon atom of the heterocyclic ring represented by Z through a hetero atom included therein, and the sulfonamido group is connected to a carbon atom of the heterocyclic ring represented by Z, provided that the nitrogen atom through which the heterocyclic group is connected to the carrier moiety and the nitrogen atom in the sulfonamido group are positioned so as to satisfy the Kendall-Pelz rule as described, for example, in *The Theory Of The Photographic Process,* 4th edition, pp. 298–325.

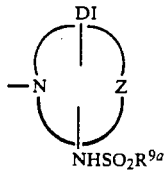

The group represented by the above formula is a group capable of being oxidized by the oxidation product of a developing agent. More specifically, the sulfonamido group thereon is oxidized to a sulfonylimino group from which a development inhibitor is cleaved.

Specific examples of the just described development inhibiting redox releasers are as follows:

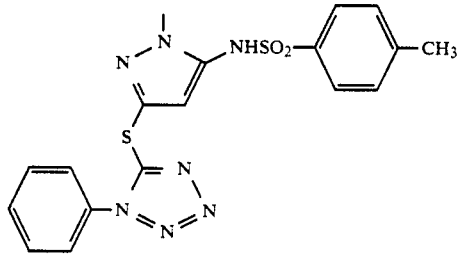

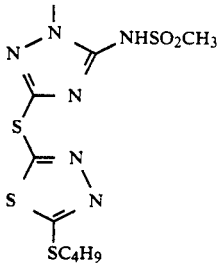

Other examples of development inhibiting redox releasers can be found in the couplers represented in for example European Patent Application 0,362,870; page 13, line 25 to page 29, line 20.

In a preferred embodiment, the PUG-releasing compound is a development inhibitor-releasing (DIR) compound. These DIR compounds may be incorporated in the same layer as the emulsions of this invention, in reactive association with this layer or in a different layer of the photographic material, all as known in the art.

These DIR compounds may be among those classified as "diffusable," meaning that they enable release of a highly transportable inhibitor moiety, or they may be classified as "non-diffusible", meaning that they enable release of a less transportable inhibitor moiety. The DIR compounds may comprise a timing or linking group as known in the art.

The inhibitor moiety of the DIR compound may be unchanged as the result of exposure to photographic processing solution. However, the inhibitor moiety may change in structure and effect in the manner disclosed in U.K. Patent No. 2,099,167; European Patent Application 167,168; Japanese Kokai 205150/83; or U.S. Pat. No. 4,782,012 as the result of photographic processing.

When the DIR compounds are dye-forming couplers, they may be incorporated in reactive association with complementary color sensitized silver halide emulsions, as for example a cyan dye-forming DIR coupler with a red sensitized emulsion or in a mixed mode, for example, a yellow dye-forming DIR coupler with a green sensitized emulsion, all known in the art.

The DIR compounds may also be incorporated in reactive association with bleach accelerator-releasing couplers, as disclosed in U.S. Pat. Nos. 4,912,024 and 5,135,839, and with the bleach accelerator-releasing compounds disclosed in U.S. Pat. Nos. 4,865,956 and 4,923,784, all incorporated herein by reference.

Specific DIR compounds useful in the practice of this invention are disclosed in the above cited references, in commercial use, and in the examples demonstrating the practice of this invention contained herein.

The dye image-forming compounds and PUG-releasing compounds can be incorporated in photographic elements of the present invention by means and processes known in the photographic art. A photographic element in which the dye image-forming and PUG-releasing compounds are incorporated can be a monocolor element comprising a support and a single silver halide emulsion layer, or it can be a multicolor, multilayer element comprising a support and multiple silver halide emulsion layers. The above described compounds can be incorporated in at least one of the silver halide emulsion layers and/or in at least one other layer, such as an adjacent layer, where they are in reactive association with the silver halide emulsion layer and are thereby able to react with the oxidized developing agent produced by development of silver halide in the emulsion layer. Additionally, the silver halide emulsion layers and other layers of the photographic element can contain addenda conventionally contained in such layers.

A typical multicolor, multilayer photographic element can comprise a support having thereon a red-sensitized silver halide emulsion unit having associated therewith a cyan dye image-forming compound, a green-sensitized silver halide emulsion unit having associated therewith a magenta dye image-forming compound, and a blue-sensitized silver halide emulsion unit having associated therewith a yellow dye image-forming compound. Each silver halide emulsion unit can be composed of one or more layers, and the various units and layers can be arranged in different locations with respect to one another, as known in the prior art and as illustrated by layer order formats hereinafter described.

In an element of the invention, a layer or unit affected by PUG can be controlled by incorporating in appropriate locations in the element a layer that confines the action of PUG to the desired layer or unit. Thus, at least one of the layers of the photographic element can be, for example, a scavenger layer, a mordant layer, or a barrier layer. Examples of such layers are described in, for example, U.S. Pat. Nos. 4,055,429; 4,317,892; 4,504,569; 4,865,946; and 5,006,451. The element can also contain additional layers such as antihalation layers, filter layers and the like. The element typically will have a total thickness, excluding the support, of from 5 to 30 m. Thinner formulations of 5 to about 25 m are generally preferred since these are known to provide improved contact with the process solutions. For the same reason, more swellable film structures are likewise preferred. Further, this invention may be particularly useful with a magnetic recording layer such as those described in *Research Disclosure*, Item 34390, November 1992, p. 869.

In the following discussion of suitable materials for use in the elements of this invention, reference will be made to the previously mentioned *Research Disclosure*, December 1989, Item 308119, the disclosures of which are incorporated herein by reference.

Suitable dispersing media for the emulsion layers and other layers of elements of this invention are described in Section IX of *Research Disclosure*, December 1989, Item 308119, and publications therein.

In addition to the compounds described herein, the elements of this invention can include additional dye image-forming compounds, as described in Sections VII A-E and H, and additional PUG-releasing compounds, as described in Sections VII F and G of *Research Disclosure*, December 1989, Item 308119, and the publications cited therein.

The elements of this invention can contain brighteners (Section V), antifoggants and stabilizers (Section VI), antistain agents and image dye stabilizers (Section VII I and J), light absorbing and scattering materials (Section VIII), hardeners (Section X), coating aids (Section XI), plasticizers and lubricants (Section XII), antistatic agents (Section XIII), matting agents (Section XVI), and development modifiers (Section XXI), all in *Research Disclosure*, December 1989, Item 308119.

The elements of the invention can be coated on a variety of supports, as described in Section XVII of *Research Disclosure*, December 1989, Item 308119, and references cited therein.

The elements of this invention can be exposed to actinic radiation, typically in the visible region of the spectrum as described in greater detail hereinafter, to form a latent image and then processed to form a visible dye image, as described in Sections XVIII and XIX of *Research Disclosure*, December 1989, Item 308119. Typically, processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N--(methanesulfonamido)ethylaniline sulfate hydrate, 4-amino-3-methyl-N-ethyl-N--hydroxyethylaniline sulfate, 4-amino-3--(methanesulfonamido)ethyl-N,N-diethylaniline hydrochloride, and 4-amino-N-ethyl-N-(2-methoxyethyl)m-toluidine di-p-toluenesulfonic acid.

With negative-working silver halide, the processing step described above provides a negative image. The described elements are preferably processed in the Kodak Flexicolor TM C-41 color process as described in, for example, the British Journal of Photography Annual of 1988, pages 196-198. To provide a positive (or reversal) image, the color development step can be preceded by development with a non-chromogenic developing agent to develop exposed silver halide but not form dye, and then uniform fogging of the element to render unexposed silver halide developable. The Kodak E-6 Process is a typical reversal process.

Development is followed by the conventional steps of bleaching, fixing, or bleach-fixing, to remove silver or silver halide, washing, and drying.

In the following tables are shown compounds useful in the practice of the present invention.

Table I contains the formulas of typical dye image-forming coupler compounds.

Table II contains the formulas of typical PUG-releasing compounds that release development inhibitor groups or precursors thereof. In Table III are shown the formulas of representative examples of other kinds of PUG-releasing compounds.

Table IV provides the formulas of miscellaneous exemplary photographic compounds that can be used in elements of the invention.

TABLE I

Typical Dye Image-Forming Coupler Compounds

C-1

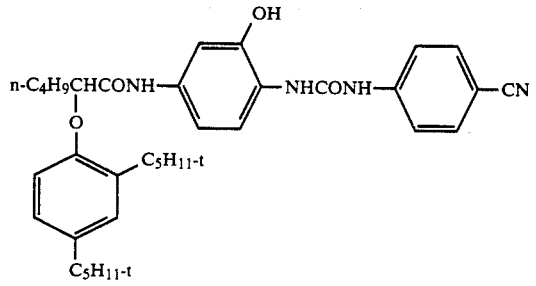

TABLE I-continued
Typical Dye Image-Forming Coupler Compounds
C-2
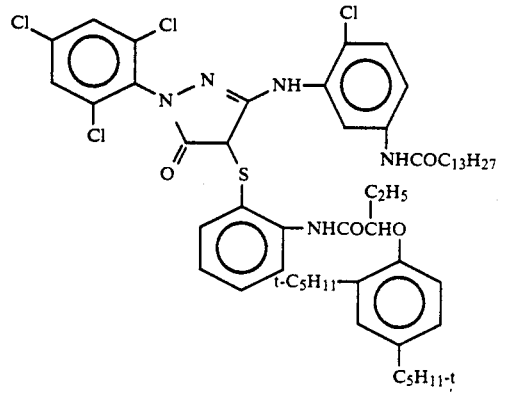
C-3
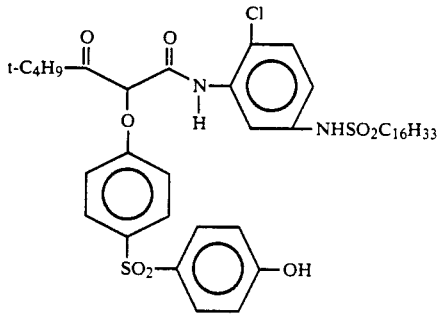
C-4
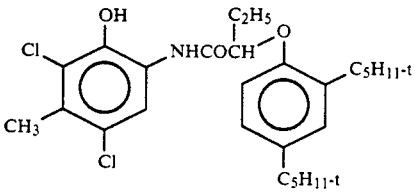
C-5
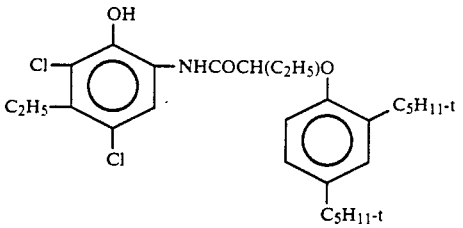
C-6
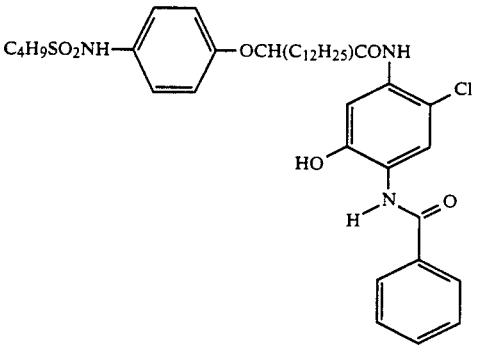

TABLE I-continued
Typical Dye Image-Forming Coupler Compounds
C-7
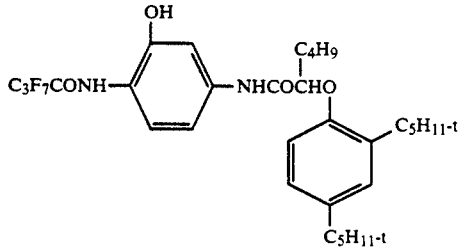
C-8
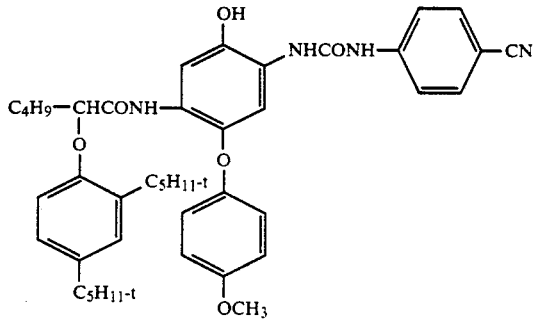
C-9
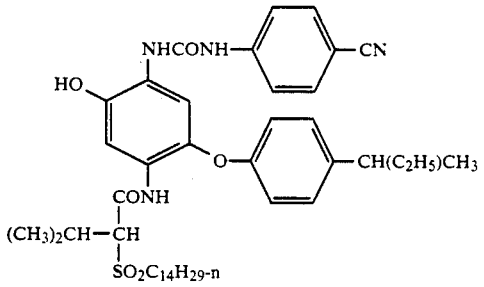
C-10
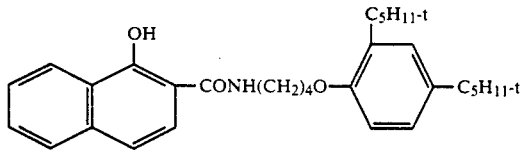
C-11
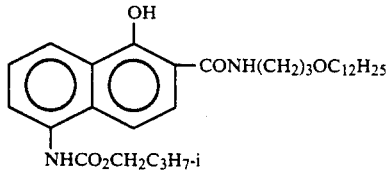
C-12
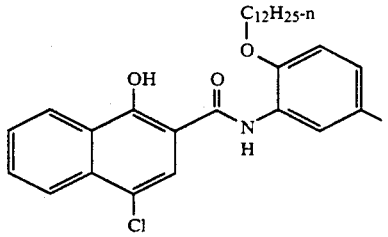

TABLE I-continued
Typical Dye Image-Forming Coupler Compounds
C-13
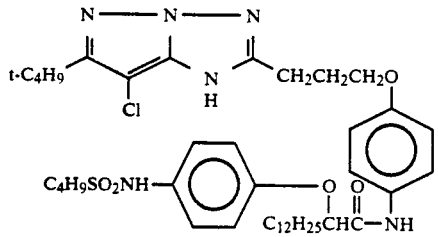
C-14
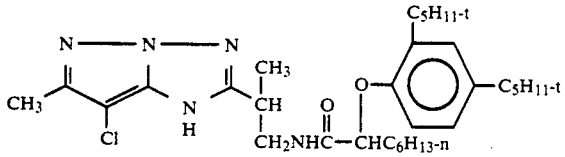
C-15
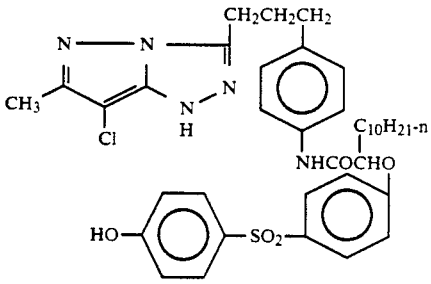
C-16
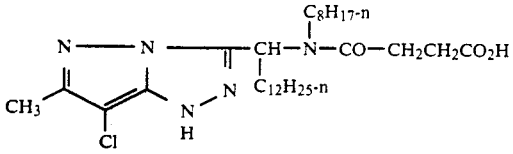
C-17
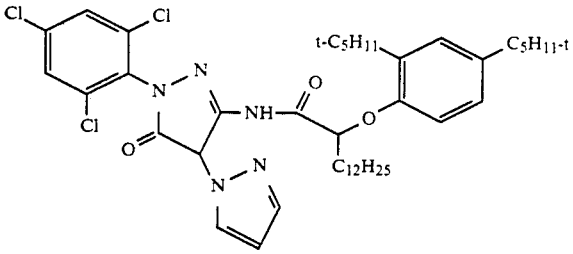
C-18
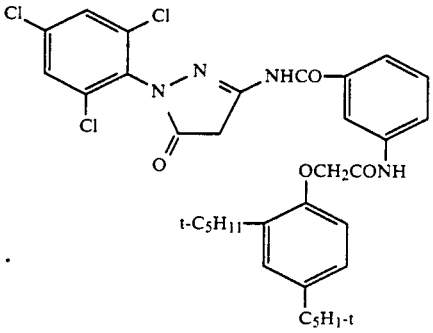

TABLE I-continued
Typical Dye Image-Forming Coupler Compounds
C-19
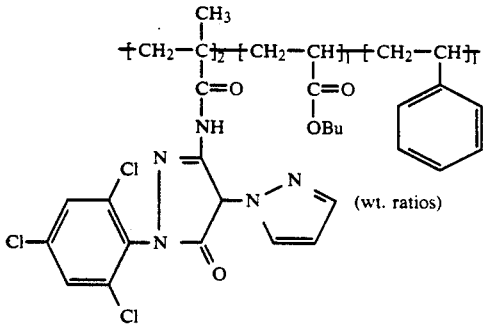
C-20
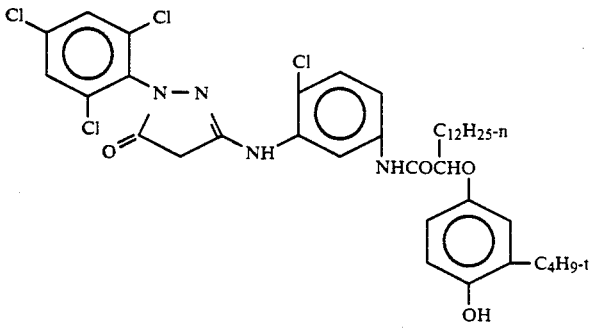
C-21
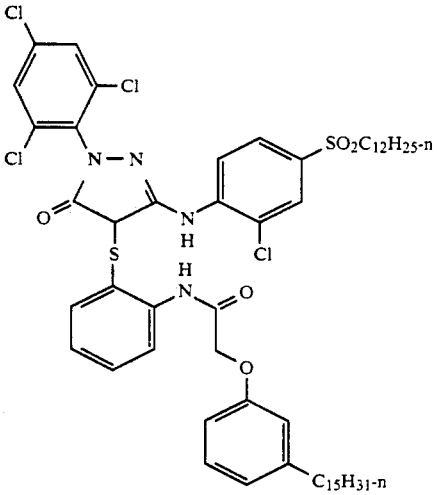
C-22
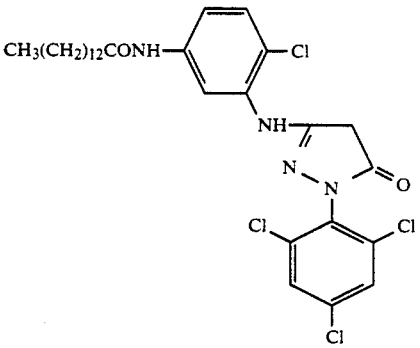

TABLE I-continued
Typical Dye Image-Forming Coupler Compounds
C-23
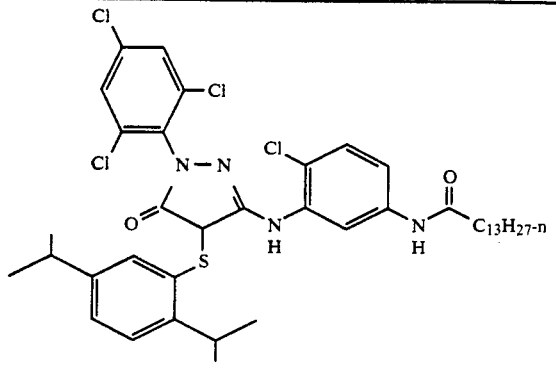
C-24
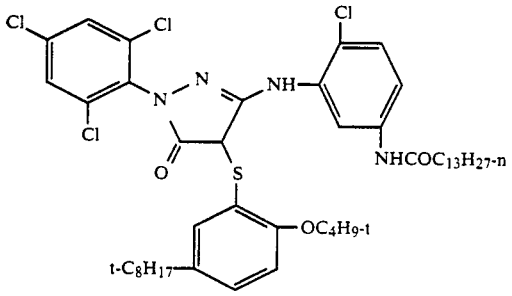
C-25
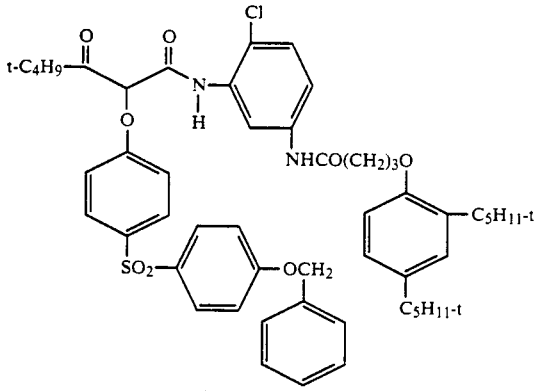
C-26
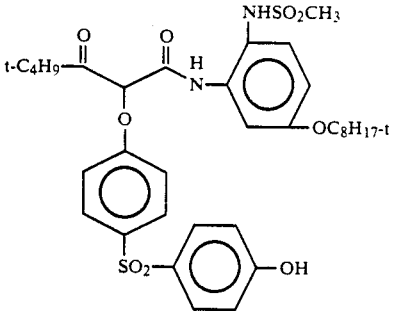
C-27
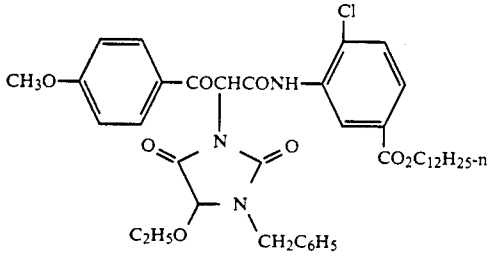

TABLE I-continued
Typical Dye Image-Forming Coupler Compounds
C-28
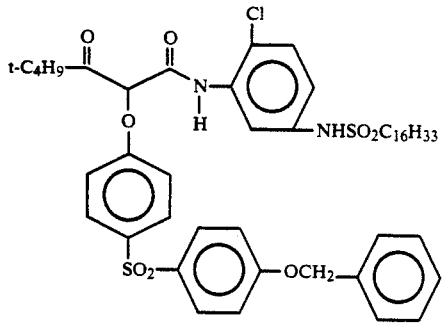
C-29
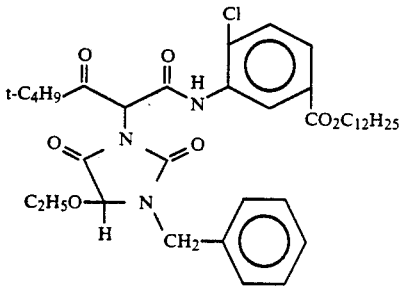
C-30
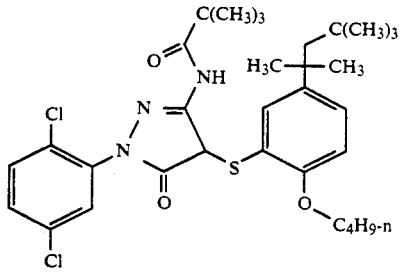
C-31
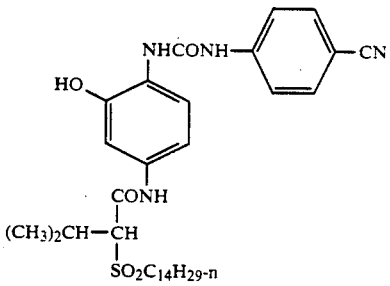
C-32
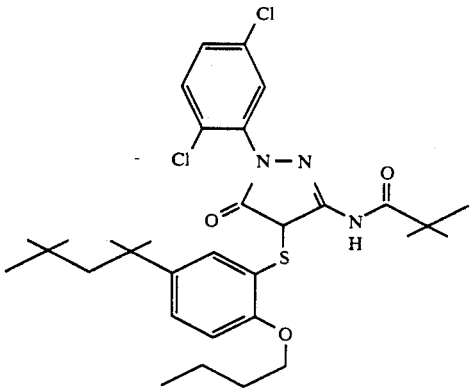

TABLE I-continued
Typical Dye Image-Forming Coupler Compounds
C-33
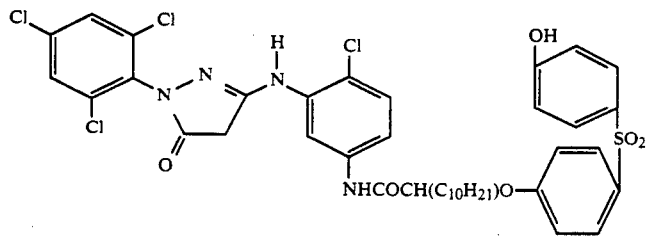
C-34
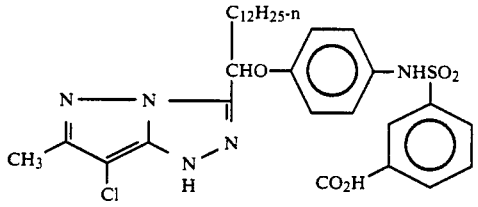
C-35
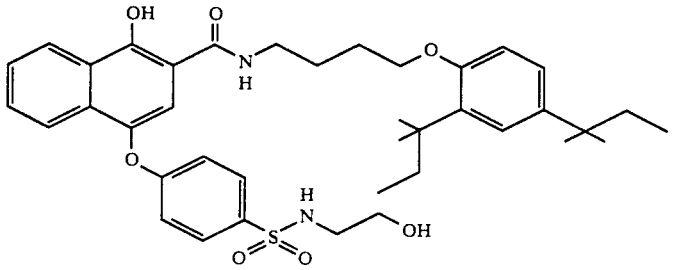
C-36
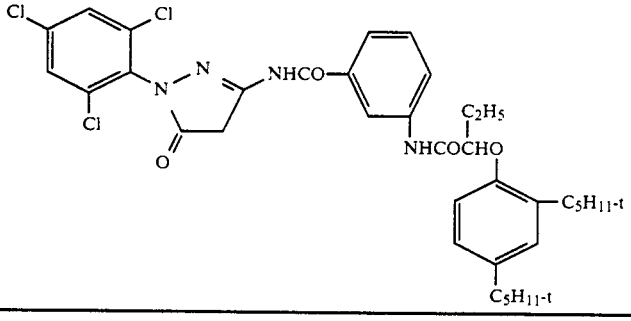
TABLE II
Typical PUG-Releasing Compounds That Release Development Inhibitor Groups or Precursors Thereof
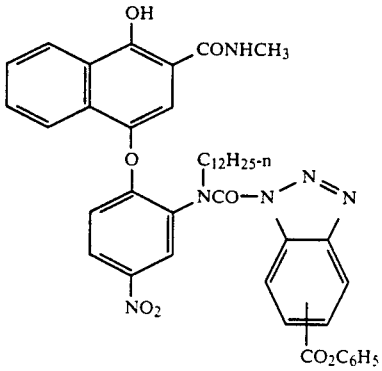
D-1

TABLE II-continued
Typical PUG-Releasing Compounds That Release Development Inhibitor Groups or Precursors Thereof
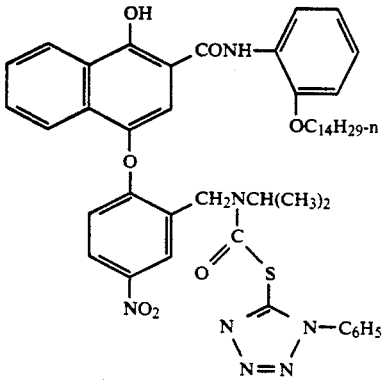
D-2
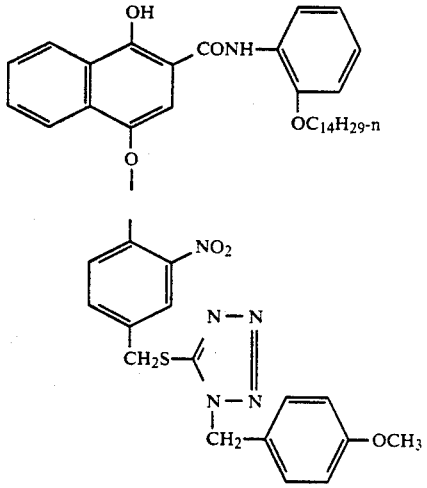
D-3
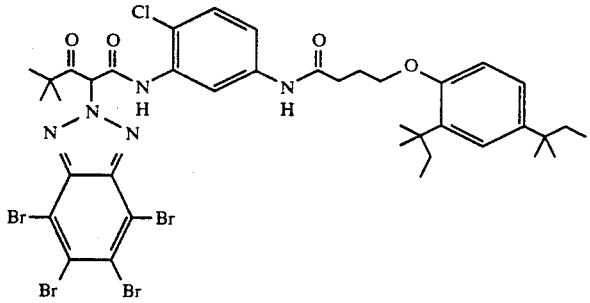
D-4
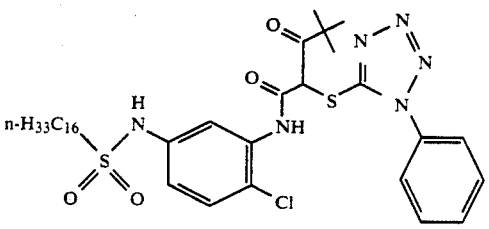
D-5

TABLE II-continued
Typical PUG-Releasing Compounds That Release Development Inhibitor Groups or Precursors Thereof
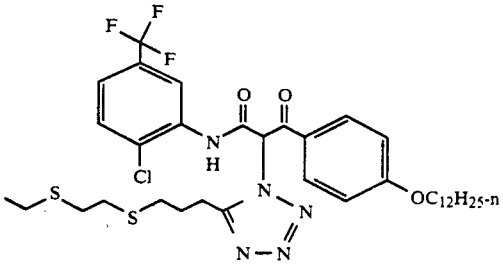
D-6
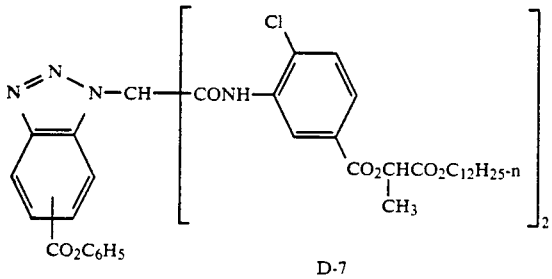
D-7
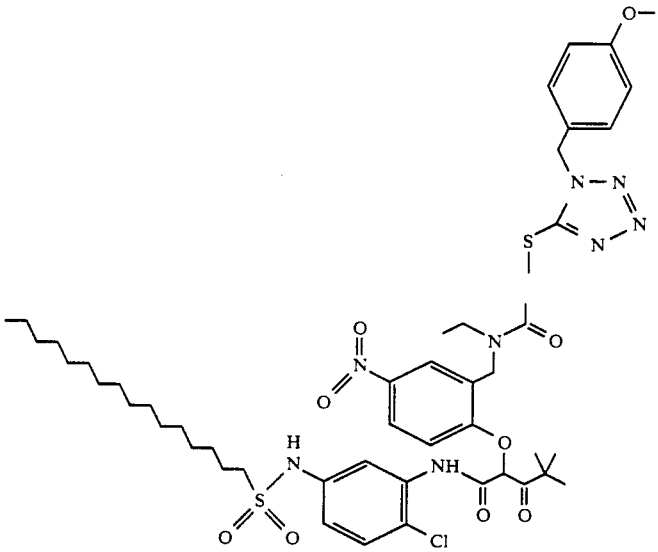
D-8
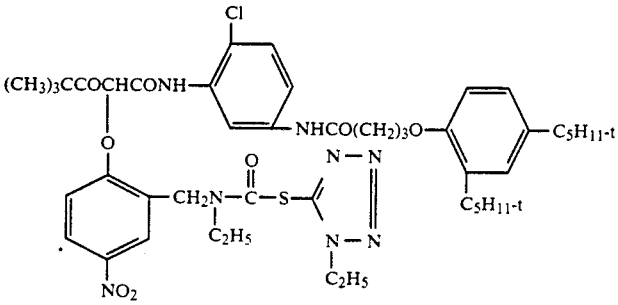
D-9

TABLE II-continued
Typical PUG-Releasing Compounds That Release Development Inhibitor Groups or Precursors Thereof
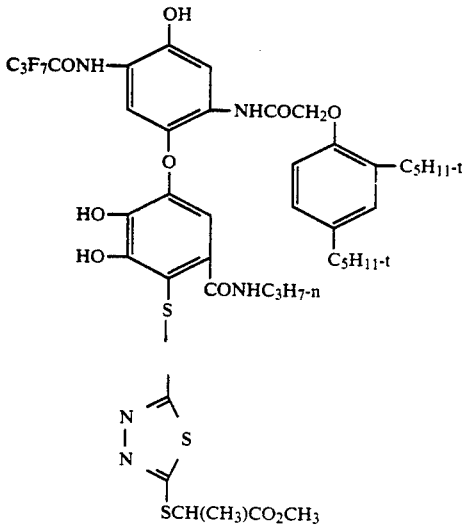
D-10
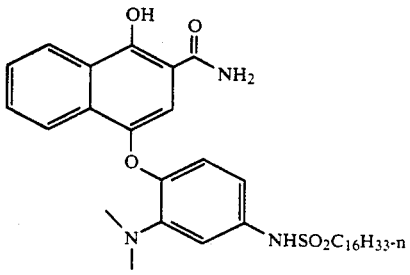
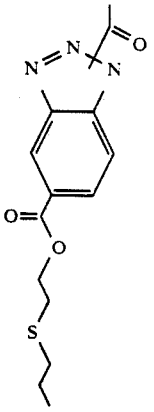
D-12
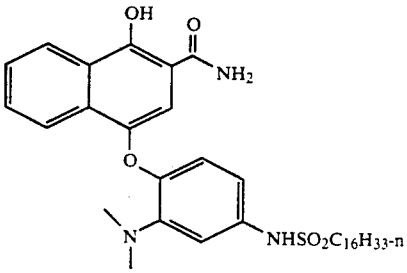

TABLE II-continued
Typical PUG-Releasing Compounds That Release Development Inhibitor Groups or Precursors Thereof
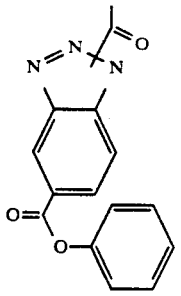
D-13
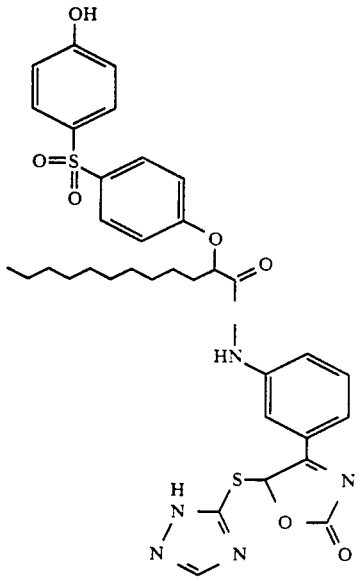
D-14
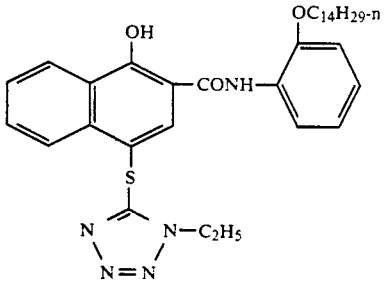
D-15
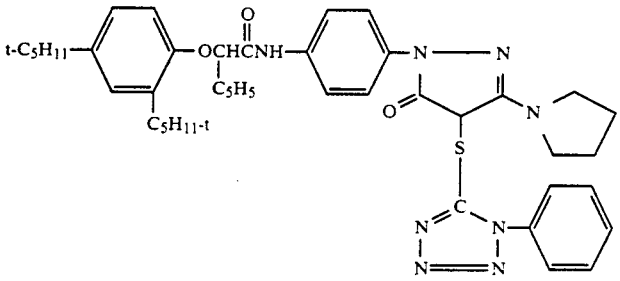
D-16

TABLE II-continued
Typical PUG-Releasing Compounds That Release Development Inhibitor Groups or Precursors Thereof
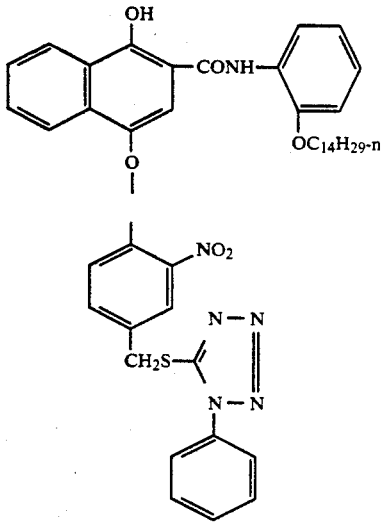
D-17
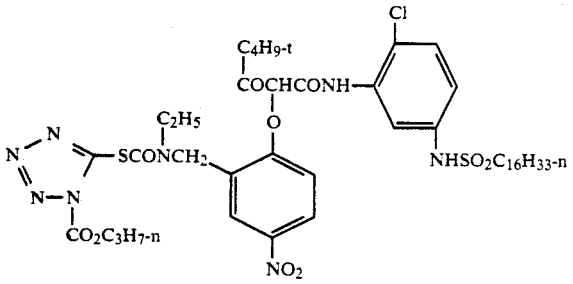
D-18
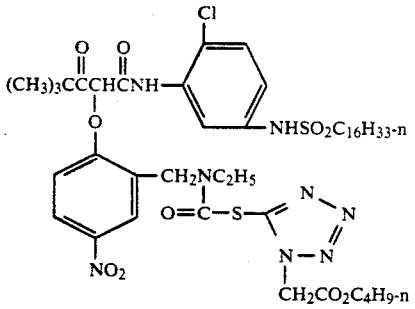
D-19
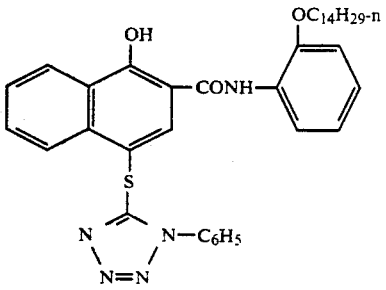
D-20

TABLE II-continued
Typical PUG-Releasing Compounds That Release Development Inhibitor Groups or Precursors Thereof
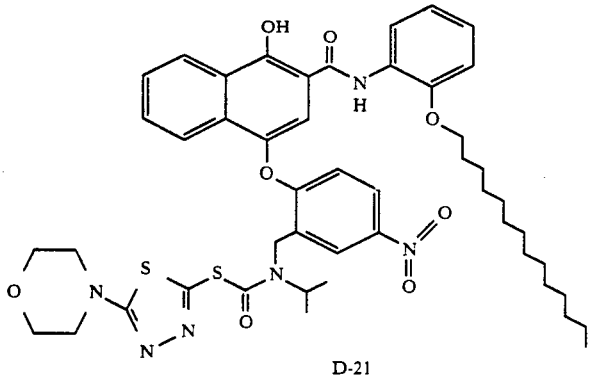
D-21
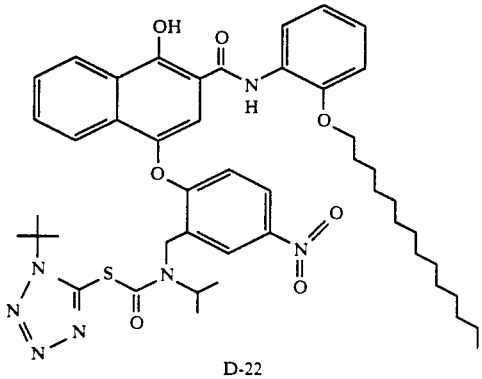
D-22
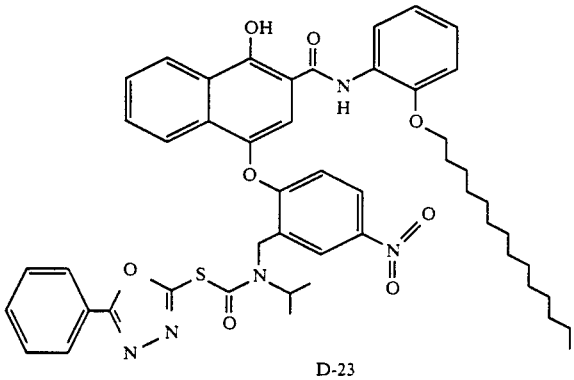
D-23
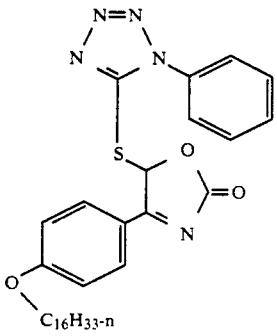
D-24

TABLE II-continued
Typical PUG-Releasing Compounds That Release
Development Inhibitor Groups or Precursors Thereof
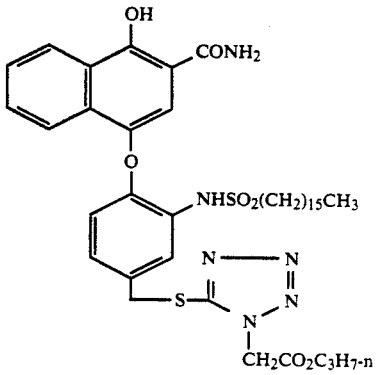
D-25
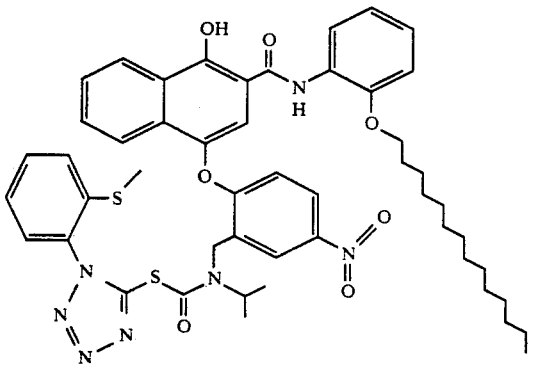
D-26
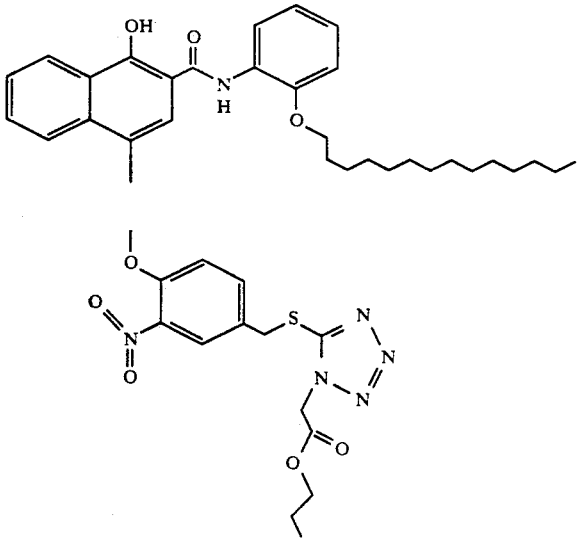
D-27

TABLE II-continued
Typical PUG-Releasing Compounds That Release Development Inhibitor Groups or Precursors Thereof
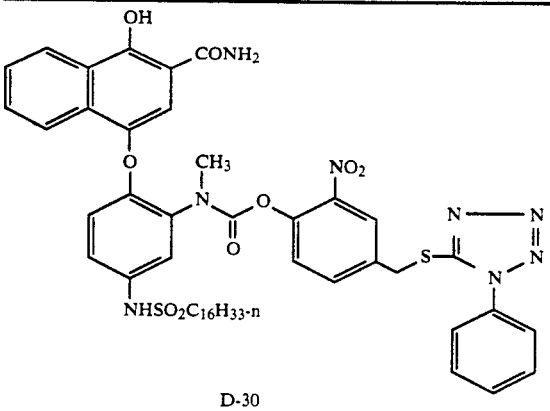
D-30
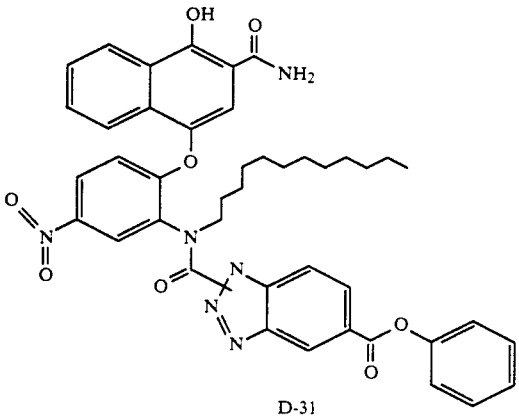
D-31
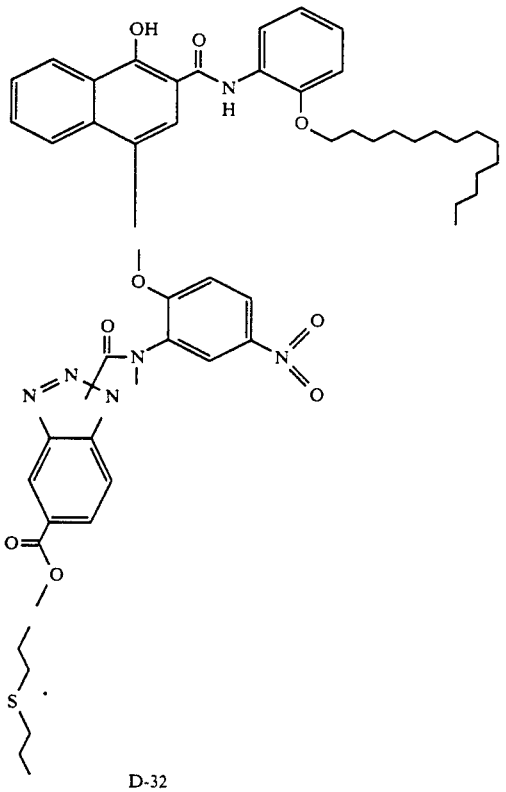
D-32

TABLE II-continued
Typical PUG-Releasing Compounds That Release Development Inhibitor Groups or Precursors Thereof
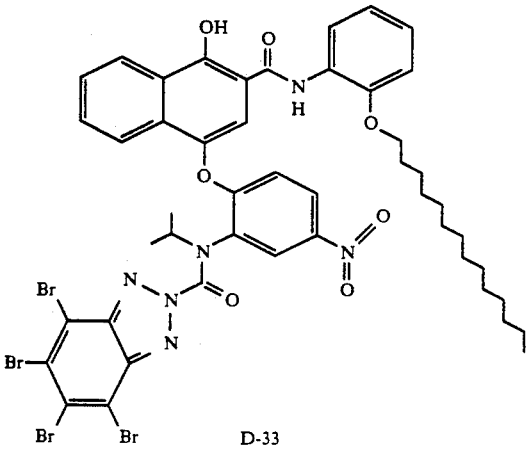
D-33
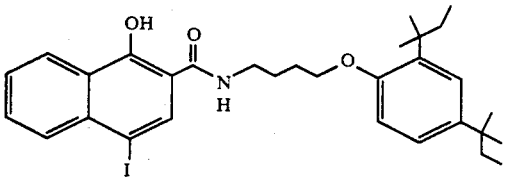
C-45
TABLE III
Typical PUG-Releasing Compounds That Release Groups Other Than Development Inhibitors
| Compound | PUG |
|---|---|
| 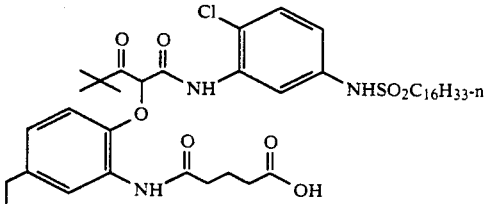 | Dye |
| 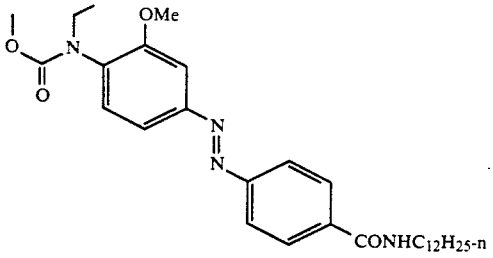 C-37 | |
| 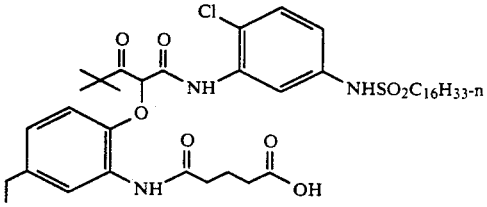 | Dye |

TABLE III-continued
Typical PUG-Releasing Compounds That Release Groups Other Than Development Inhibitors
| Compound | PUG |
|---|---|
| 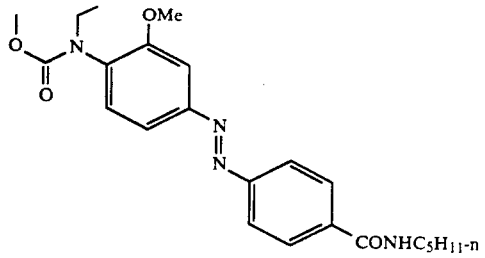 C-38 | |
| 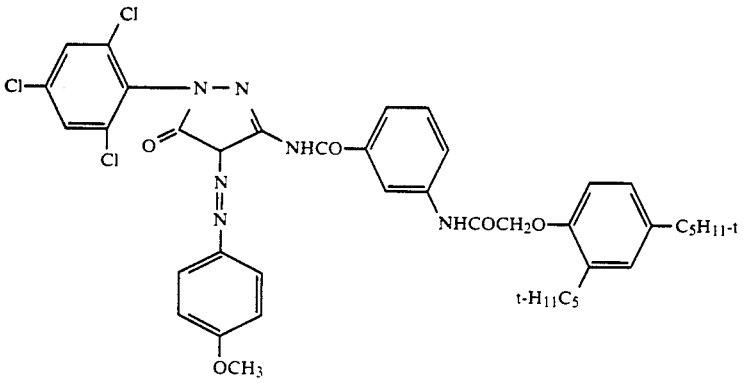 C-39 | Dye |
| 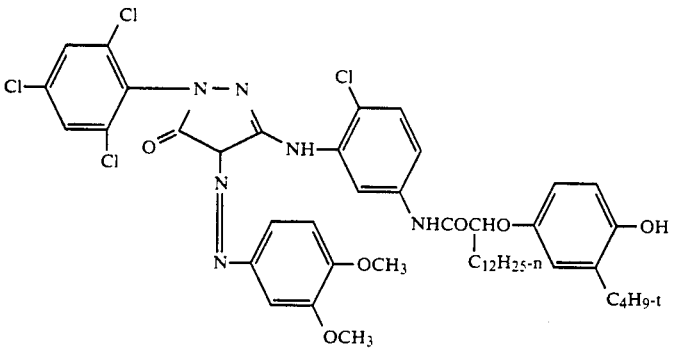 C-40 | Dye |
| 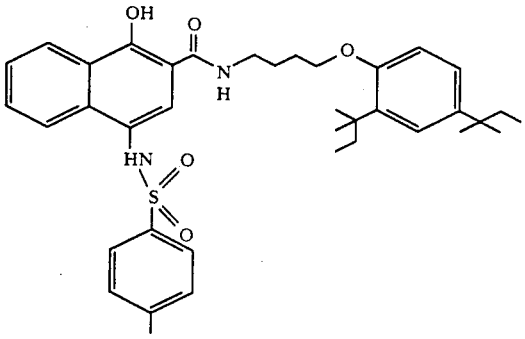 | Dye |

TABLE III-continued
| Typical PUG-Releasing Compounds That Release Groups Other Than Development Inhibitors | |
|---|---|
| Compound | PUG |
| 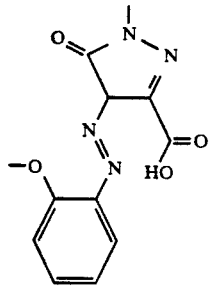 C-41 | |
| 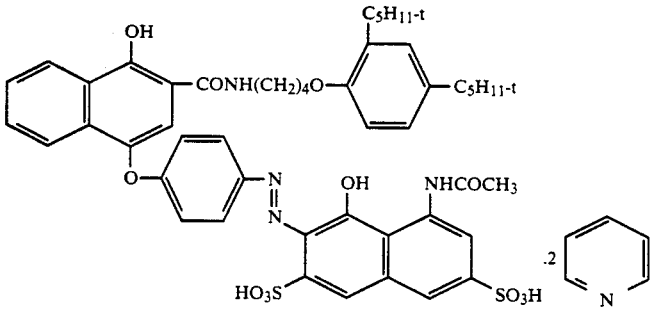 C-42 | Dye |
| 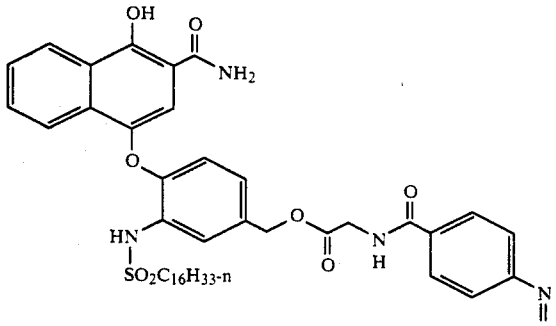 | Shifted Dye |
| 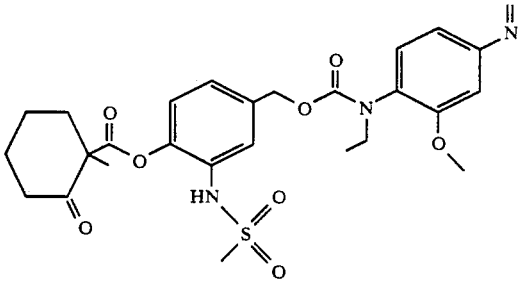 C-43 | |
| 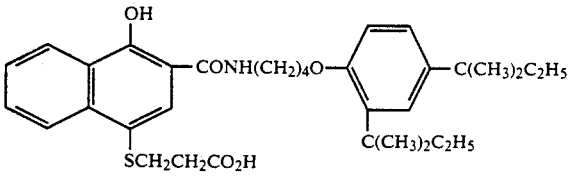 B-1 | Bleach Accelerator |

TABLE III-continued
| Typical PUG-Releasing Compounds That Release Groups Other Than Development Inhibitors | |
|---|---|
| Compound | PUG |
| 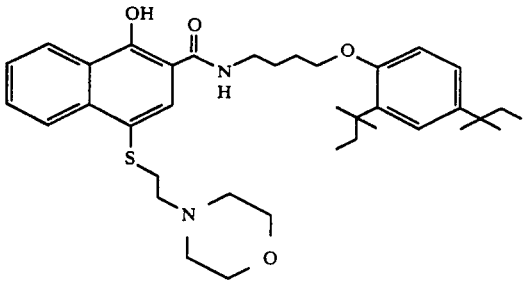 B-6 | Bleach Accelerator |
| 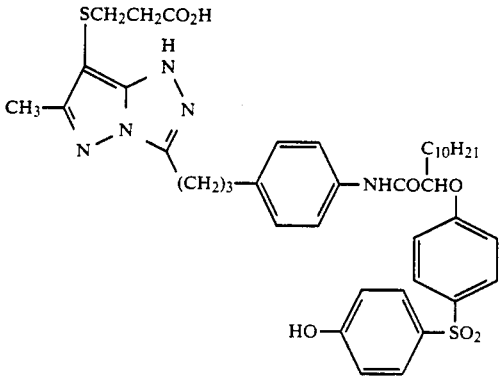 B-36 | Bleach Accelerator |
| 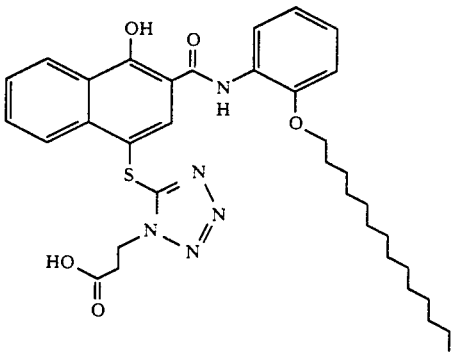 D-28 | Bleach Accelerator |
| 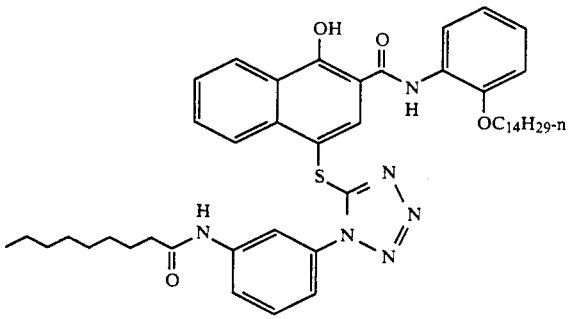 D-29 | Bleach Inhibitor |

TABLE III-continued
Typical PUG-Releasing Compounds That Release Groups Other Than Development Inhibitors
| Compound | PUG |
|---|---|
| 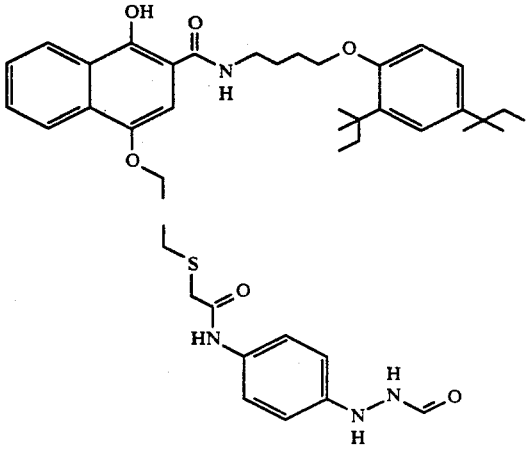 C-49 | Development Accelerator |
| 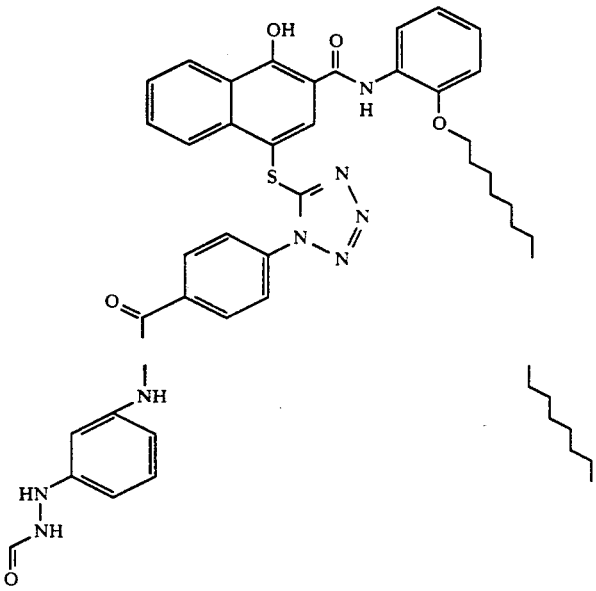 C-50 | Development Accelerator |
| 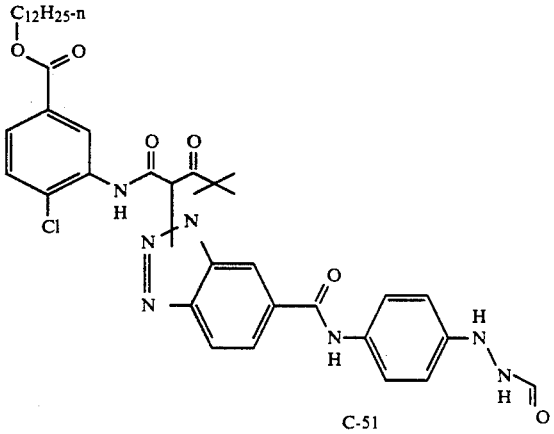 C-51 | Development Accelerator |

TABLE III-continued
| Typical PUG-Releasing Compounds That Release Groups Other Than Development Inhibitors | |
|---|---|
| Compound | PUG |
| 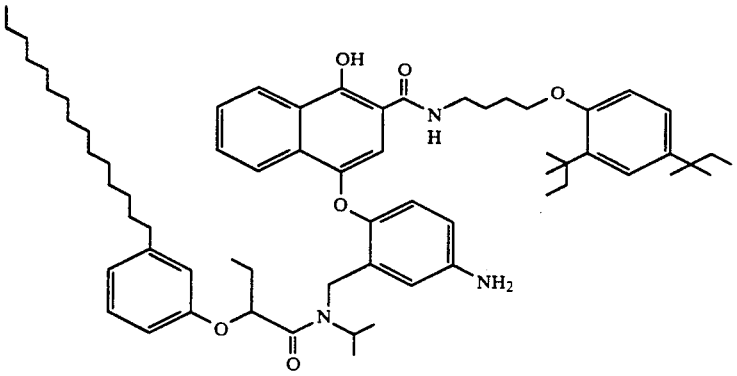 C-46 | Competing Coupler |
| 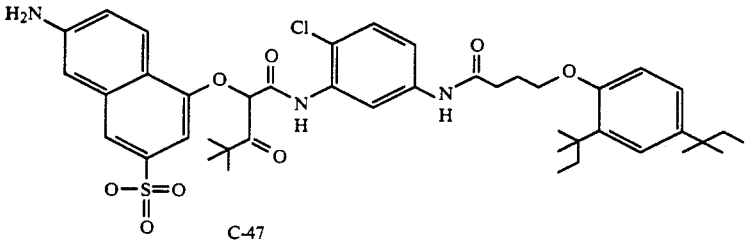 C-47 | Competing Coupler |
| 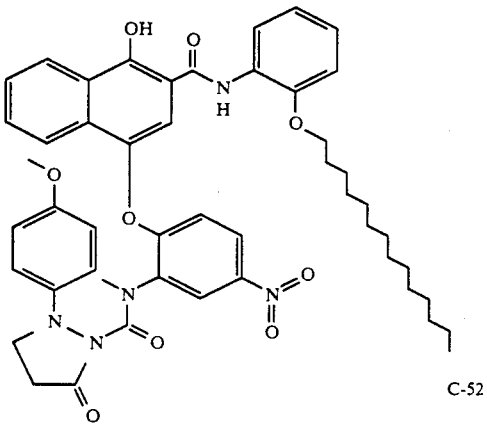 C-52 | Electron Transfer Agent |
TABLE IV
Miscellaneous Exemplary Photographic Compounds
DYE-1
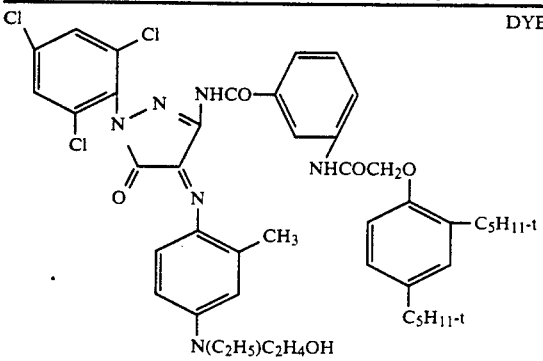
TABLE IV-continued
Miscellaneous Exemplary Photographic Compounds
DYE-2
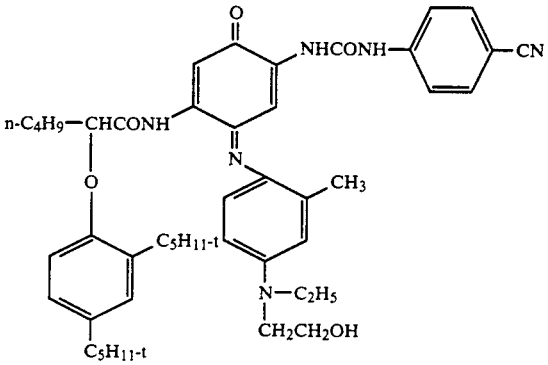

TABLE IV-continued
Miscellaneous Exemplary Photographic Compounds
DYE-3
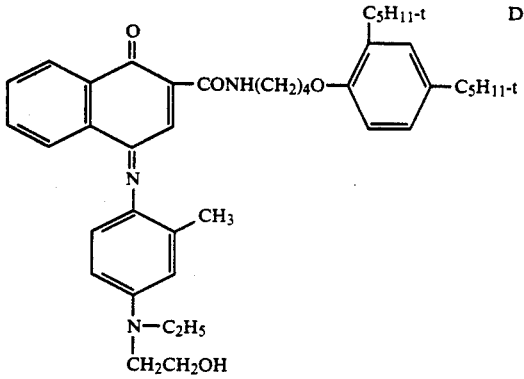
DYE-4
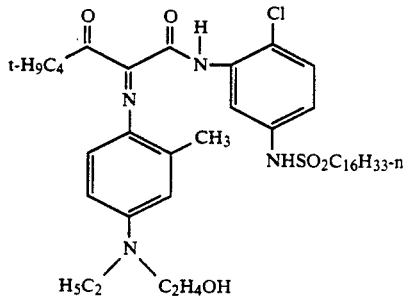
DYE-6
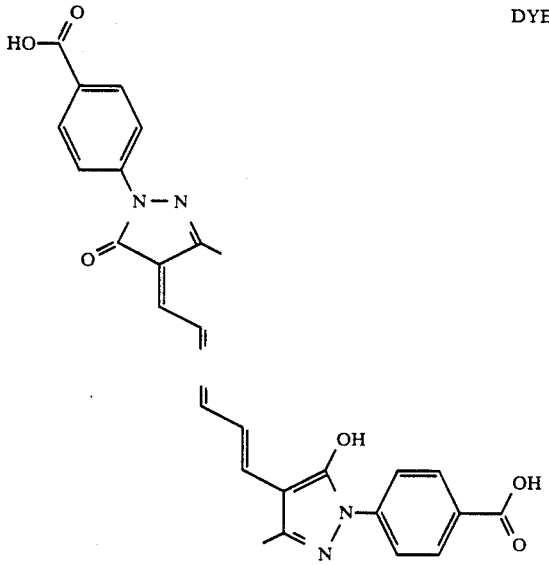
DYE-7
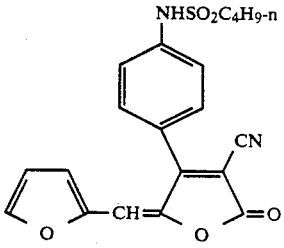
TABLE IV-continued
Miscellaneous Exemplary Photographic Compounds
DYE-8
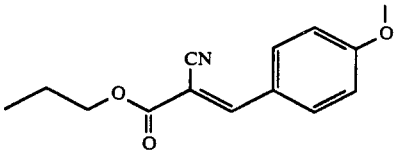
DYE-9
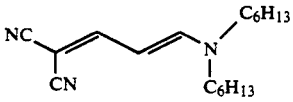
DYE-10
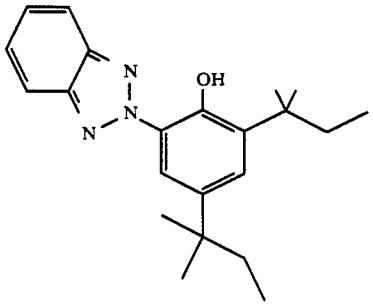
DYE-11
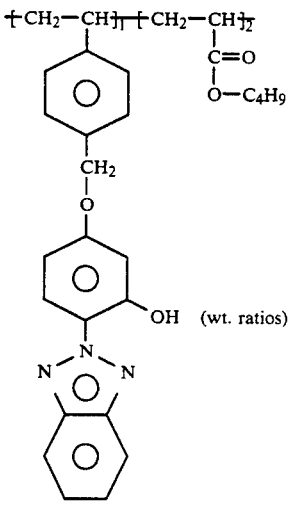
(wt. ratios)
SOL-1
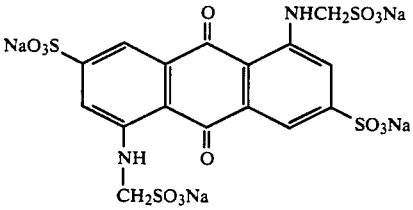
SOL-2
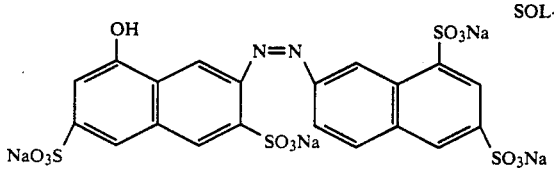
Mixture of Isomeric Didodecylhydroquinones S-1

TABLE IV-continued

Miscellaneous Exemplary Photographic Compounds

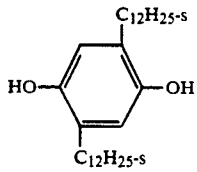

S-2

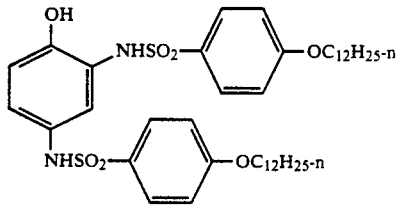

S-3

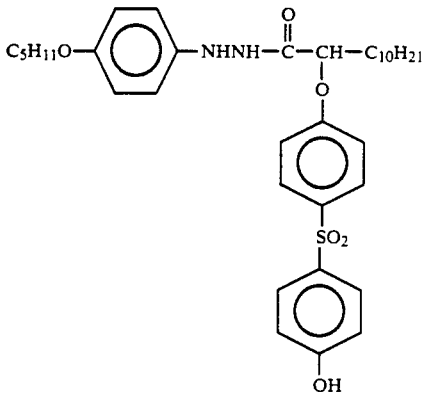

S-4

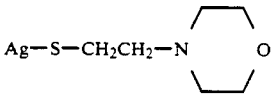

BA-1

Ag—S—$CH_2CH_2CO_2H$ BA-2

The photographic elements can, but need not, contain conventional emulsions, addenda and layers in addition to those specifically described. Such conventional features are disclosed in ICBR-1 through ICBR-14 and Kofron et al U.S. Pat. No. 4,439,520, cited and incorporated by reference above.

Photographic elements containing high chloride {100} tabular grain emulsions according to this invention can be imagewise-exposed with various forms of energy which encompass the ultraviolet and visible (e.g., actinic) and infrared regions of the electromagnetic spectrum, as well as electron-beam and beta radiation, gamma ray, X-ray, alpha particle, neutron radiation and other forms of corpuscular and wave-like radiant energy in either noncoherent (random phase) forms or coherent (in phase) forms as produced by lasers. Exposures can be monochromatic, orthochromatic or panchromatic. Imagewise exposures at ambient, elevated or reduced temperatures and/or pressures, including high- or low-intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process*, 4th Ed., Macmillan, 1977, Chapters 4, 6, 17, 18 and 23.

EXAMPLES

The invention can be better appreciated by reference to the following examples.

Emulsions A-K (Comparative)

These examples demonstrate repeated attempts to form {100} tabular grain emulsions following the teachings of Bogg U.S. Pat. No. 4,063,951. Since the only Example provided by Bogg was directed to a silver iodobromide emulsion, the first emulsion preparations also used iodide and bromide salts. In subsequent preparation attempts chloride and iodochloride emulsion preparations were attempted.

Emulsion A

A 2000 mL solution containing 5.0% by weight bone gelatin and 0.2 mL of tributylphosphate antifoamant was provided in a reaction vessel at 65° C., stirred with a highly pitched, 7.6 cm diameter, three-blade marine propeller at 250 rpm. The initial pH was 5.74. While the solution was stirred, a 4.7 M silver nitrate solution and a 4.465M ammonium bromide and 0.235M ammonium iodide solution were added simultaneously at 21.2 mL/min for 22.2 minutes with the pAg controlled at 6.0. The temperature was then reduced to 45° C. linearly over 10 minutes. After the temperature was reduced, 147 mL of an 11.8M ammonium hydroxide solution were rapidly added and the mixture was held for 10 minutes. The pBr was 3.25 after the ammonia was added.

The resulting emulsion contained relatively polydisperse cubic grains with rounded corners. Out of 672 grains observed on a scanning electron microscope (SEM) at a magnification of 20,000 ×, 21 grains (3%) showed a slight rectangular shape with a ratio of adjacent edge lengths of less than 1.3 and typically 1.1. SEM observations of grains tilted so that the thickness could be observed showed that the few grains present that appeared rectangular exhibited aspect ratios of less than 2.

Emulsion B

The precipitation process was the same as that used for Emulsion A, except that mixing was improved by increasing the rpm of the marine propeller to 600 and the latitude of pAg variation during the preparation more restricted with the pAg being centered at 7.7. The pBr after the ammonium hydroxide was added was 2.7.

The resulting emulsion contained polydisperse spherical grains of about 0.5 in ECD, showing {111} (i.e., octahedral) crystal faces.

Emulsion C

The precipitation process was the same as that used for Emulsion A, except that the marine propeller was replaced by a high rpm mixing device operating at 5000 rpm. The range of pAg variance restricted to the range of 5.7 to 6.5 and was centered at a pAg of 6.1. The pBr after the addition of the ammonium hydroxide was 2.7.

The resulting emulsion contained polydisperse spherical grains with an average ECD of about 0.5 μm, showing (111) faces.

Emulsion D

The precipitation process was the same as that used for Emulsion B, except that immediately after the addition of the ammonium hydroxide, 18.1 mL of 4.7M silver nitrate was added to reduce excess halide and increase the pBr to 3.5 during the 10 minute ripening period.

A sample of the emulsion taken before the temperature was reduced to 45° C. showed a relatively monodisperse population of cubes with an edge length of about 0.2 μm with corners only slightly less rounded than the cubes Emulsion A.

The emulsion appeared essentially similar to Emulsion A, being composed of almost entirely cubic grains with a small percentage of the grains showing a rectangular shape and an aspect ratio less than 2.

Emulsion E

The precipitation process was the same as that used for Emulsion D, except that 39.5 mL of 4.7M silver nitrate were added immediately after the addition of the ammonium hydroxide to further reduce the excess halide and raise the pBr to 3.95 during the 10 minute ripening period.

The resulting emulsion appeared similar to Emulsion D.

Emulsion F

The precipitation process was the same as that used for Emulsion D, except that 115 mL of 4.7M silver nitrate were added immediately after the addition of the ammonium hydroxide to raise the pBr to 5.0 during the 10 minute ripening period.

The resulting emulsion again appeared similar to Emulsion D.

Emulsion G

The precipitation process was the same as that used for Emulsion D, except that 142 mL of 4.7M silver nitrate were added immediately after the addition of the ammonium hydroxide to raise the pBr to 6.1 during the 10 minute ripening period.

The resulting emulsion again appeared similar to Emulsion D.

Emulsion H

The precipitation process was the same as that used for Emulsion F, except that the iodide content in the salt solution was reduced by a factor of 10 by using a solution composed of 4.6765M ammonium bromide and 0.0235M ammonium iodide. The amount of 4.7M silver nitrate added after the ammonium hydroxide addition was increased slightly to 124 mL and the pBr was 5.4.

The resulting emulsion again appeared similar to Emulsions D through G.

Emulsion I

The precipitation process was the same as that used for Emulsion H, except that the amount of silver nitrate added after the ammonium hydroxide dump was 9 mL to adjust the pBr to 3.25 during the 10 minute ripening period.

The resulting emulsion again looked about identical to Emulsions D through H.

Emulsions A and D through H most closely resembled the grain shapes disclosed by Bogg U.S. Pat. No. 4,063,951, but with two differences: (1) the percentage of rectangular grains was much Emulsions above and (2) the average grain diameter was about 0.3 μm. It was not apparent how a silver iodobromide emulsion could be prepared having the grain population disclosed by Bogg using a precipitation procedure of the type taught by Bogg.

The following two emulsions show the results obtained when ammonium bromide was replaced by ammonium chloride.

Example J

The precipitation process was the same as that used for Emulsion A, except that the ammonium bromide and ammonium iodide solutions were replaced with an equimolar amount of ammonium chloride. The pCl during the ripening period was 1.5. No iodide was added.

The resulting emulsion was composed of a wide variety of polymorphic, very low aspect ratio grains showing a variety of crystal faces including {111} faces. A very small number of the grains were square or rectangular, but exhibited aspect ratios of less than 2. The corners of every grain had been modified and showed both {111} and {110} crystal faces. The mean grain ECD was much larger than that of the previous emulsions at about 10 μm.

Emulsion K

This emulsion was prepared identically to Example J, except that ammonium iodide was added to the salt solution such that the composition was 4.465M ammonium chloride and 0.265M ammonium iodide. The pCl during the 10 minute ripening period was 1.6.

The resulting emulsion appeared almost identical to the bromide Emulsions A and D through H, except that most of the emulsion grains had modified corners exhibiting {111} or {110} crystallographic faces. The mean grain ECD was also less than 0.5 μm, as was observed in the bromide examples. This silver iodochloroiodide emulsion also contained a low percentage of grains that were slightly rectangular, but the rectangular grains exhibited an aspect ratio of less than 2. As in Emulsion J, most of the corners of the grains were modified and showed {111} faces.

Based on these investigations it was concluded that a tabular grain emulsion satisfying the requirements of this invention could not be prepared by following the teachings of Bogg U.S. Pat. No. 4,063,951.

Emulsion M (Comparative)

This emulsion preparation demonstrates the inability of a ripening out procedure—specifically the procedure referred to in the 1963 Torino Symposium, cited above—to produce a tabular grain emulsion satisfying the requirements of the invention.

To a reaction vessel containing 75 mL distilled water, 6.75 g deionized bone gelatin and 2.25 mL of 1.0M NaCl solution at 40° C. were simultaneously added with efficient stirring 15 mL of 1.0M $AgNO_3$ solution and 15 mL of 1.0M NaCl solution each at 15 mL per minute. The mixture was stirred at 40° C. for 4 minutes, then the temperature was increased to 77° C. over a period of 10 minutes and 7.2 mL of 1.0M NaCl soluton were added. The mixture was stirred at 77° C. for 180 minutes and then cooled to 40° C.

The resulting grain mixture was examined by optical and electron microscopy. The emulsion contained a population of small cubes of approximately 0.2 μm edge length, large nontabular grains, and tabular grains with square or rectangular major faces. In terms of numbers of grains the small grains were overwhelmingly predominant. The tabular grains accounted for no more than 25 percent of the total grain projected area of the emulsion.

The mean thickness of the tabular grain population was determined from edge-on views obtained using an electron microscope. A total of 26 tabular grains were measured and found to have a mean thickness of 0.38 μm. Of the 26 tabular grains measured for thickness, only one had a thickness of less than 0.3 μm, the thickness of that one tabular grain being 0.25 μm.

EXAMPLE 1

Moderate Aspect Ratio High-Chloride {100} Tabular Grain Emulsion

A 400 mL solution which was 2% in bone gelatin, 6 mM in 3-amino-1H-1,2,4-triazole, 0.031M in NaCl, and 0.20M in sodium acetate was adjusted to pH 6.0 at 75° C. To this solution at 75° C. were added simultaneously, with stirring, 200 mL of 4M $AgNO_3$ at a constant rate of 5.0 mL/min and approximately 200 mL of 4M NaCl at a rate chosen to maintain a constant pCl of 1.40. The resulting AgCl emulsion was comprised of tabular grains having {100} major faces. The grains having an aspect ratio greater than 2 and less than 7.5 made up 85% of the projected area of the total grain population. This tabular grain population had a mean equivalent circular diameter of 1.2 μm, a mean thickness of 0.32 μm , and a mean aspect ratio of 3.8. This emulsion is shown in FIG. 1.

EXAMPLE 2

Moderate Aspect Ratio High-Chloride {100} Tabular Grain Emulsion Made Without Growth Modifier.

A 400 mL solution which was 0.25% in bone gelatin (methionine greater than 30 micromoles per gram gelatin) and 0.008M in NaCl was adjusted to pH 6.2 at 85° C. To this solution at 85° C. were added simultaneously, with stirring, 25 mL of 4M $AgNO_3$ at a constant rate of 5.0 mL/min and 4.5M NaCl at a rate needed to maintain a constant pCl of 2.10. Then the precipitation was stopped and 25 mL of a NaCl-gelatin solution was added. The solution was 1.25M in NaCl and 8.0% in bone gelatin that had been oxidized, as described in Maskasky U.S. Pat. No. 4,713,320; it contained less than 5 micromoles methionine per gram gelatin. The addition of the $AgNO_3$ solution at 5.0 mL/min and the NaCl solution was continued while maintaining a constant pCl of 1.13 until 0.4 mole of silver had been added. The resulting AgCl emulsion contained tabular grains having {100} major faces. The grains having an aspect ratio greater than 2 and less than 7.5 made up 70% of the projected area of the total grain population. This tabular grain population had a mean equivalent circular diameter of 1.58 μm, a mean thickness of 0.27 μm, and a mean aspect ratio of 5.9. This emulsion is shown in FIG. 2.

The invention has been described in detail with particular reference to preferred embodiments thereof, but it will be understood that variations and modifications can be effected within the spirit and scope of the invention.

What is claimed is:

1. A radiation sensitive emulsion containing a silver halide grain population internally free of iodide at the site of grain nucleation comprised of at least 50 mole percent chloride, based on total silver forming the grain population, in which greater than 50 percent of the grain population projected area is accounted for by tabular grains, wherein the tabular grains (a) have parallel major faces lying in {100} crystallographic planes and (b)have an average aspect ratio of up to 7.5.

2. A radiation sensitive emulsion according to claim 1 wherein the average aspect ratio of the tabular grains is at least 5.

3. A radiation sensitive emulsion according to claim 1 wherein the tabular grains have a mean thickness of less than 0.3 μm.

4. A radiation sensitive emulsion according to claim 1 wherein the tabular grains contain less than 2 mole percent iodide, based on silver.

5. A radiation sensitive emulsion according to claim 4 wherein the tabular grains contain less than 1 mole percent iodide, based on silver.

6. A radiation sensitive emulsion according to claim 1 wherein the tabular grains are internally free of iodide.

7. A radiation sensitive emulsion according to claim 1 wherein the tabular grains contain less than 20 mole percent bromide, based on silver.

8. A radiation sensitive emulsion according to claim 7 wherein the tabular grains contain less than 10 mole percent bromide, based on silver.

9. A radiation sensitive emulsion according to claim 1 wherein the tabular grains consist essentially of silver chloride.

10. A radiation sensitive emulsion according to claim 1 wherein the emulsion contains a restraining agent capable of restraining the emergence of non-{100} crystal faces.

11. A radiation sensitive emulsion according to claim 10 wherein the restraining agent is chosen from the class consisting of 3-amino-1H-1,2,4-triazole, 3,5-diamino-1,2,4-triazole, and imidazole.

* * * * *